US012427368B2

(12) United States Patent
Stephenson

(10) Patent No.: US 12,427,368 B2
(45) Date of Patent: Sep. 30, 2025

(54) MULTI-FUNCTION EXERCISE APPARATUS WITH INTEGRATED TREADMILL, EXERCISE PLATFORM, PULL UP AND CHIN UP STATION, PUSH SLED AND RESISTANCE PULLEYS

(71) Applicant: Michael Stephenson, Toronto (CA)

(72) Inventor: Michael Stephenson, Toronto (CA)

( * ) Notice: Subject to any disclaimer, the term of this patent is extended or adjusted under 35 U.S.C. 154(b) by 197 days.

(21) Appl. No.: 18/465,032

(22) Filed: Sep. 11, 2023

(65) Prior Publication Data

US 2024/0082631 A1 Mar. 14, 2024

Related U.S. Application Data

(60) Provisional application No. 63/405,546, filed on Sep. 12, 2022.

(51) Int. Cl.

| | |
|---|---|
| ***A63B 22/02*** | (2006.01) |
| ***A63B 21/00*** | (2006.01) |
| ***A63B 71/06*** | (2006.01) |

(52) U.S. Cl.

CPC ..... *A63B 22/02* (2013.01); *A63B 21/154* (2013.01); *A63B 21/4035* (2015.10); (Continued)

(58) Field of Classification Search

CPC ..... A63B 22/02; A63B 21/151–156; A63B 2225/10; A63B 71/0622

See application file for complete search history.

(56) References Cited

U.S. PATENT DOCUMENTS 7,537,552 B2 * 5/2009 Dalebout ..... A63B 23/1209 482/121
12,186,620 B1 * 1/2025 Lawrence ..... A63B 21/0552
(Continued)

FOREIGN PATENT DOCUMENTS

CN 2053911564 U 7/2016
CN 217745548 U 11/2022
(Continued)

OTHER PUBLICATIONS

PCT International Search Report and Written Opinion. PCT/CA2023/051205. Mailed Dec. 14, 2023.
(Continued)

*Primary Examiner* — Joshua T Kennedy
(74) *Attorney, Agent, or Firm* — Forsgren Fisher McCalmont DeMarea Tysver LLP; James M. Urzedowski; Daniel A. Tysver

(57) ABSTRACT

A multi-functional exercise apparatus includes a treadmill module. The treadmill module includes a running deck extending between a first end and a second end, the running deck being capable of serving as an exercise platform to support a user performing exercises. The treadmill module further includes a plurality of resistance pulleys associated therewith. The multi-functional exercise apparatus includes a center stack attached to the second of the treadmill module. The center stack includes a display screen oriented towards the running deck for a user to interact with, a crossarm module connected to the center stack being movable between a raised position and a lowered position. The apparatus further includes a pull up arm module for performing pull up exercises located adjacent the top of the center stack, the pull up arm module being moveable between a raised and a lowered position.

22 Claims, 49 Drawing Sheets

(52) U.S. Cl.
CPC ..... *A63B 71/0622* (2013.01); *A63B 2210/50* (2013.01); *A63B 2225/093* (2013.01); *A63B 2225/10* (2013.01)

(56) References Cited

U.S. PATENT DOCUMENTS

| | | | | |
|---|---|---|---|---|
| 2005/0049121 | A1* | 3/2005 | Dalebout | A63B 21/078 482/129 |
| 2013/0123073 | A1* | 5/2013 | Olson | A63B 22/02 482/54 |
| 2015/0352396 | A1* | 12/2015 | Dalebout | A63B 22/02 482/54 |
| 2017/0056711 | A1* | 3/2017 | Dalebout | A61B 5/6895 |
| 2017/0319941 | A1* | 11/2017 | Smith | A63B 24/0003 |
| 2018/0021625 | A1* | 1/2018 | Michaels | A63B 21/0552 482/38 |
| 2018/0154205 | A1* | 6/2018 | Watterson | A63B 21/4035 |
| 2022/0409950 | A1* | 12/2022 | Zhu | A63B 22/02 |
| 2023/0055078 | A1* | 2/2023 | Malcolm | A63B 24/0062 |

FOREIGN PATENT DOCUMENTS

| | | | |
|---|---|---|---|
| GB | 2541226 | A | 2/2017 |
| WO | WO2018106603 | A1 | 6/2018 |

OTHER PUBLICATIONS

NordicTrack Fusion CST Studio, Website, https://www.nordictrack.ca/fusion-cst-studio.
NordicTrack Fusion CST, Website, Previously accessible at www.nordictrack.ca/strength/fusion-cst, Now accessible at https://web.archive.org/web/20230202021712/www.nordictrack.ca/strength/fusion-cst.
BowFlex Revolution Home Gym, Website, https://www.bowflex.ca/en-ca/home-gyms/revolution/160000.html.
Tonal, Website, https://www.tonal.com/.
Assault Fitness AssaultRunner Pro, Website, https://www.assaultfitness.com/products/assaultrunner-pro.
Vitruvian, Website, https://vitruvianform.com/.

* cited by examiner

MULTI-FUNCTION EXERCISE APPARATUS WITH INTEGRATED TREADMILL, EXERCISE PLATFORM, PULL UP AND CHIN UP STATION, PUSH SLED AND RESISTANCE PULLEYS

FIELD OF INVENTION

The present disclosure relates generally to exercise equipment and more specifically, to a multi-function exercise apparatus with an integrated treadmill, exercise platform, pull up and chin up station, push sled and resistance pulleys.

BACKGROUND OF THE INVENTION

Many commercial gyms are outfitted with equipment for most exercises, including, but not limited to, dumbbells, barbells and plates, strength machines, stationary bikes, treadmills, squat racks, stair climbers, rowers, and pull up bars. However, a few key challenges are presented with regards to commercial gyms. While a commercial gym may have all the equipment needed to perform a variety of exercises, it may be intimidating or difficult to figure out all of the equipment. In addition, when performing a variety of exercises in a circuit, in many cases, the equipment that may be needed may be used by other persons, and as such, a user may need to wait until said equipment becomes free. Furthermore, when working through a predefined fitness routine or a program with a particular set of timed workouts and rest periods, waiting for a particular piece of equipment can undermine progress and results and be extremely frustrating. This may especially be the case for users who practice high intensity interval training ("HITT"), Tabata, CrossFit or similar types of fitness programs. In addition, while all the equipment may be present in the gym, typically cardio workout machines are not next to weight training machines. As such, if a user's predefined fitness routine or circuit were to perform cardio exercise, and then switch to weights, even if both the cardio machine and the weights were available, a user is forced to run between areas of the gym, taking up additional time and further hampering progress and results.

Home gyms also have their own challenges. While a home gym does not require a user to wait for persons to finish using equipment, users who wish to perform the same exercises as those in commercial gyms will need to purchase a substantial amount of equipment, which can be both costly, and may take up a large physical footprint.

Furthermore, neither home gyms nor commercial gyms provide a single piece of equipment which allows a user to perform both cardio exercises and resistance training or weight training exercises on the same device, in combination, or in short, quick sequenced, multi-exercise intervals, also referred to as "circuit-training".

SUMMARY OF THE INVENTION

According to various aspects of the present invention, there is provided a multi-functional exercise apparatus including a treadmill module, the treadmill module including a first end, a second end, a running deck extending therebetween, the running deck being capable of serving as an exercise platform to support a user performing exercises, and a plurality of resistance pulleys associated therewith. The multi-functional exercise apparatus further includes a center stack attached to the second end of the treadmill module. The center stack includes a display screen oriented towards the running deck for a user to interact with. The display screen is configured to provide instructions to the user in connection with the performance of exercises and display statistics regarding a workout. The center stack further includes a crossarm module connected to the center stack being movable relative hereto between a raised position and a lowered position. The crossarm module includes a first rotatable arm extending from a right side of the center stack, and a second rotatable arm extending from a left side of the center stack. The crossarm module further includes at least one resistance pulley associated with each of the first rotatable arm and the second rotatable arm. The center stack also includes a pull up arm module for performing pull up exercises located adjacent a top of the center stack, the pull up arm module being movable between a raised position and a lowered position, the pull up arm module including arms on either side of the pull up arm module. The multi-functional exercise apparatus being configured to allow the user to perform a variety of exercises using the treadmill module, the crossarm module or the pull up arm module in rapid succession.

The running deck of the treadmill module may include a treadmill platform that may be inclinable and declinable.

The treadmill module may further include a treadmill inclination adjustment assembly. The treadmill inclination adjustment assembly may include a pneumatic cylinder pivotally connected to the treadmill platform.

The running deck may include a treadmill belt that may be placed in a locked, freely movable or powered configuration.

The treadmill module of the multi-functional exercise apparatus may have a rectangular footprint, where the plurality of resistance pulleys may be located along margins of the rectangular footprint.

In addition, the plurality of resistance pulleys may include four resistance pulleys.

Furthermore, each of the four resistance pulleys may be located in proximity to a corner of the treadmill module.

The display screen of the multi-functional exercise apparatus may include a touch screen.

The center stack of the multi-functional exercise apparatus may include at least one rail upon which the crossarm module is mounted on, the crossarm module being configured to slide upon the at least one rail to move between the raised position and the lowered position.

The multi-functional exercise apparatus may further include a motor to move the crossarm module between the raised position and the lowered position.

The multi-functional exercise apparatus may further include a controller, the motor being controllable by the controller, the controller being directed by a processor, the processor receiving instructions from the display, where the user is able adjust the height of the crossarm module by interacting with the display.

The first and second rotatable arms of the crossarm module may be movable between a push sled exercise position and a stowage position. In the push sled exercise position each of the first and second rotatable arms presenting a vertical section oriented towards the user to push against while performing a push sled exercise.

The crossarm module may include a third rotatable arm and a fourth rotatable arm. The third rotatable arm may extend from the right side of the center stack and the fourth rotatable arm may extend from the left side of the center stack.

The third and fourth rotatable arm may be movable to a treadmill exercise position, in the treadmill exercise position the third and fourth rotatable arms being rotated to serve as safety bars for the user when using the running deck.

The center stack of the multi-functional exercise apparatus further including a center resistance pulley oriented towards the treadmill module.

The center stack of the multi-functional exercise apparatus further including an inner mast and an outer mast. The inner mast extends from the treadmill module upwardly and the outward mast surrounding the inner mast. The pull up arm module to travel along the inner mast to move between the raised position and the lowered position.

Alternatively, the center stack of the multi-functional exercise apparatus includes a central mast and an extension mast secured to the top of the central mast. The pull up arm module to travel along the extension mast to move between the raised position and the lowered position.

The multi-functional exercise apparatus may include a motor to move the pull up arm module between the raised position and the lowered position.

The multi-functional exercise apparatus may further include a controller, the motor being controllable by the controller, the controller being directed by a processor, the processor receiving instructions from the display, where the user is able to adjust the height of the pull up arm module by interacting with the display.

A bicycle or wheelchair may be securely attached to a surface of the running deck of the multi-functional exercise apparatus via the plurality of resistance pulleys associated with the treadmill module, allowing the user to perform circling exercises.

BRIEF DESCRIPTION OF THE DRAWINGS

The embodiments of the present invention shall be more clearly understood with reference to the following detailed description of the embodiments of the invention taken in conjunction with the accompanying drawings, in which.

DESCRIPTION OF THE PREFERRED EMBODIMENTS OF THE INVENTION

Figure 1:
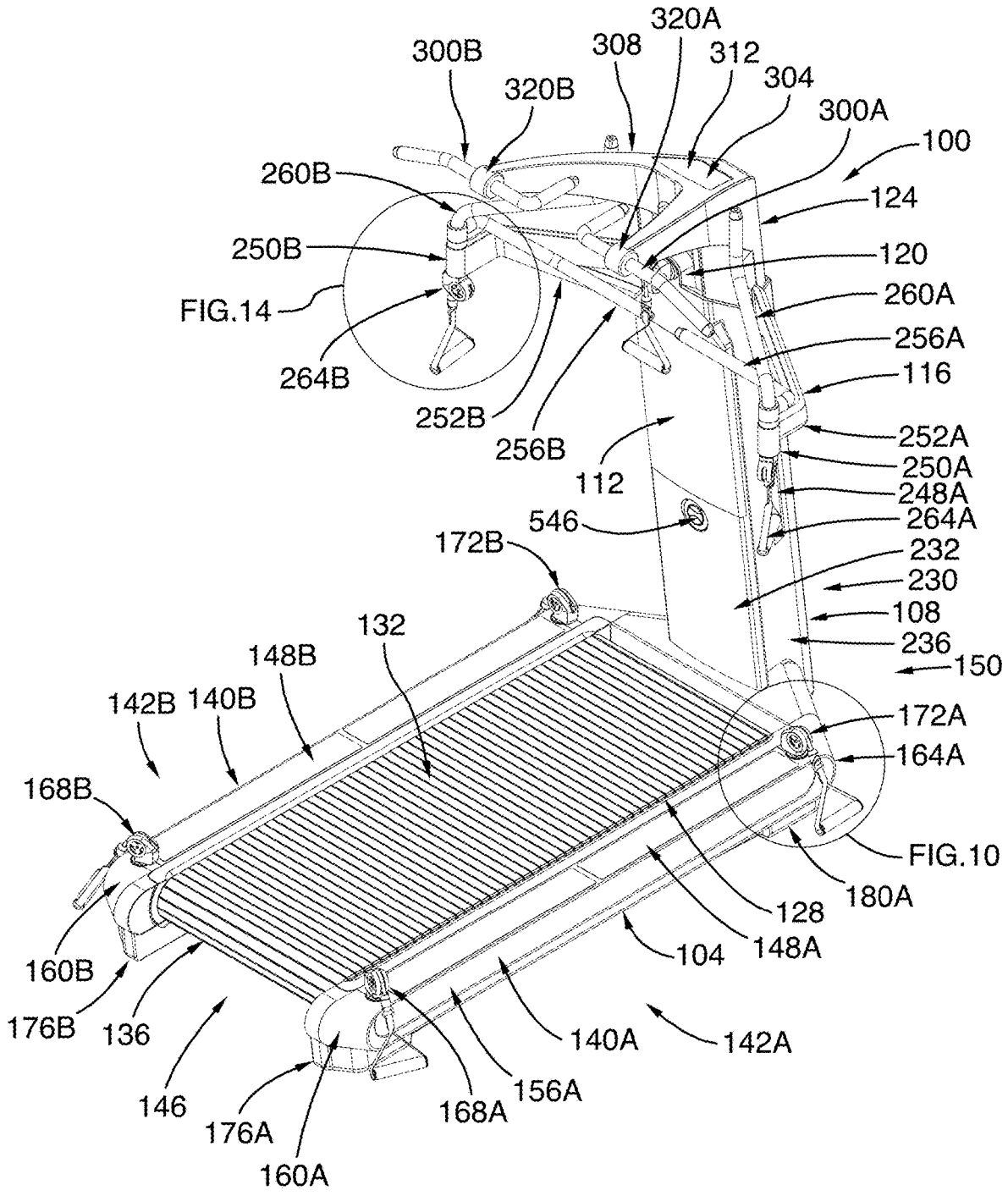
FIG. 1 is a front left perspective view of an exercise apparatus depicted in a configuration where the treadmill platform is in a lowered position, the adjustable center arm module is in a raised position, and the pull up arm module is in a raised position, according to an embodiment of the present invention.
Figure 2:
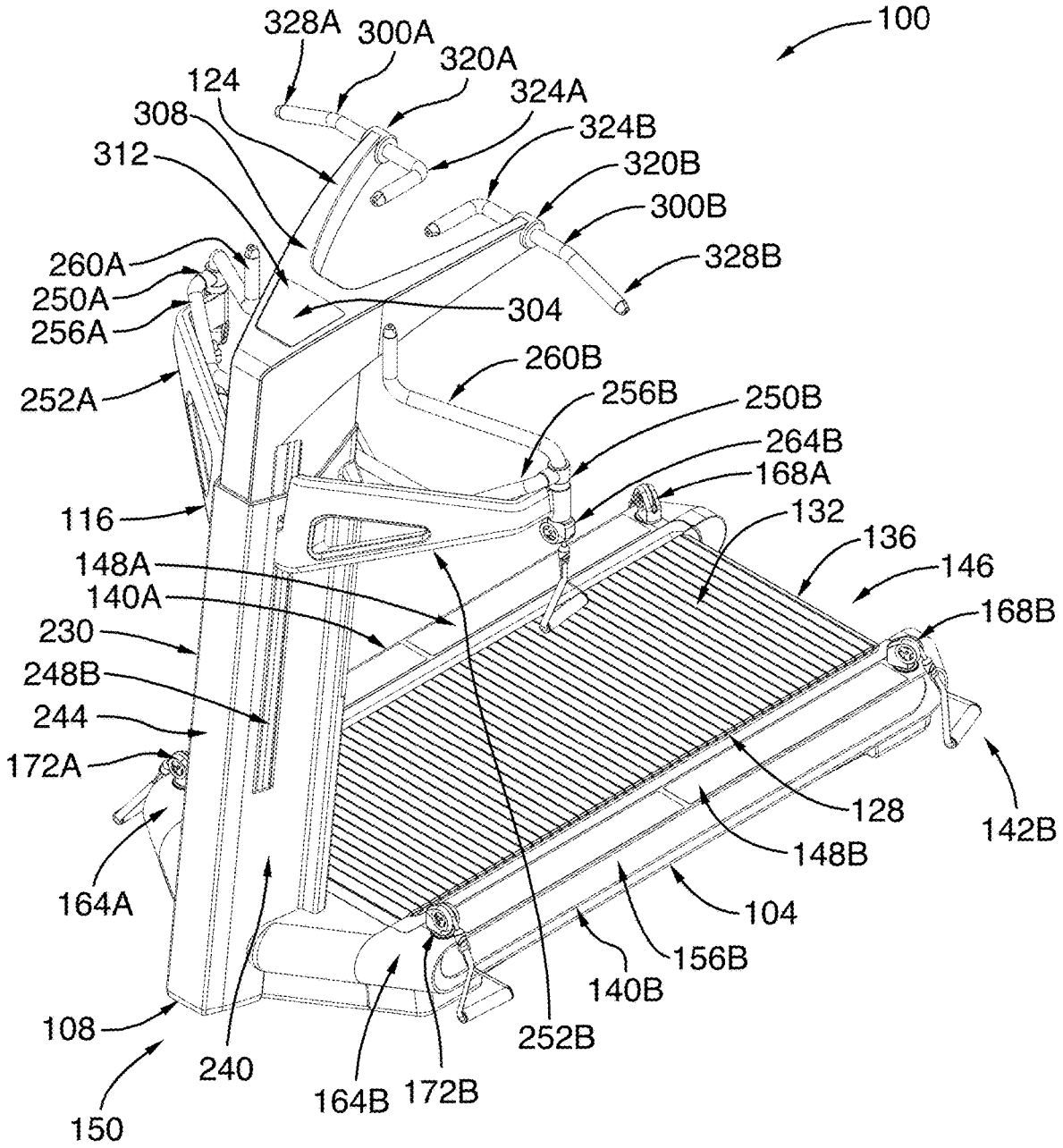
FIG. 2 is a rear right perspective view of the exercise apparatus shown in FIG. 1.
Figure 3:
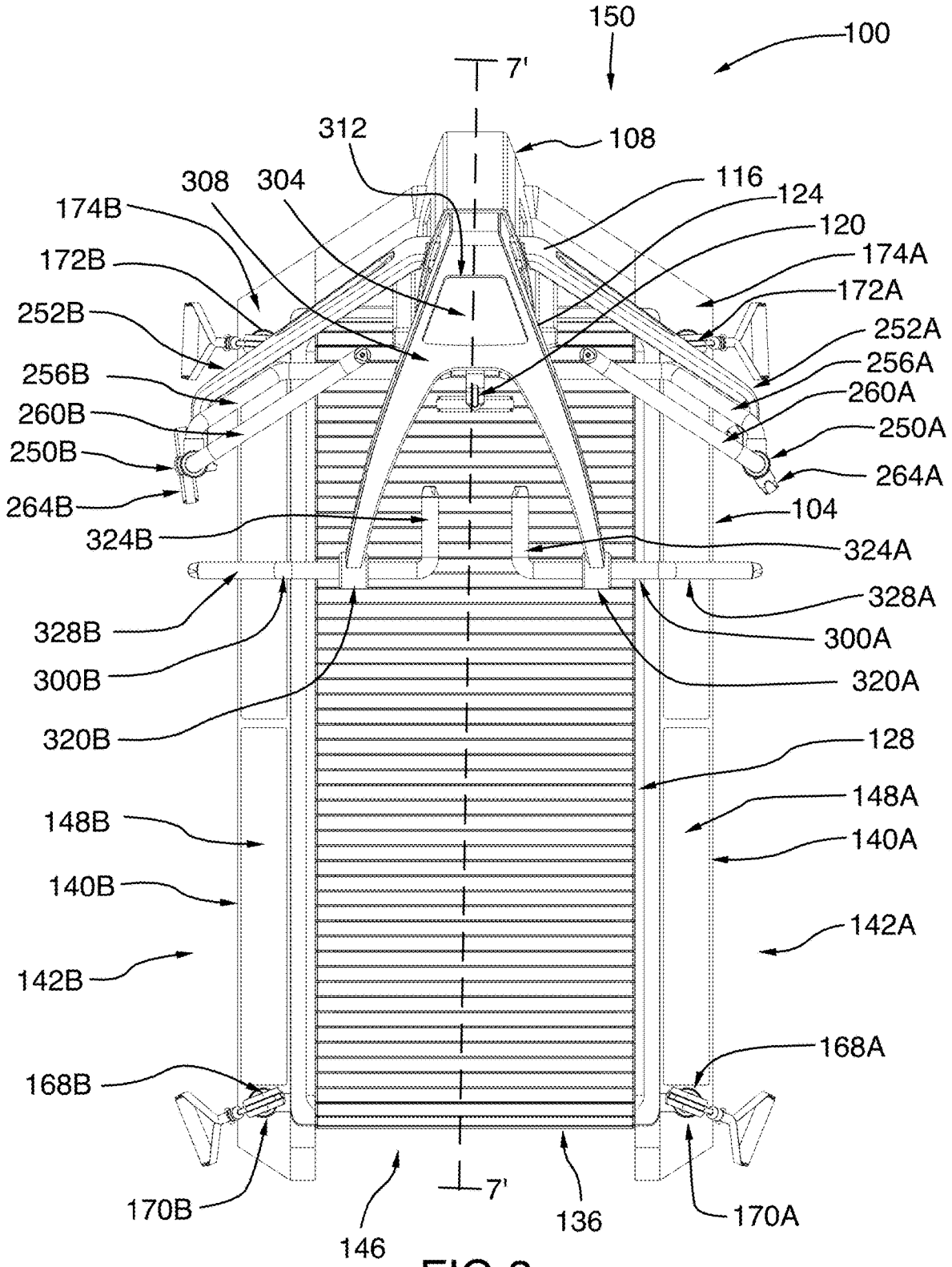
FIG. 3 is a top plan view of the exercise apparatus shown in FIG. 1.

The description, which follows, and the embodiments described therein are provided by way of illustration of an example, or examples of particular embodiments of principles and aspects of the present invention. These examples are provided for the purposes of explanation and not of limitation, of those principles of the invention. In the description that follows, like parts are marked throughout the specification and the drawings with the same respective reference numerals.

By way of general overview, there is provided a multi-functional exercise apparatus with an integrated treadmill, exercise platform, pull up and chin up station, push sled and resistance pulleys that allows a user to perform multiple exercises, including cardio and resistance based training. In addition, the exercise apparatus disclosed tends to address the challenges identified above, by allowing users to perform both cardio and resistance based training/exercises, either on their own, or concurrently, or within short intervals or rapid succession one after another, within the same space, reducing the time in between activities and also solving the issue pertaining to waiting for equipment to free up.

The exercise apparatus has a treadmill module provided with a running deck which serves as an exercise platform to support the user while performing strength training services. When actuated, the treadmill platform provides a useable surface on which a user can walk, run, or sprint. The treadmill platform may be inclinable up to 20 degrees and declinable up to 2 degrees, and provide a top speed of 25 mph. But advantageously when the treadmill module is not in operation, the platform may be locked to do floor type exercises without needing to leave the exercise apparatus. Alternatively, the treadmill platform may also be allowed to freely move to allow the user to perform exercises similar to a sled push exercise, where the freely moving treadmill simulates the movement of pushing. In alternate embodiments, there may be an area surrounding the treadmill platform to provide additional surface area for the user to perform floor type exercises.

At the rear of the treadmill module is a center stack which is configured to provide strength training functionality and also offer a display screen for the user. The display screen may be oriented towards the running deck for a user to interact with. The display screen includes a touch screen and control panel to provide instructions and display statistics regarding the user's workouts. Through interacting with the touch screen, the user may control the treadmill module and adjust the resistance on the pulleys. In alternate embodiments, the user may also control functions on the touch screen through physical buttons or rotary knobs. The center stack may also include speakers to broadcast sound or music from applications on the display screen.

The center stack also includes a crossarm module which may also be setup in different configurations for different exercises. More specifically, crossarm module may be lowered and lower arms of crossarm module may be rotated outwards to create safety handles on either side of the treadmill platform. In an alternate configuration, lower arms and upper arms of crossarm module may be folded out of the way in a stowage position so as to avoid obstructing or so as not to obstruct or otherwise interfere with the performance of exercises using the various resistance pulleys. In an alternate configuration, upper arms of crossarm module may be rotated to allow a user to perform a sled push exercise when used in conjunction with the treadmill module. Crossarm module may also be height adjustable providing for additional configurations. In alternate embodiments, the crossarm module may also have a cup holder and/or a phone holder.

The center stack further includes a pull up arm module located at the top of the center stack. Pull up arm module may be raised or lowered depending on the height of the user or the ceiling height clearance where the device is located to provide the proper height for a user to perform pull up or chin up exercises. Arms on the pull up arm module allow a user to either perform a neutral grip chin up exercise, or a wide grip pull up exercise.

It will be appreciated by the person skilled in the art that strength and resistance training functionality is integrated throughout the exercise apparatus, affording a wide variety of exercises, angles and movements. Resistance training through resistance pulleys and cables may be provided either though mechanical means, or through magnetic means built into the exercise apparatus. In the preferred embodiment, there are a total of seven different resistance pulleys: four located on the treadmill module—one located at each corner thereof, two integrated into the crossarm module on the center stack, and a single resistance pulley at the center and near the top of center stack below the pull up arm module, and above the crossarm module. With seven resistance pulleys disposed at different locations, the user is able to incorporate a wide range of exercises into workouts. Each of the seven resistance pulleys may provide an adjustable range of resistance.

The resistance pulleys may also be used with a variety of accessories and other exercise equipment by replacing the standard handle with another accessory, such as connecting the resistance pulleys to a bicycle or a wheelchair on the treadmill to hold the bicycle or wheelchair in place and for a user to cycle on the treadmill.

All of the aforementioned configurations of the treadmill module, the crossarm module, the resistance pulleys, and the pull up arm module allow are adjustable in resistance and height through a controller and a touch screen interface, allowing for well over 200 types of strength and cardio exercises, all available through a single exercise apparatus.

Referring to FIGS. 1 through 6, there is shown an apparatus for performing cardio and resistance based exercises generally designated with reference numeral 100, also referred to herein as exercise apparatus 100. The main components of the exercise apparatus 100 are a treadmill module 104, a center stack 108 connected to the treadmill module 104 along a portion thereof; a pull up arm module 124 (also referred to herein as a pull up and chin up station 124) carried on and movable relative to the center stack 108; a crossarm module 116 connected to the center stack 108; and a plurality of resistance pulleys associated with the treadmill module 104 and the center stack 108. Exercise apparatus 100 also includes a computer and a controller to adjust the positioning and configurations of treadmill module 104, crossarm module 116 and pull up arm module, and the resistance of the resistance pulleys, based on input from the user.

Figure 7:
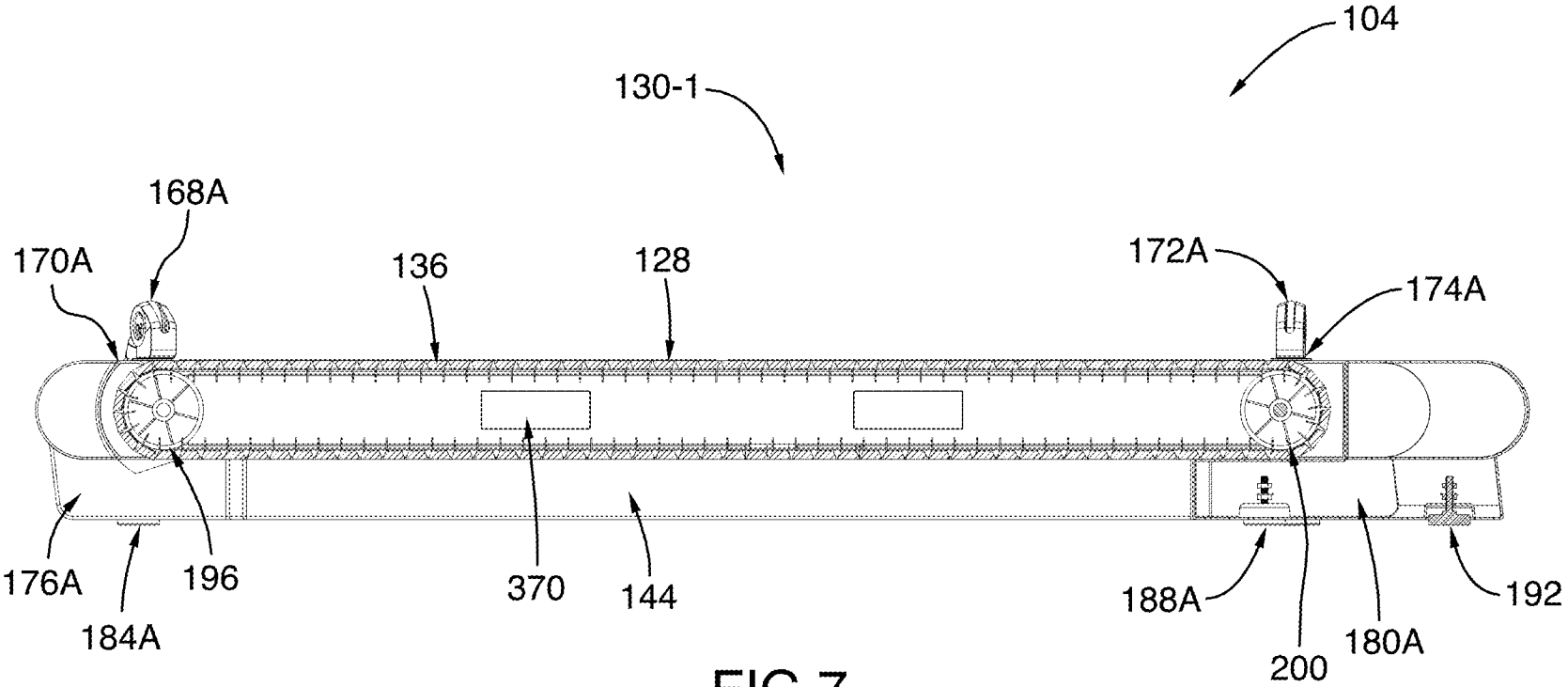
FIG. 7 is a cross sectional view of the treadmill of the exercise apparatus illustrated in FIG. 3 taken along line '7-7' with the center stack removed, depicting the internal workings of the treadmill module.
Figure 8:
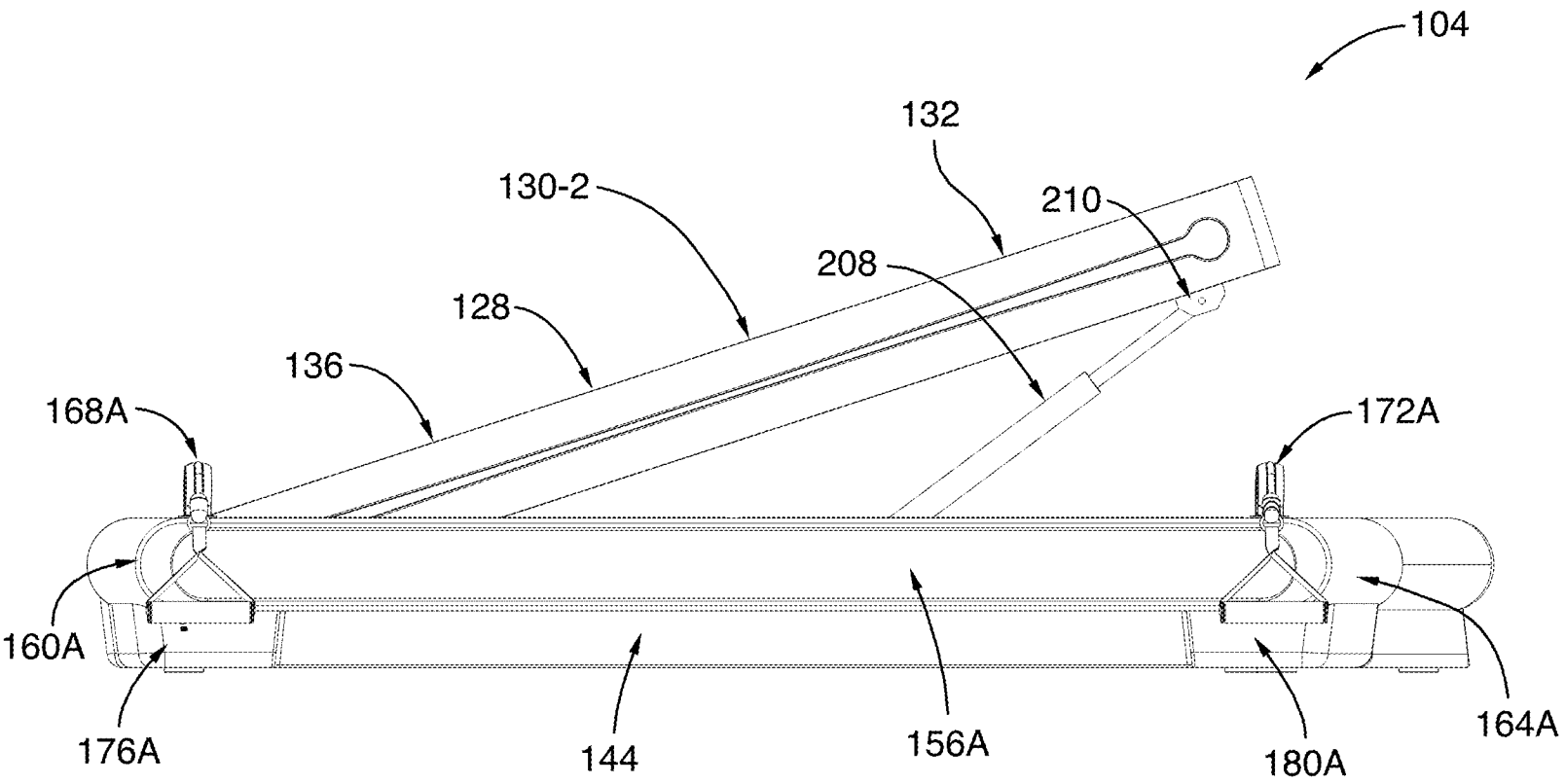
FIG. 8 is a right side view of the treadmill module of the exercise apparatus similar to that shown in FIG. 5, but with the center stack removed, and the treadmill platform shown in a raised position.
Figure 9:
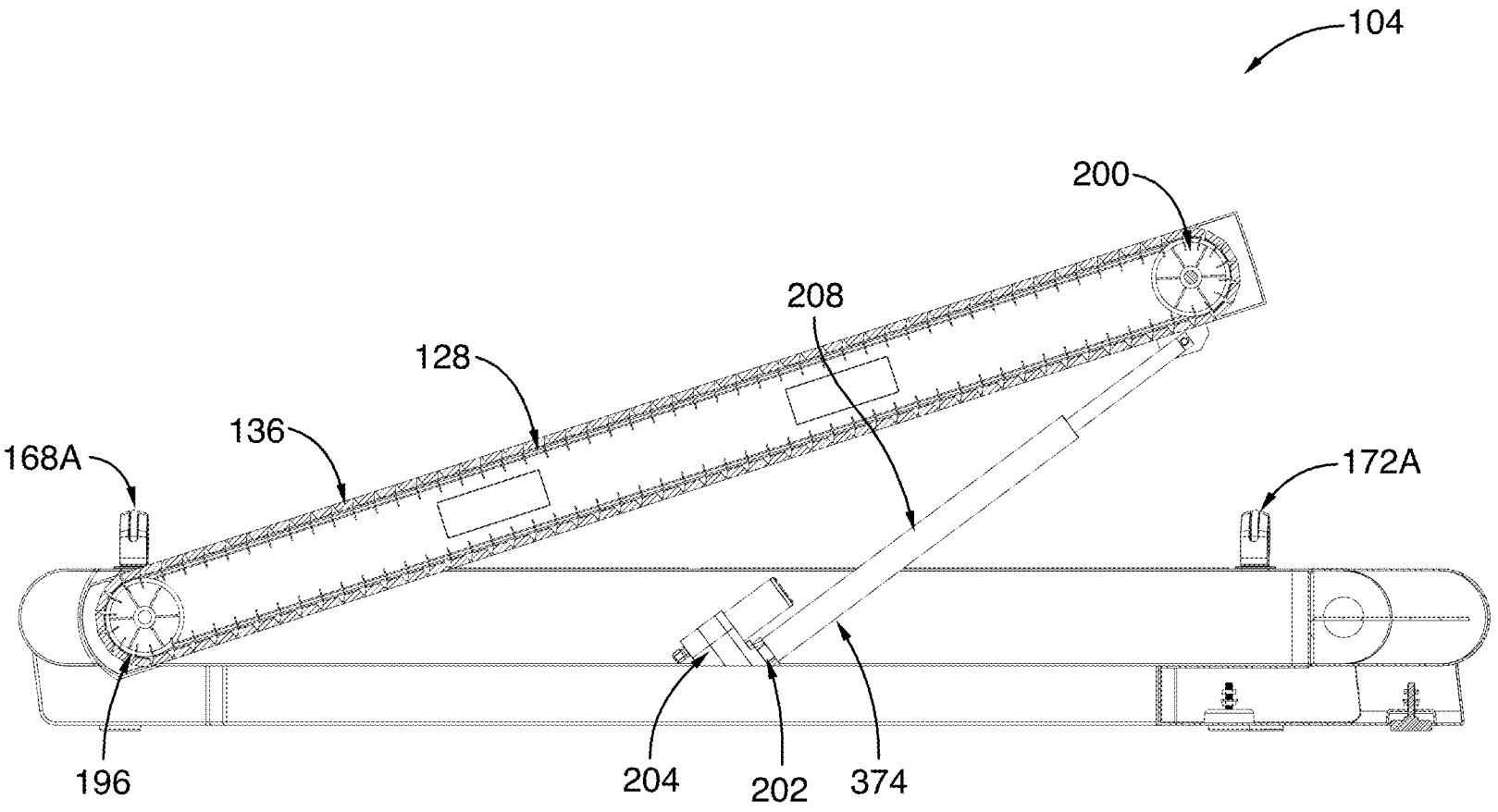
FIG. 9 is a cross-sectional view of the treadmill module similar to that shown in FIG. 7, except that the treadmill platform is shown in the raised position.

Referring to FIGS. 7, 8, and 9 treadmill module 104 includes a treadmill platform for a user to perform cardio exercises, and also as an exercise platform 132 for the user to stand on to perform resistance training and use components on center stack 108, such as crossarm module 116 and center resistance pulley 120, for exercise.

Treadmill module 104 has a generally rectangular shape or rectangular footprint with two sides along the right side 142A and left side 142B of treadmill module 104 being longer than the two sides along the front 146 and rear 150 of treadmill module 104. The right and left sides 142A and 142B of treadmill module 104 define the length of treadmill module 104 while the front side 146 and rear sides 150 of treadmill module 104 define the width of treadmill module 104. Extending between the left and right and front and rear sides of the treadmill module is a running deck 128 supported on a frame (not shown). The running deck 128 is disposed between a first enclosure 140A to the right of running deck 128 and a second enclosure 140B to the left of running deck 128, also referred to herein as right enclosure 140A and left enclosure 140B.

Right enclosure 140A and left enclosure 140B are similar and mirror each other. The shape of right enclosure 140A is substantially rectangular defined by a top face 148A, an opposite bottom face 152A, outer side panel 156A, front end cap 160A and rear end cap 164A, where the length of right enclosure 140A is at least as long as the length of tread belt 136 (also referred to herein as treadmill belt 136). Similarly, the shape of left enclosure 140B is substantially rectangular defined by a top face 148B, an opposite bottom face 152B, an outer side panel 156B, front end cap 160B and rear end camp 164B.

All surfaces of right enclosure 140A, and left enclosure 140B, including top faces 148A and 148B, bottom face 152A and 152B, side panel 156A and 156B, end caps 160A, 164A, 160B and 164B may be constructed of a relatively rigid, ABS plastic. It will however be appreciated that other materials, either in addition to or in replacement of ABS plastic, may be used as well.

Along bottom faces 152A and 152B of right enclosure 140A and left enclosure 140B, there are legs to lift treadmill module 104 off the supporting surface and ensure that treadmill belt 136 is elevated off the supporting surface. In the current embodiment, there are four legs, legs 180A, 176A, 180B and 176B. Leg 180A is located on bottom face 152A, on the end of right enclosure 140A that is at the rear of treadmill module 104. Leg 176A is located on bottom face 152A, on the end of right enclosure 140A that is at the front of treadmill module 104. Leg 180B is located on bottom face 152B, on the end of left enclosure 140B that is at the rear of treadmill module 104. Leg 176B is located on bottom face 152B, on the end of left enclosure 140B that is at the front of treadmill module 104. While in the current embodiment, legs 180A, 176A, 180B, and 176B are used as structural support in connection with the supporting surface, such as the floor, a person skilled in the art will recognize that the number of legs is not limited, and there may be any number of legs, as long as the structure allows for treadmill belt 136 to be carried above the supporting surface.

Referring to FIG. 7, within each leg, leveling piece may be included. In the current embodiment, leg 180A includes leveling piece 188A, leg 176A includes leveling piece 184A, leg 180B includes leveling piece 188B, and leg 176B includes leveling piece 184B. Leveling pieces 188A, 184A, 188B and 184B include a screw with a circular flat surface on the screw head, where the receptacle for the screw is in legs 180A, 176A, 180B and 176B respectively, and where the circular flat surface is in contact with the support surface or the floor. Leveling pieces 188A, 184A, 188B and 184B are accessible to the user and can be hand tightened. By tightening or loosening the screw in leveling pieces 188A, 184A, 188B and 184B with respect to their respective receptacles in legs 180A, 176A, 180B and 176B, the length of screw exposed will increase or decrease, allowing the height of each leveling piece 188A, 184A, 188B and 184B to be adjusted. As such, by tightening or loosening level pieces 188A, 184A, 188B and 184B, a level surface can be provided for treadmill module 104, and hence a level surface for running for a user on treadmill belt 136. Other leveling pieces may be present, such as leveling piece 192 at the rear of treadmill module 104. Additional leveling pieces allow for additional adjustment and increased accuracy with respect to providing a level surface for treadmill module 104. A person skilled in the art will recognize that should level pieces be included in treadmill module 104, that the number of leveling pieces is not limited to four, five or six, and may include any number of leveling pieces.

Returning to the embodiment depicted in FIGS. 1 and 4, a space 144 is defined between the left and right the enclosures 140A and 140B and below running deck 128. The space 144 is configured to accommodate a treadmill drive assembly 370, a treadmill inclination adjustment assembly 374. As well as additional components for providing resistance to resistance pulley resistance pulleys 168A, 168B, 172A and 172B.

The treadmill drive assembly 370 includes treadmill belt 136, two drums 196 and 200 and a motor not shown. The treadmill belt 136 is supported on top of running deck 128 and is rotationally mounted onto the two drums 196 and 200. Drum 196 is located adjacent to the front of running deck 128, and drum 200 is located adjacent the rear of running deck 128. The motor (not shown) is provided to drive rotation of drums 196 and 200 and urge movement of the tread belt 136. The speed of travel of treadmill belt 136 may be adjusted by the user. In this embodiment, the treadmill belt 136 can reach speeds of up to 25 mph. However, it will occur to a person skilled in the art that a different sized motor may be provided to adjust the speed of treadmill belt 136. For example, a larger motor may be provided to allow treadmill belt 136 to reach in excess of 25 mph. The running deck 128 provides a hard surface below the upper portion of tread belt 136 to support a user while running along tread belt 136. The space 144 provides clearance for the lower portion of tread belt 136 as it moves.

The treadmill inclination adjustment assembly 374 is operable to incline or decline/raise or lower the rear end of the running deck 128, thereby changing the angle of inclination of the running deck. In the current embodiment, treadmill inclination adjustment assembly 374 includes a pneumatic cylinder 204 that has a cylinder housing 202 and a piston rod 208 operatively mounted therein. One end of the piston rod 208 is pivotally connected to a pivot attachment 210 in proximity to the rear end of running deck 128. In operation, the pneumatic cylinder 204 may be actuated to urge the piston rod to extend further out of the piston cylinder thereby pushing the rear end of running deck 128 upwards against pivot attachment 210 at a desired angle of inclination. Referring to FIG. 9, while only a single pneumatic cylinder 204 is depicted, it will occur to a person skilled in the art that multiple pneumatic cylinders 204 may be used to adjust the angle of inclination of running deck 128 and to enhance stability of running deck 128 when in a raised position. In alternative embodiments, pneumatic cylinder 204 may be a hydraulic cylinder. In yet another alternative embodiment, inclination assembly may be a piston housed in a piston cylinder or a piston housing connected to extendable rod 208. Furthermore, in the current embodiment, pivot attachment 210 is attached to the bottom of running deck 128, in proximity to the rear of running deck 128. In alternative embodiments, there may be more than one pivot attachment 210, such as one located on either side of running deck 128 in proximity to the rear of running deck 128. A person skilled in the art will recognize that pivot attachment 210 may be attached to running deck 128 in any location in proximity to the rear of running deck 128. A person skilled in the art will recognize the different configurations possible for an inclination assembly.

As such, the rear of running deck 128 may be elevated to be higher than that of the front end of running deck 128, providing an inclined running deck 128. In the current embodiment, running deck 128 may be movable between a fully lowered position 130-1 (as depicted in FIG. 7), where the angle of elevation for running deck 128 is zero 0° degrees, and a fully raised position 130-2 (as depicted in FIGS. 8 and 9), where the angle of elevation for running deck 128 is at twenty 20° degrees. While only two positions are depicted, a fully lowered position 130-1 (as depicted in FIG. 7), and a fully raised position 130-2 (as depicted in FIGS. 8 and 9), it will occur to a person skilled in the art that a range of angles of inclination between zero (0) degrees and twenty (20) degrees may be provided. In alternate embodiments (not shown), the running deck 128 may further be declined below zero (0) degrees. For example, running deck 128 may be declined by negative two (−2) degrees. A person skilled in the art will recognize the different configurations and ranges of angles of inclination for running deck 128.

Figure 24:
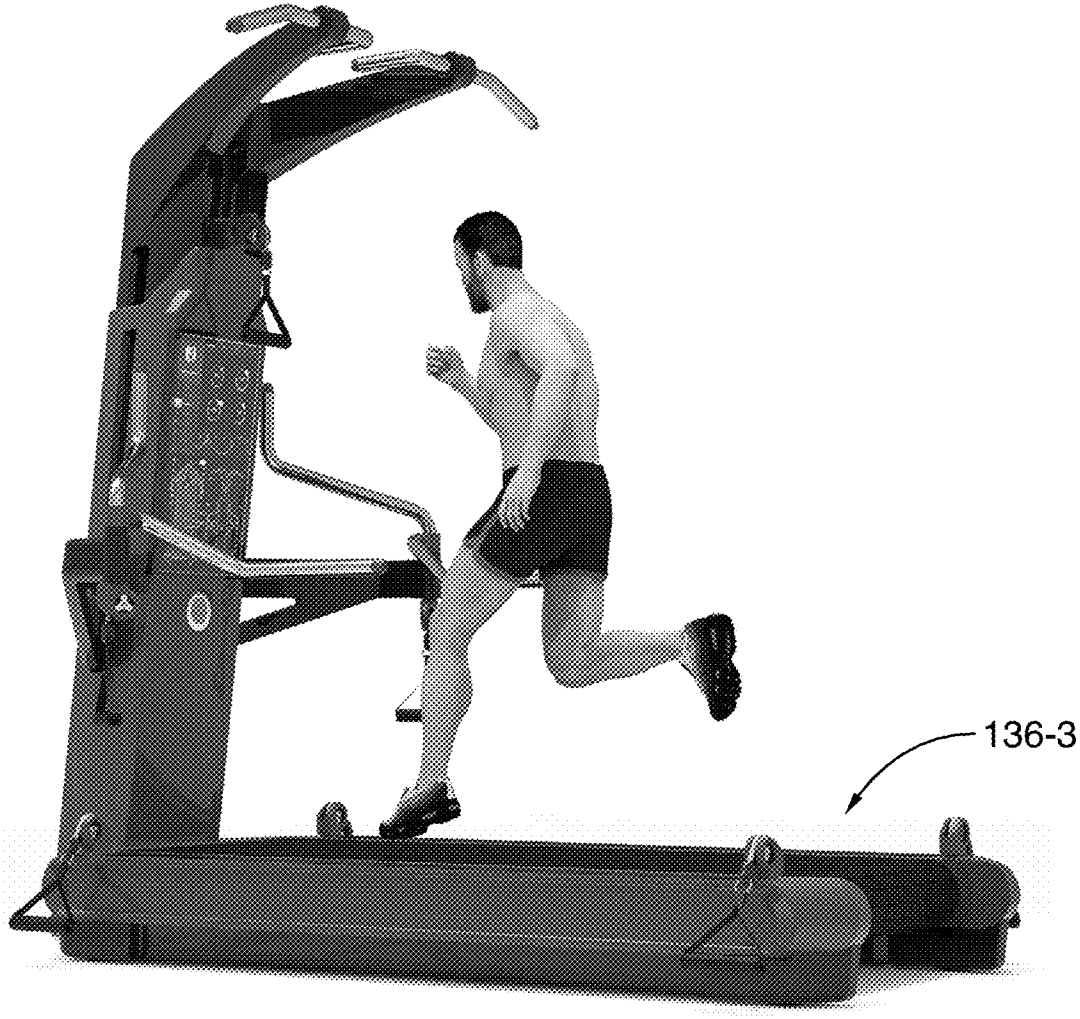
FIG. 24 is a front right perspective view of the exercise apparatus of FIG. 1, showing a user running on the treadmill platform while it is in its lowered position.
Figure 25:
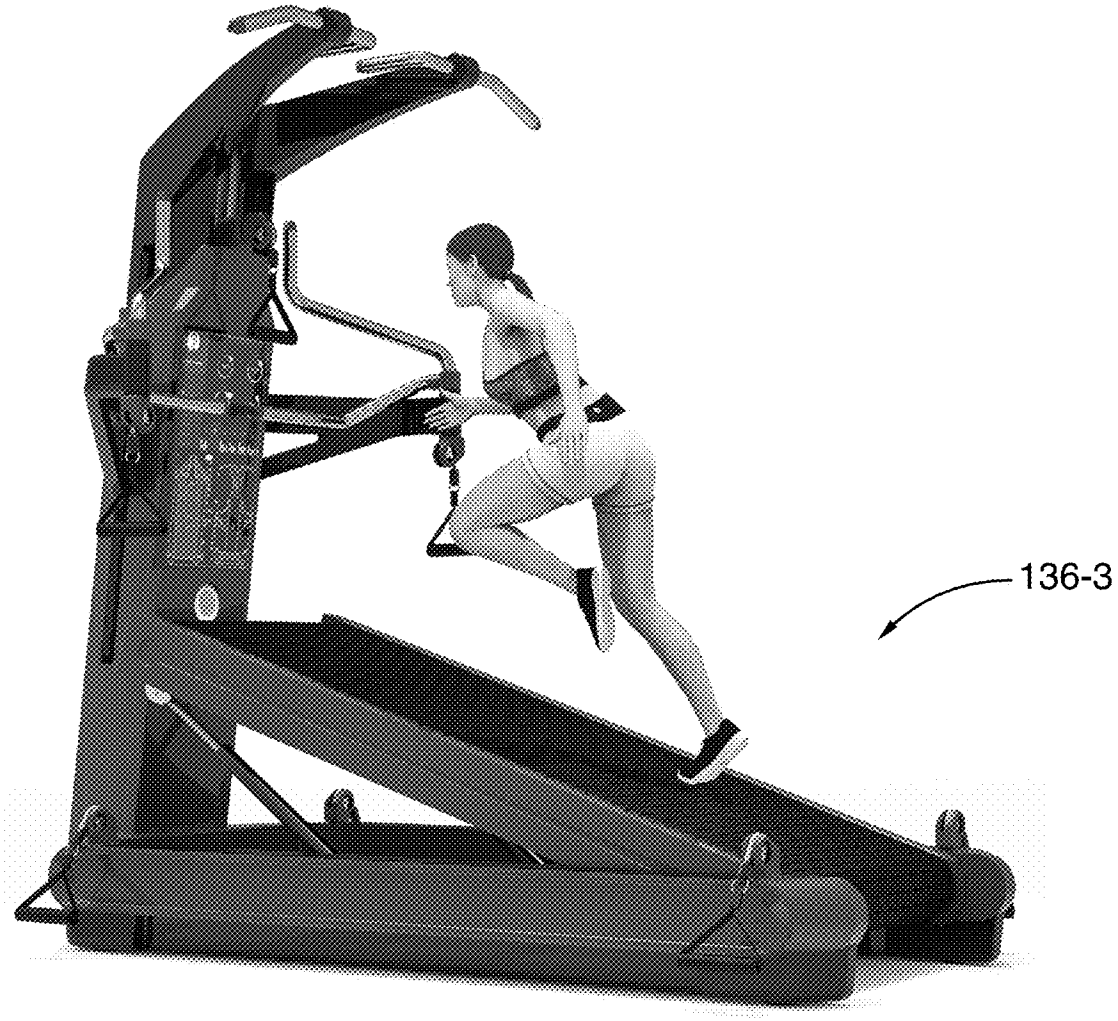
FIG. 25 is a front right perspective view of the exercise apparatus of FIG. 1, showing a user running on the treadmill platform while it is in its raised position.

Treadmill belt 136 may either placed in a locked configuration 136-1 (shown in FIGS. 26 and 27), a freely movable configuration 136-2 (shown in FIG. 28), or a powered configuration 136-3 (shown in FIGS. 24 and 25). When treadmill belt 136 is in a locked configuration, drums 196 and 200 are prevented from rotating, effectively preventing treadmill belt 136 from moving. Drums 196 and 200 may be locked in place through mechanisms in either right enclosure 140A or left enclosure 140B. In other embodiments, treadmill belt 136 may be locked in place through mechanisms below running deck 128 extending and preventing drums 196 and 200 from rotating. A person skilled in the art will recognize that different methods may be possible to lock treadmill belt 136 from rotating.

When treadmill belt 136 is in a freely movable configuration, drums 196 and 200 are free to rotate. The motor may either be turned off, or drums 196 and 200 may be disengaged from the motor, ensuring that drums 196 and 200 are not driven. Rather treadmill belt 136 moves in response to the user's steps and movement on the treadmill belt 136. When treadmill belt 136 is in a powered configuration, drums 196 and 200 are powered using the motor, as previously described.

Adjustments between the different configurations of treadmill belt 136 and the adjustments of the speed and inclination of treadmill belt 136 may all be changed through a controller 366 that may be configured and controlled through touch screen 112.

Figure 28:
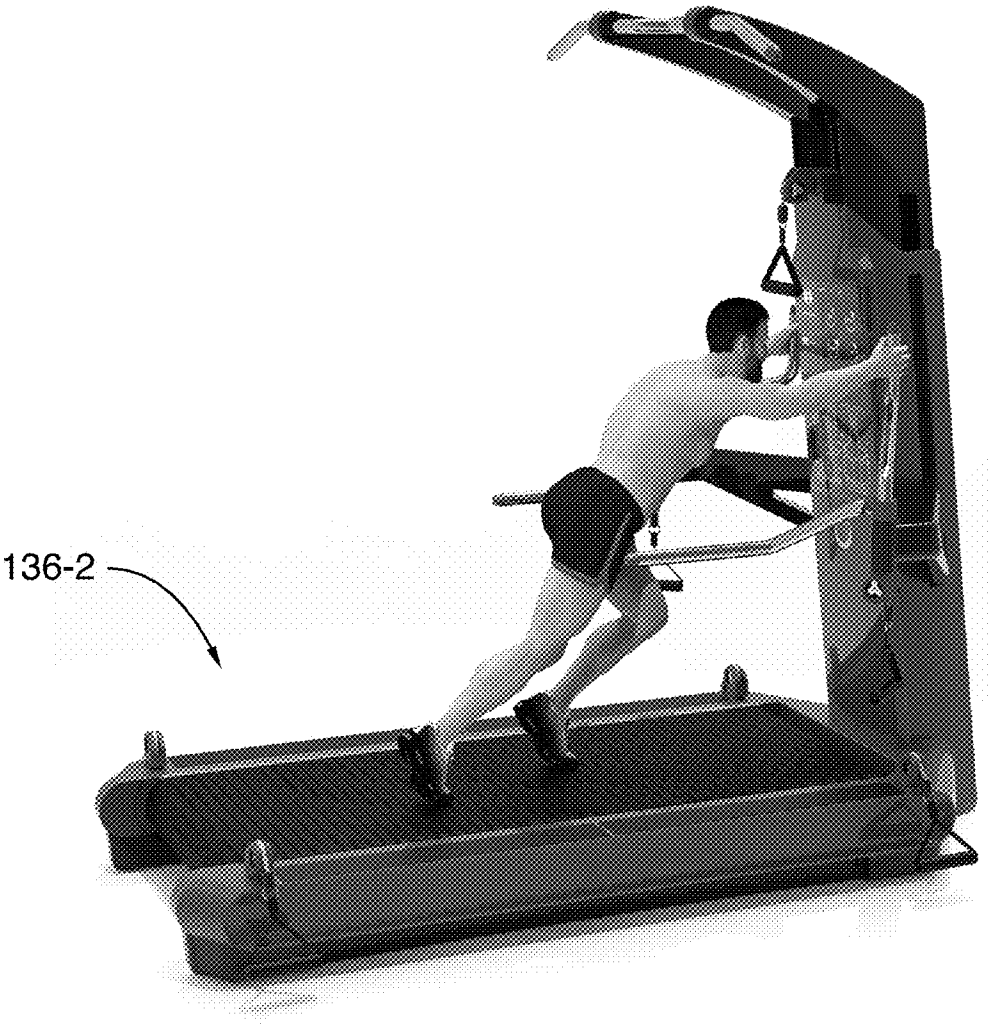
FIG. 28 is yet another front left perspective view of the exercise apparatus of FIG. 1, showing the crossarm module in a lowered position, the upper right and left arms of the crossarm module rotated to provide a vertical section on each of the upper right and left arms, the vertical sections of the upper right and left arms with a distance of a user's shoulder length between each other, and the lower right and left arms of the crossarm module rotated to act as safety bars on either side of the treadmill module with a user performing a sled push exercise.

The different configurations of treadmill belt 136 allow for a user to perform different exercises. When the treadmill belt 136 is powered, a user may perform cardio based exercises with the running deck 128 either a fully lowered position 130-1, a fully raised position 130-2, or any elevation in between. For example, FIG. 24 depicts a user running on the treadmill belt 136 in a fully lowered position 130-1. In another example, FIG. 25 depicts a user running on the treadmill belt 136 in a fully raised position 130-2. In addition to cardio based exercises, a user standing on the treadmill platform may perform both cardio and resistance training at the same time by powering the treadmill and using components on center stack 108. Alternatively, the user may leave the treadmill unpowered, but keep the treadmill movable while using components on center stack 108. This will allow for exercises where the simulation of a user's movement along the ground may be useful. An example of this would be to perform a sled push exercise as depicted in FIG. 28, where a user may push against crossarm module 116 with its rotatable arms in a specific configuration, while simulating the pushing movement by allowing the user's legs to move the treadmill. A person skilled in the art will recognize other exercises where the free movement of treadmill belt 136 may be useful. In addition, a user may lock the treadmill in place, and solely use components on center stack 108 for exercise, preventing any slipping, and focusing solely on resistance training. Examples of these exercises will be further discussed below.

Returning to FIGS. 1, 2 4 and 5, treadmill module 104 further includes a plurality of resistance pulleys where each of the plurality of resistance pulleys may be located along the margin of the rectangular footprint of the treadmill module. The plurality of resistance pulleys may also be on the top surface of treadmill module 104. Furthermore, the plurality of resistance pulleys may be located in proximity to each corner of treadmill module 104. In the current embodiment, the plurality of resistance pulleys includes a first resistance pulley 168A, a second resistance pulley 168B, a third resistance pulley 172A and a fourth resistance pulley 172B, where resistance pulley 168A is located on top face 148A at position 170A at the front right corner of treadmill module 104, resistance pulley 168B is located on top face 148B at position 170B at the front left corner of treadmill module 104, resistance pulley 172A is located on top face 148A at position 174A at the rear right corner of treadmill module 104, and resistance pulley 172B is located on top face 148B at position 174B at the rear left corner of treadmill module 104. In alternative embodiments, resistance pulleys 168A and 172A may not be located at the corners of treadmill module 104, but may be located anywhere along top surface 148A on right side 142A. Similarly, resistance pulleys 168B and 172B may be located anywhere along top surface 148B on left side 142B. In another alternative embodiment, resistance pulleys 168A and 172A may be located along side panel 156A of right enclosure 140A on right side 142A, and resistance pulleys 168B and 172B may be located along side panel 156B of left enclosure 140B on left side 142B. A person skilled in the art will recognize the different positions that resistance pulleys 168A, 168B, 172A and 172B may be located at on treadmill module 104.

Figure 10:
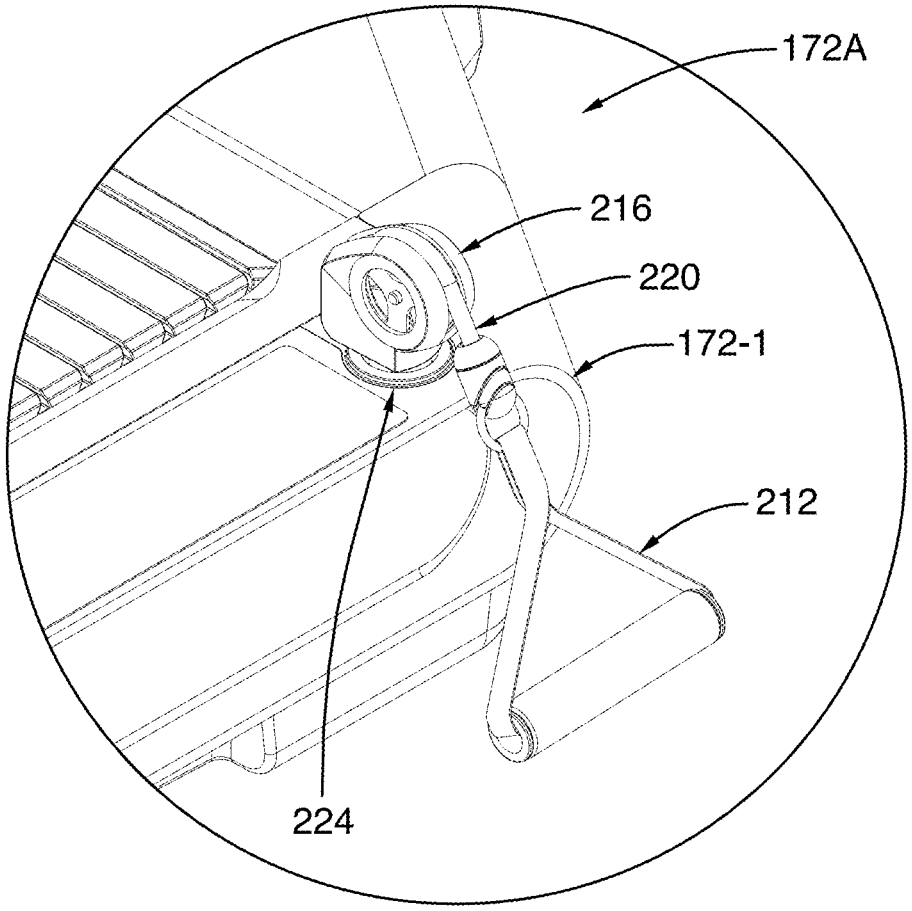
FIG. 10 is an elongated, partial front left perspective view of the rear right corner of the treadmill module of exercise apparatus of FIG. 1, showing a pulley in a retracted position.

Referring to FIG. 10, resistance pulley 172A is depicted. Resistance pulley 172A includes handle 212, pulley 216, cable 220 and bearing 224, where handle 212 is attached to cable 220, and cable 220 is guided by pulley 216, where resistance is provided against cable 220 to simulate weights. Bearing 226 interconnects pulley 216 and top surface 148A and allows the rotation of resistance pulley 172A. Resistance pulleys 168A, 168B, and 172B (as depicted in FIG. 1) include similar components arranged in a similar manner.

In the current embodiment, handle 212 is triangular in shape, where one edge/side of the triangle acts as the handle grip for a user to hold. A person skilled in the art will recognize that handle 212 may be sized or shaped differently to accommodate a user's hand and grip. A person skilled in the art will also recognize that handle 212 may be sized to accommodate both of the user's hands. The handle grip may further include sensors, such as a heart rate sensor to detect heart rate to be displayed or as data to be recorded, or a gyroscope to record the repetitions (or reps) of an exercise performed by a user and/or the positioning of the handle while a user is exercising. Preferably, handle 212 is detachable from cable 220, allowing the replacement of handle 212 with another accessory to be connected to cable 220 for other uses. For example, an attachment mechanism to hook cable 220 to part of a bicycle or a wheelchair may be used. In other embodiments, a crossbar may be attached between two cables of resistance pulleys. Additional accessories and their uses will be further discussed below.

Figure 26:
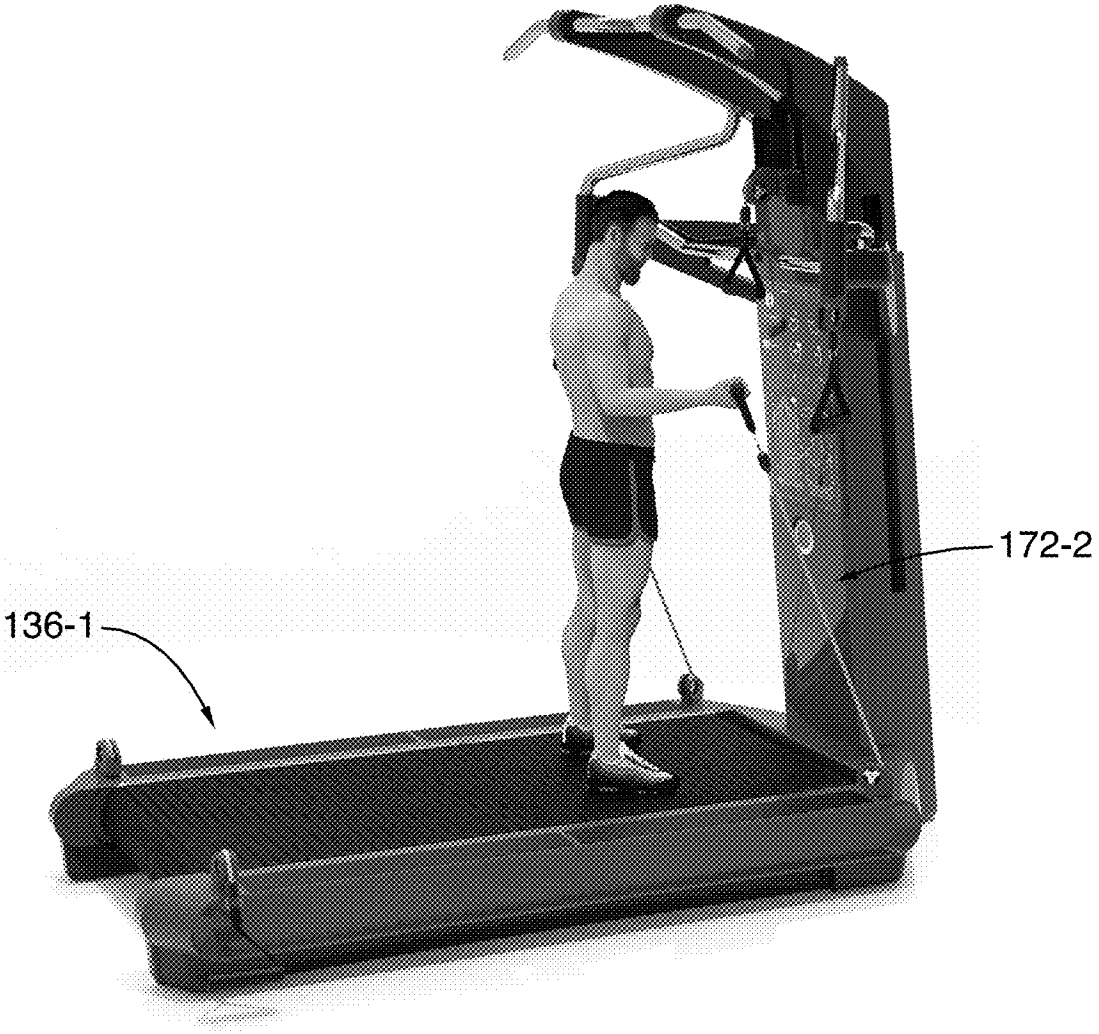
FIG. 26 is another front left perspective view of the exercise apparatus of FIG. 1, showing a user using the two pulleys located at the rear corners of the treadmill module.

Pulley 216 guides cable 220 of resistance pulley 172A as it moves from a retracted position 172-1 (as depicted in FIG. 10) to an extended position 172-2 (as can be seen in the bicep curl exercise depicted in FIG. 26). While in the current embodiment, pulley 216 is used to guide cable 220, in other embodiments, pulley 216 may be replaced with other guiding mechanisms, such as a cable ring.

Resistance pulley 172A further includes bearing 224 which allows for the rotation of pulley 216, allowing for enhanced degrees of motion along the same plane as top face 148A. In combination, bearing 224, pulley 216 and cable 220 allow a user to pull handle 212 in any direction and angle above the plane of top face 148A.

Resistance pulley 172A further provides resistance through components located within right enclosure 140A to simulate weights as resistance pulley 172A is moved from a retracted position 172-1 to an extended position 172-2, and back to a retracted position 172-1. Components to provide resistance may include mechanical means of providing resistance, such as a brushless DC motor, or in a preferred embodiment through a magnetic means of providing resistance, such as using a caliper with magnets to move the calipers closer together towards a flywheel to produce high strength opposite-polarity eddy currents around a metal flywheel (not shown), or by varying the strength of a magnetic field around a flywheel, adjusting the resistance based on the strength of the magnetic field. Resistance provided against cable 220 may emulate a weight range of 1 lbs to 200 lbs, with increments of 0.5 lbs. Resistance may be adjusted using a controller 366 that is controlled via touch screen 112. A person skilled in the art will recognize the different forms of controlling resistance for resistance pulley 172A. A person skilled in the art will also recognize that resistance provided against 220 may emulate any weight range at any increment. Spools configured to hold excess cable 220 may also reside within right enclosure 140A as part of resistance pulley 172A.

The components and arrangement of components of resistance pulley 172A are similar to the components and arrangement of components for resistance pulleys 168A, 168B, and 172B, however the components may be placed within proximity to their respective resistance pulley, and in the respective enclosure.

Figure 31:
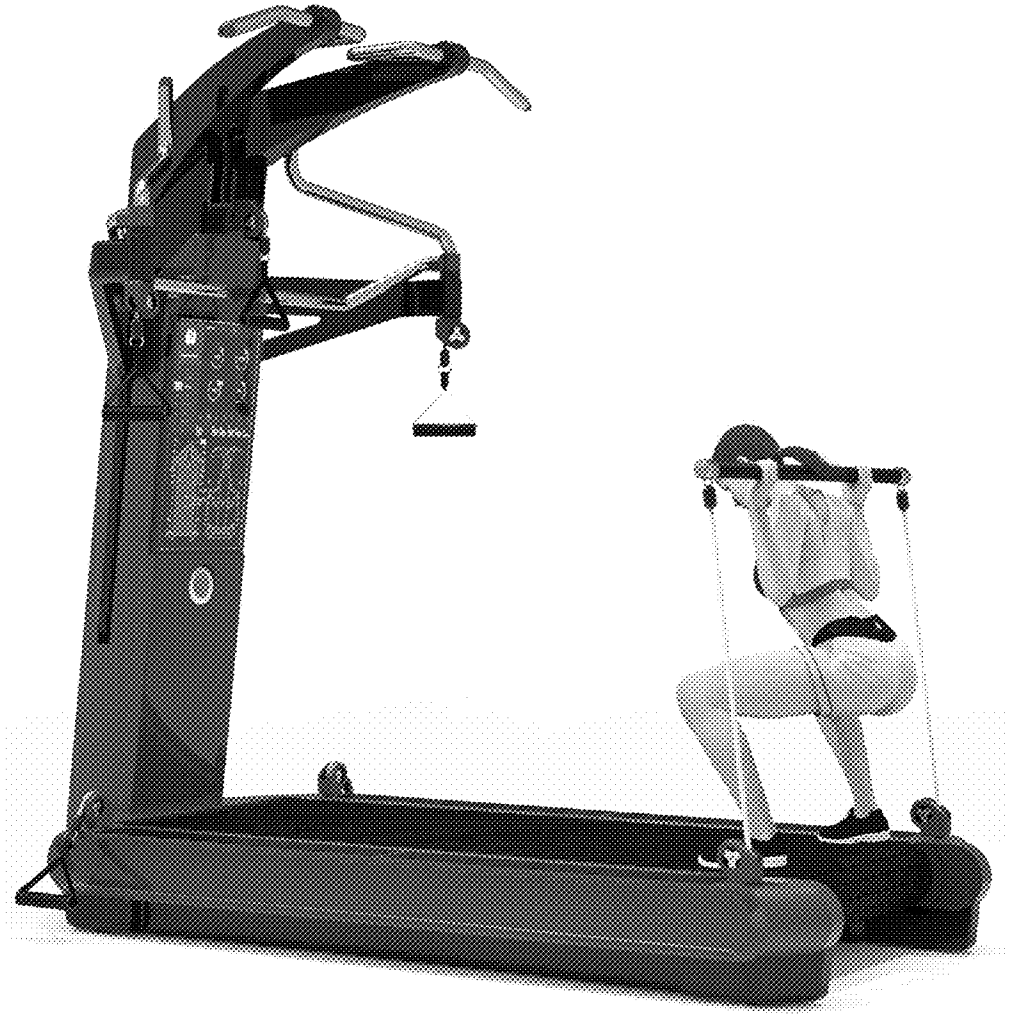
FIG. 31 is a front right perspective view of the exercise apparatus of FIG. 1, showing a user performing squats using a crossbar connected between the two pulleys located at the front corners of the treadmill module.

With resistance pulleys 168A, 168B, 172A and 172B located on the four corners of treadmill module 104, resistance pulleys 168A, 168B, 172A, and 172B may be used to perform a variety of exercises. For example, resistance pulleys 172A and 172B allow for a user to perform a bicep curl, while interacting with screen 112. This is depicted in FIG. 26. In another example, resistance pulleys 168A and 168B allow for a user to perform exercises that require additional space to allow for additional movement without a user being constrained by the placement center stack 108. This is depicted in FIG. 31 where the crossbar attachment is used between resistance pulleys 168A and 168B, and the total resistance provided may emulate a weight range of 2 lbs to 400 lbs total, with increments of 1 lbs. A person skilled in the art will recognize the different exercises that may be performed with resistance pulleys 168A, 168B, 172A and 172B.

As previously indicated, treadmill belt 136 of treadmill module 104 may be placed in different configurations: locked, freely movable or powered. A user may use any one of the resistance pulleys 168A, 168B, 172A and 172B, either alone or in conjunction with one another may do so with the treadmill being powered, the treadmill being unpowered but free to move, or the treadmill being locked in place. A person skilled in the art will also recognize the different exercises that may be performed with resistance pulleys 168A, 168B, 172A and 172B with treadmill belt 136 either locked, freely movable, or powered by a motor and drums 196 and 200.

Referring to FIGS. 2, 4, 5 and 6, as can be seen, center stack 108 includes an inner mast 304, and an outer mast 230 defined by front panel 232, right side panel 236, left side panel 240 and rear panel 244. Inner mast 304 may extend from the treadmill module 104 upwardly, where outer mast 230 surrounds inner mast 304, and extends partly up the way to reveal the protruding upper end of inner mast 304. The protruding end of inner mast 304 beyond the top of outer mast 230 carries the pull up arm module, and provides a means for pull up arm module 124 to move between a fully lowered position 124-1 and a fully raised position 124-2. Pull up arm module will be further discussed below. Front panel 232 includes embedded touch screen 112. Front panel 232 may also include fan 546. Right side panel 236 and left side pane 240 of outer mast 230 further includes slots 248A and 248B respectively to allow crossarm module 116 to move between a raised position 116-1 and a lowered position 116-2. Crossarm module will be further discussed below.

Figure 4:
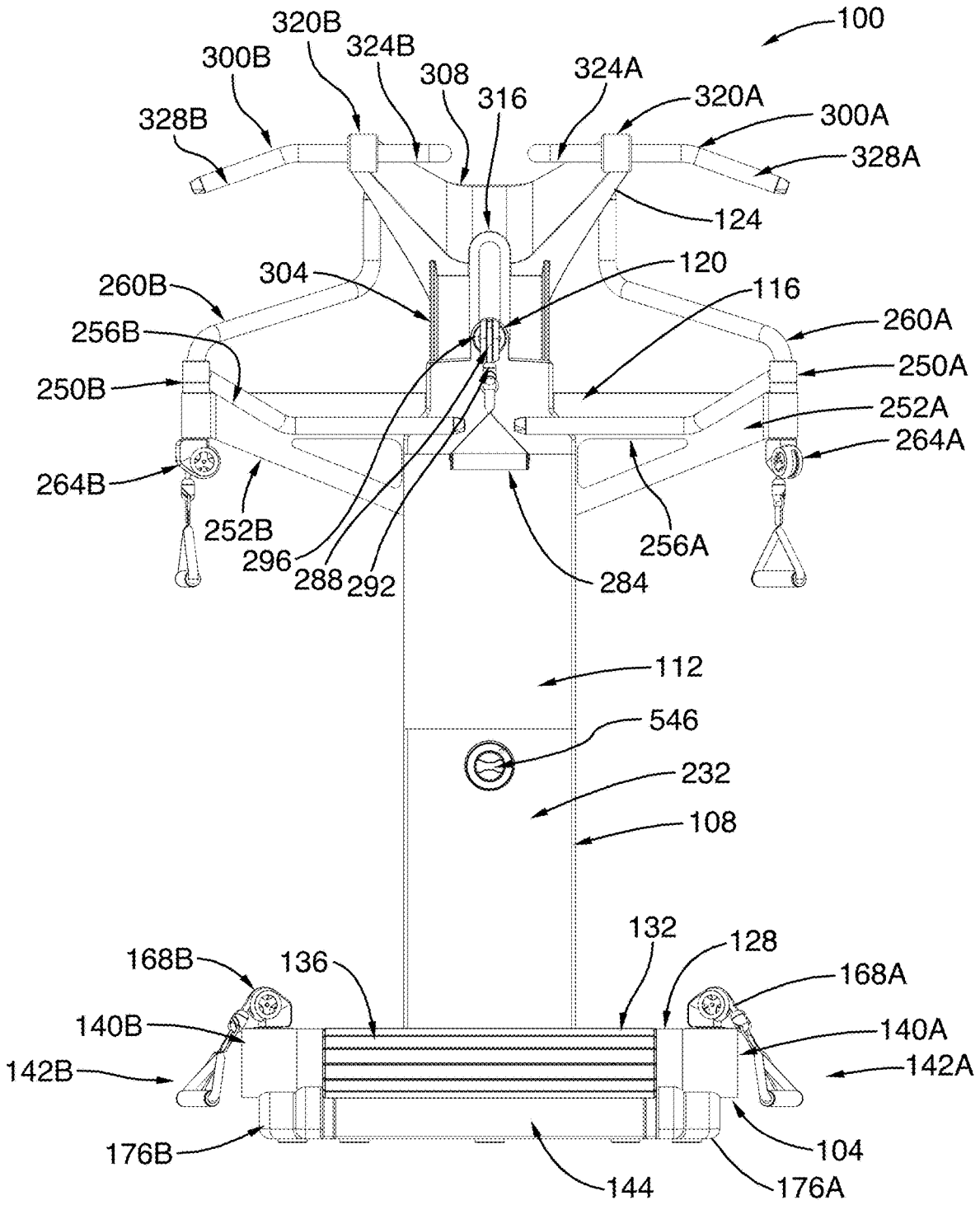
FIG. 4 is a front end view of the exercise apparatus shown in FIG. 1.
Figure 5:
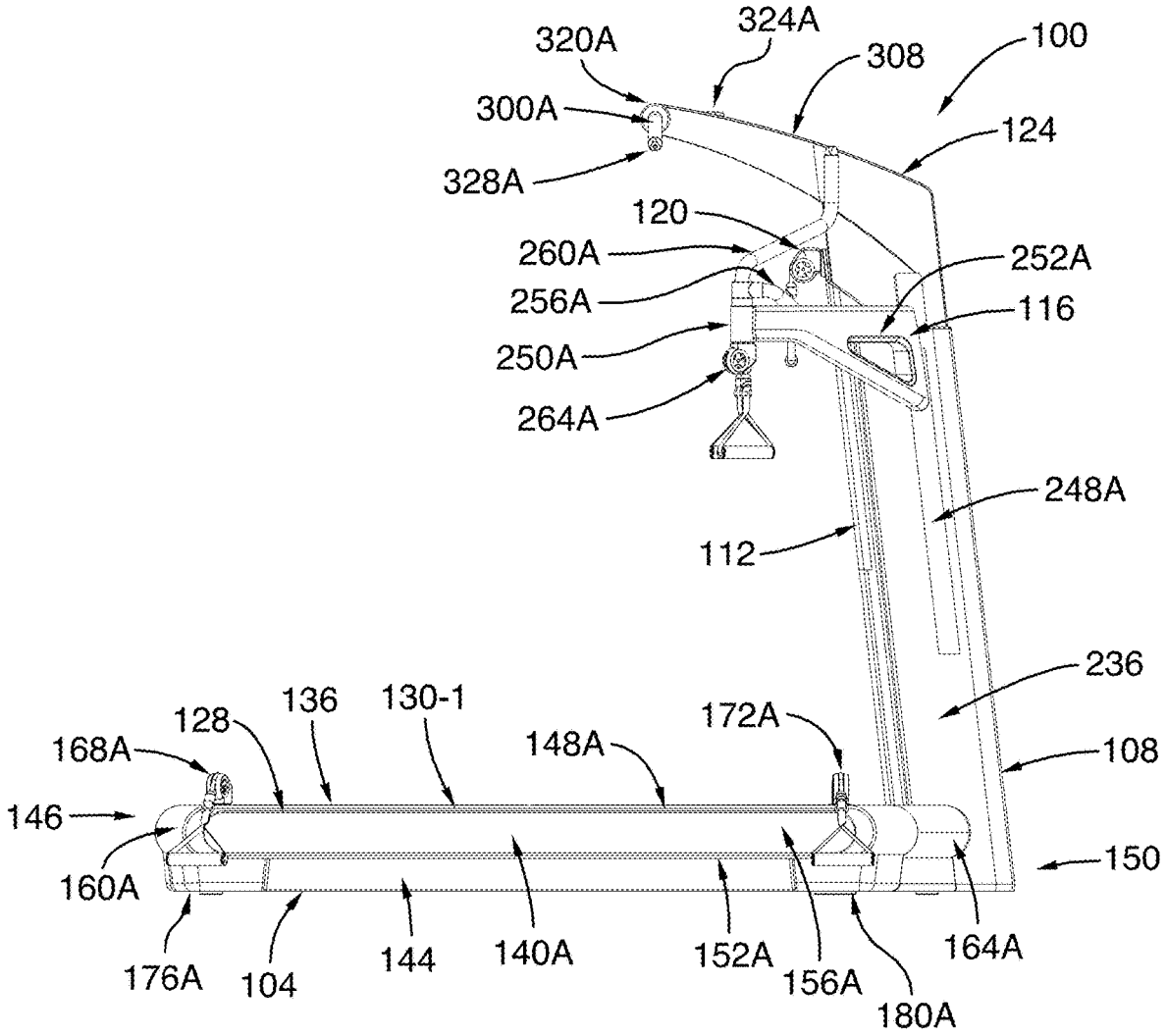
FIG. 5 is a right side view of the exercise apparatus shown in FIG. 1.
Figure 6:
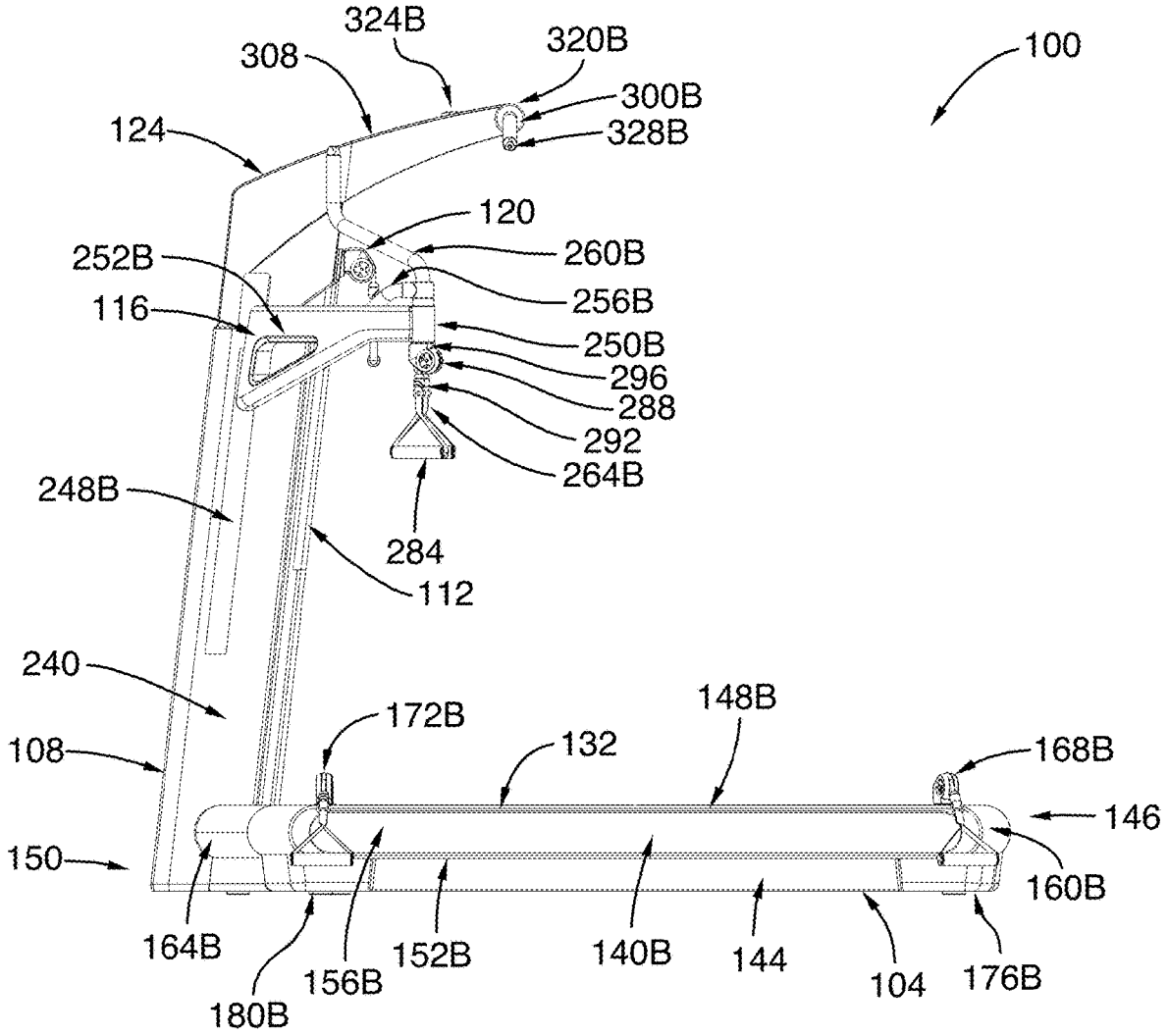
FIG. 6 is a left side view of the exercise apparatus shown in FIG. 1.
Figure 11:
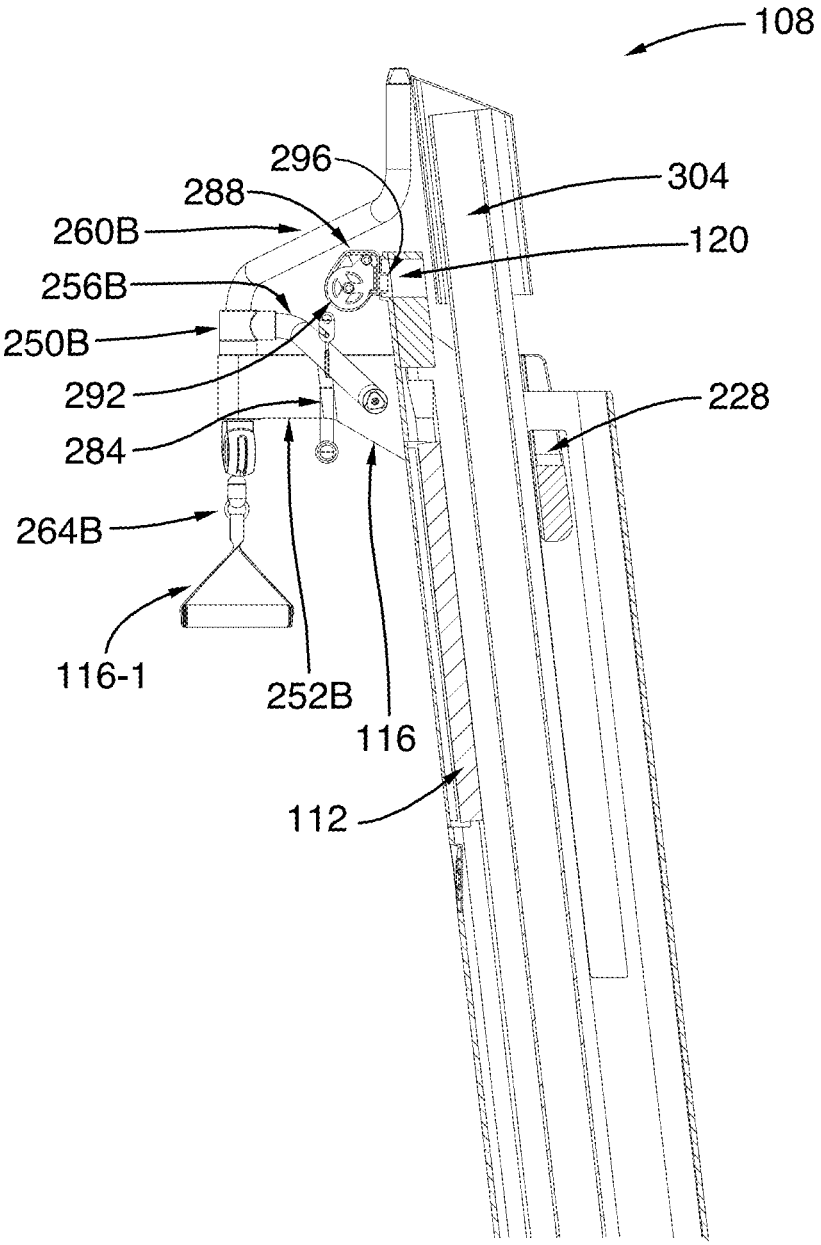
FIG. 11 is a cross-sectional view of the center stack of the exercise apparatus illustrated in FIG. 3 taken along line '7-7', showing the crossarm module in a raised position, and the pull up arm module in a raised position.

Referring to FIGS. 1, 4 and 11, crossarm module 116 includes right arm 252A (also referred to herein as right wing 252A), lower right armbar 256A, upper right armbar 260A, and resistance pulley 264A on the right side of center stack 108 and left arm 252B (also referred to herein as left wing 252B), lower left armbar 256B, upper left armbar 260B, and resistance pulley 264B on the left side of center stack 108, where the right side and left side of crossarm module 116 are mirrored along the center length of exercise apparatus 100. Crossarm module 116 is mounted on a rail 228, which is within outer mast 230 of center stack 108. Slot 248A along right side panel 236 of center stack 108 allows for crossarm module 116 to be connected to rail 228. Cross arm module 116 may slide upon rail 228, and will be further discussed below.

Figure 13:
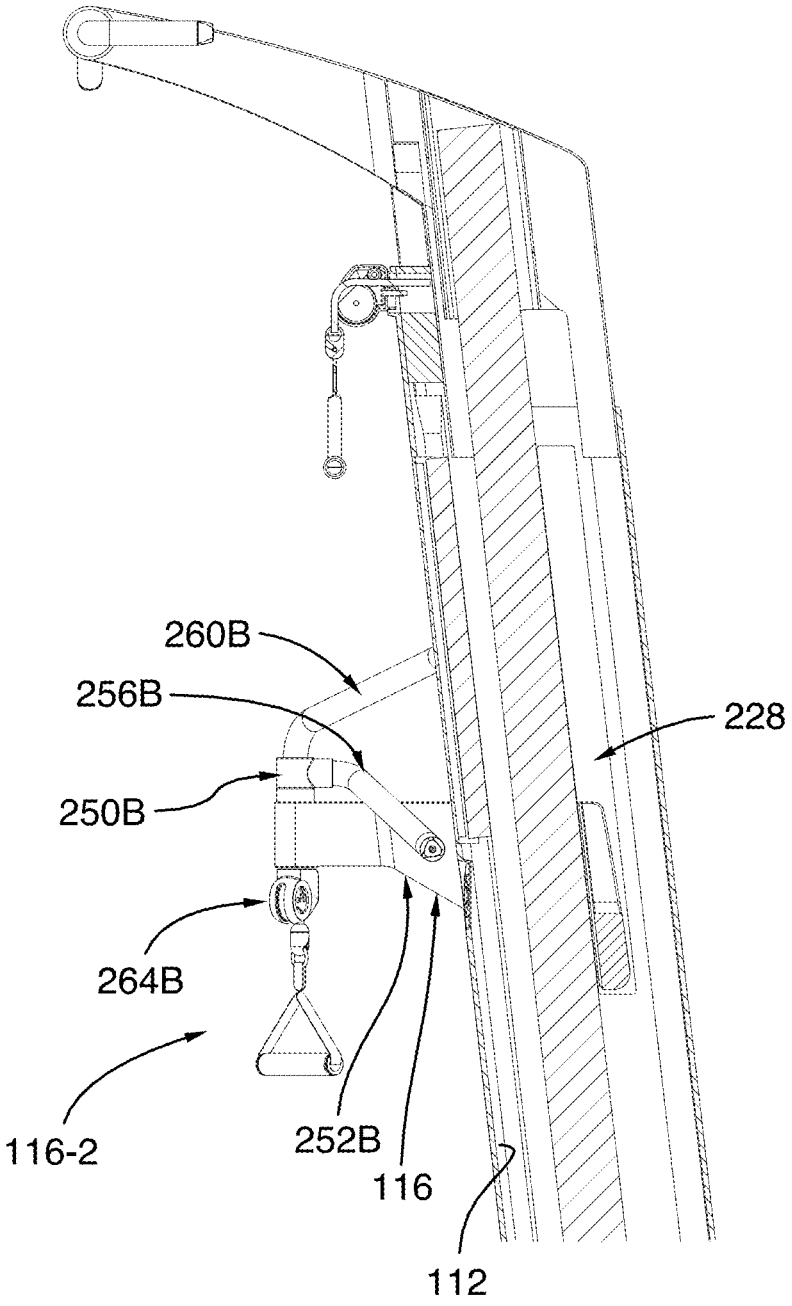
FIG. 13 is a cross sectional view of the center stack similar to that shown in FIG. 11, except that the crossarm module is shown in the lowered position.

On the right side of rail 228 and center stack 108, right arm 252A acts as the mounting point to rail 228 and extends away from center stack 108 at an angle away from center stack 108 towards the right of center stack 108 and towards the user using exercise apparatus 100 while standing on treadmill belt 136. At the furthest end away from center stack 108 on right arm 252A, there is a connecting point to lower right armbar 256A, upper right armbar 260A and resistance pulley 264A, where lower right armbar 256A, upper right armbar 260A and resistance pulley 264A may all rotate about a vertical axis to provide different configurations for different exercises. A similar configuration is mirrored across center stack 108 for left arm 252B, lower left armbar 256B, upper left armbar 260B and resistance pulley 264B, where left arm 252B is also mounted on rail 228, with slot 248B on left side panel 240 providing left arm 252B access to rail 228. In alternative embodiments, crossarm module 116 may straddle rail 228 either in front of rail 228, or behind rail 228. In the current embodiment, right arm 252A and left arm 252B may connected in front of rail 228 or behind rail 228 to be a singular body. FIGS. 11 and 13 provide a view crossarm module 116 mounted on rail 228 within center stack 108.

Right arm 252A extends from the center stack 108 and the connection between crossarm module 116 and rail 228 outwards away from center stack 108, to the connection point 250A for lower right armbar 256A, upper right armbar 260A and resistance pulley 264A. Right arm 252A is also angled away from center stack 108 towards a user standing on the treadmill. Both the angle and the distance right arm 252A extends away from center stack 108 allows for the positioning of lower right armbar 256A, upper right armbar 260A and resistance pulley 264A in optimum placement for additional exercises. In the current embodiment, right arm 252A is shaped in a triangular truss, or shaped as a wing having a triangular flange portion. However, right arm 252A may be any shape, as long as it provides optimum placement of the components connected to the end of right arm 252A, specifically, lower right armbar 256A, upper right armbar 260A and resistance pulley 264A for various exercises.

Left arm 252B, lower left armbar 256B, upper left armbar 260B and resistance pulley 264B are mirrored across center stack 108 with right arm 252A, lower right armbar 256A, upper right armbar 260A and resistance pulley 264A. As such, similar to right arm 252A, left arm 252B extends from the center stack 108 and the connection between crossarm module 116 and rail 228 outwards away from center stack 108, to the connection point 250B for lower left armbar 256B, upper left armbar 260B, and resistance pulley 264B. Left arm 252B is also angled away from center stack 108 towards a user standing on the treadmill. Both the angle and the distance left arm 252B extends away from center stack 108 allows for the positioning of lower left armbar 256B, upper left armbar 260B and resistance pulley 264B in optimum placement for additional exercises. Similar to right arm 252A, in the current embodiment, left arm 252B is shaped in a triangular truss, but may be any shape, as long as it provides optimum placement of the components connected to the end of left arm 252B, specifically lower left armbar 256B, upper left armbar 260B and resistance pulley 264B for various exercises.

Upper right armbar 260A is connected to the end of right arm 252A, and is directed upwards in a "S" shape configuration. Similarly, upper left armbar 260B is connected to the end of left arm 252B, and is also directed upwards in a "S" shape configuration. Both upper right armbar 260A and upper left armbar 260B may be rotated about a vertical axis at respective connection points 250A and 250B at the end of right arm 252A and left arm 252B respectively. Upper right armbar 260A and upper left armbar 260B may be rotated into a position that allows for different exercises. The upper portion of the "S" shape of upper right armbar 260A and upper left armbar 260B may include conductive surfaces and heart rate sensors, so as to detect and measure the heart rate of a user while the user exercises and is in contact with said conductive surfaces, such as while performing a sled push exercise. A person skilled in the art will recognize the different uses of upper right armbar 260A and upper left armbar 260B, and the different exercises that can be performed using upper right armbar 260A and upper left armbar 260B. A person skilled in the art will also recognize that upper right armbar 260A and upper left armbar 260B may be of any shape that may allow users to perform a variety of exercises.

Lower right armbar 256A is connected to the connection point 250A at the end of right arm 252A. More specifically, the connection point 250A of lower right armbar 256A to right arm 252A is shaped as a hollow cylinder with the through hole of the hollow cylinder along a vertical axis, surrounding the bottom of upper right armbar 260A, and connects to right arm 252A. This is more clearly depicted in FIG. 14 with the mirrored left side of crossarm module 116, where lower left armbar 256B is connected to the end of left arm 252B, where the connection point 250B of lower left armbar 256B to left arm 252B is shaped as a hollow cylinder with the through hole of the hollow cylinder along the vertical axis, surrounding the bottom of upper left armbar 260B, and connects to left arm 252B. This form of connection with hollow cylinder at connection point 250B allows lower left armbar 256B to rotate along the vertical axis around the center of hollow cylinder, allowing for the different positioning of lower left armbar 256B. This rotation is similar for lower right armbar 256A. In the current embodiment, hollow cylinder at connection point 250B surrounding the bottom of upper left armbar 260B may be considered a clearance fit, allowing for the free rotation of lower left armbar 256B, however, other forms of connection allowing for the same rotation may be contemplated, such as the use of a bearing within the hollow cylinder at connection point 250B. A person skilled in the art will recognize different forms of connection between lower left armbar 256B and left arm 252B at connection point 250B that also allow for rotation about a vertical axis, and will similarly recognize the same different forms of connection between lower right armbar 256A and right arm 252A at connection point 250A.

In the current embodiment, lower right armbar 256A is shaped with a first straight section and a second straight section, where the first straight section is adjacent to the connection point 250A between lower right armbar 256A and right arm 252A and the second section is connected to the first section, and where the first section is slightly angled in comparison with the second straight section. Lower left armbar 256B is also similarly shaped. In alternative embodiments, lower right armbar 256A and lower left armbar 256B may be straight bars. Both lower right armbar 256A and lower left armbar 256B are shaped to ensure that when rotated outwards with the ends of lower right armbar 256A and lower left armbar 256B pointing towards the front of exercise apparatus 100, lower right armbar 256A and lower left armbar 256B may act as safety bars for a user using treadmill module 104 (also known as a treadmill exercise position/configuration). More specifically, lower right armbar 256A and lower left armbar 256B allow a user to easily step off the treadmill belt 136 while it is still in motion by grabbing lower right armbar 256A and/or lower left armbar 256B, or if a user stumbles, to prevent them from falling onto treadmill belt 136 by grabbing lower right armbar 256A and/or lower left armbar 256B. This configuration may be seen in FIG. 24. A person skilled in the art will recognize the different shapes that lower right armbar 256A and lower left armbar 256B may be.

Figure 14:
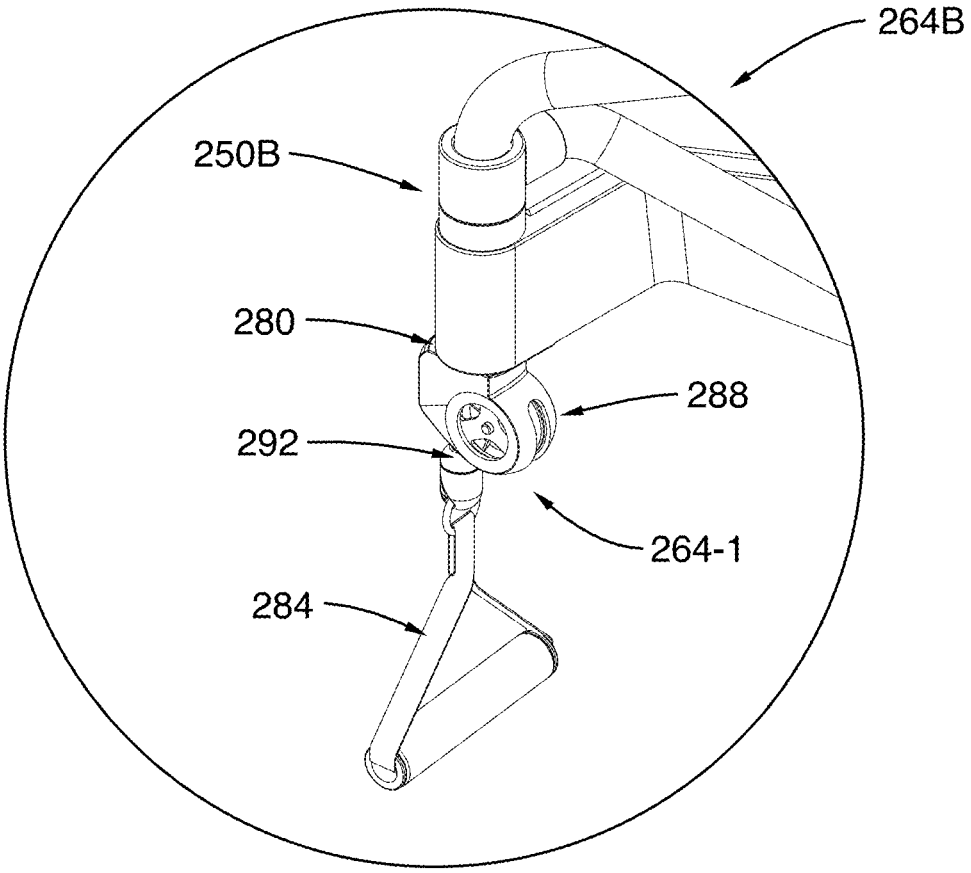
FIG. 14 is an enlarged, partial front left perspective view of the left pulley of the crossarm module of the exercise apparatus of FIG. 1, with the pulley shown in a retracted position.

Referring to FIG. 14, similar to resistance pulley 172A, resistance pulley 264B includes handle 268, cable 276, pulley 272 and bearing 280. Similar to previously described handle 212, handle 268 may is a triangular shape in the current embodiment, but may be of any shape, and may be of any size, and may even accommodate more than one hand. Handle 268 may also include sensors located in the grip, such as a heart rate sensor to measure the heart rate of the user using resistance pulley 264B and a gyroscope to track the rotation and positioning of handle 268 while a user is exercising. In addition, in the current embodiment, handle 268 is attached to cable 276, however in other embodiments, handle 268, may be detachable from cable 276, and replaced with a different handle or a different accessory. This will be further described below.

Figure 27:
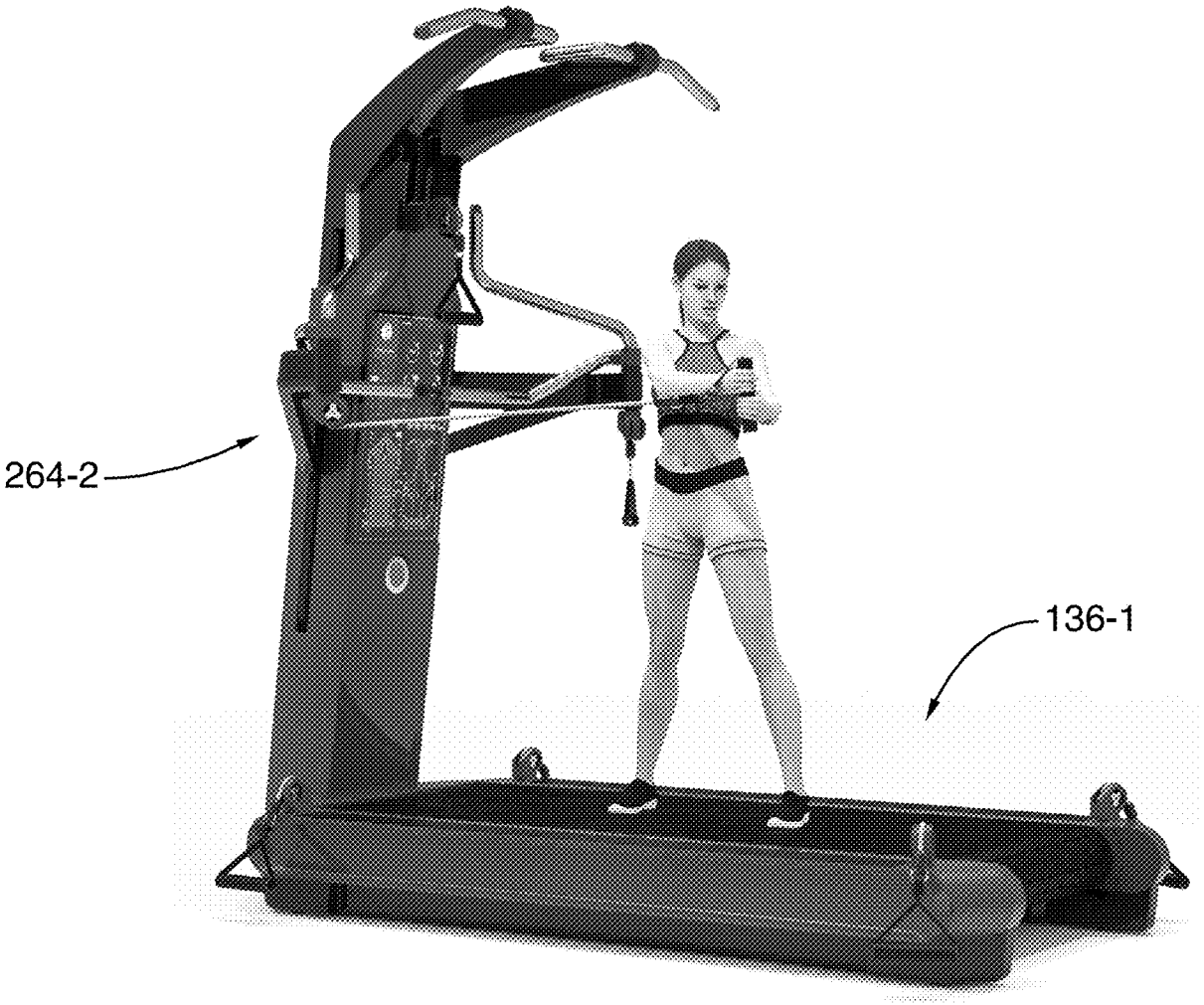
FIG. 27 is a front right perspective view of the exercise apparatus of FIG. 1, showing a user using the left pulley located on the crossarm module when the crossarm module is in a raised position to perform a standing twist exercise.

Pulley 272 provides guidance to cable 276 when resistance pulley 264B is moved from a retracted position as depicted in FIG. 14 to an extended position as depicted in FIG. 27.

Resistance pulley 264B further includes bearing 280 which allows for the rotation of pully 272, and hence allowing an increased range of motion for resistance pulley 264B. More specifically, resistance pulley 264B may be rotated 360 degrees perpendicular to the vertical axis, and hence allowing a user to pull resistance pulley 264B into an extended position in any direction below pulley 272.

Similar to pulley 216, resistance may be provided and adjusted through either mechanical means, or in a preferred embodiment, through magnetic means. Components to provide adjustable resistance may be located within center stack 108 or within right and left arms 252A, and 252B. A person skilled in the art will recognize the different potential methods and apparatus available to provide adjustable resistance against cable 276.

Resistance pulley 264A is attached to connection point 250A, away from center stack 108 of right arm 252A, and is similar to resistance pulley 264B with similar components and a similar range of motion.

Figure 12:
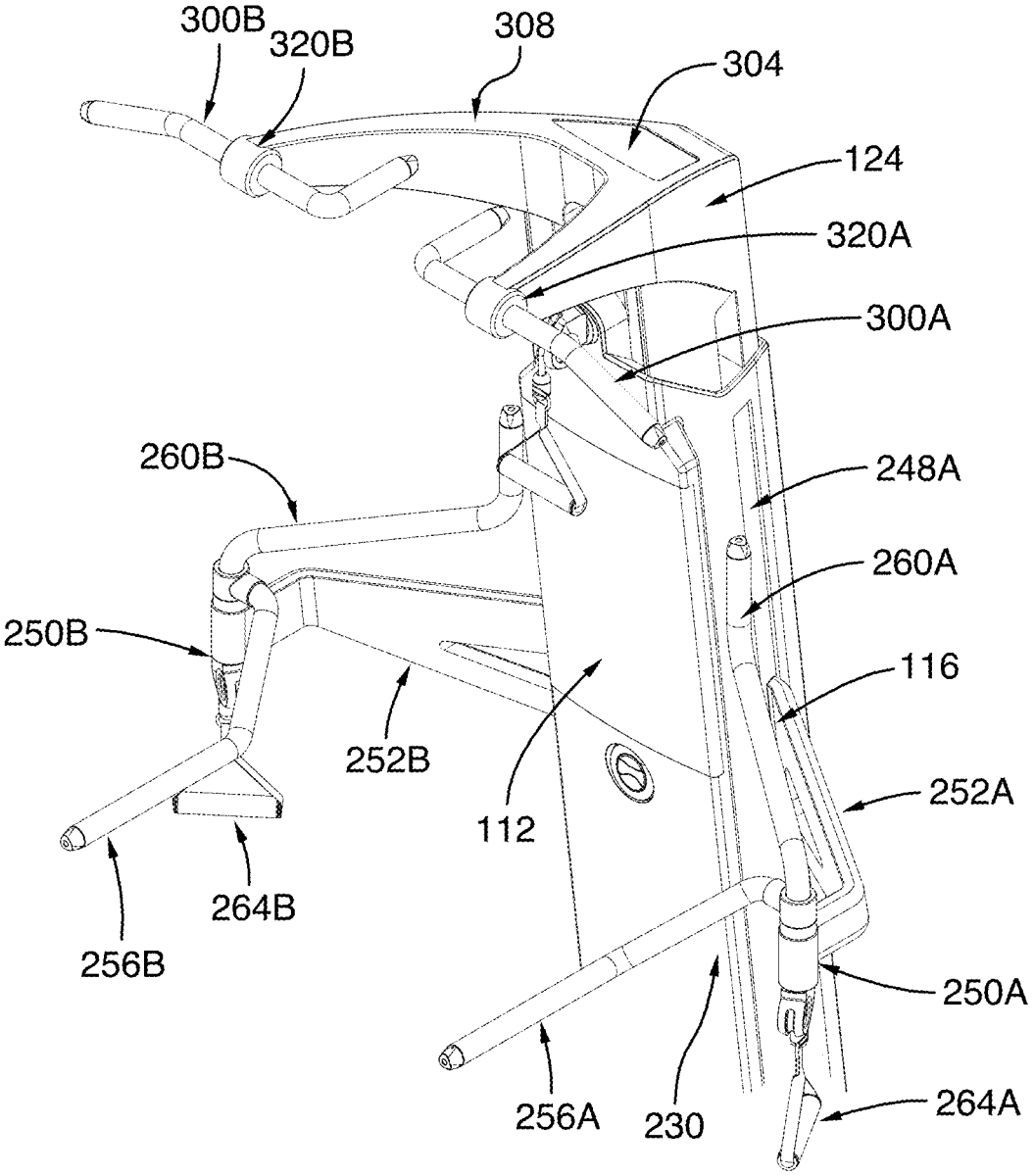
FIG. 12 is a front left perspective view of the exercise apparatus of FIG. 1, showing the crossarm module in a lowered position, the upper right and left arms of the crossarm module rotated to allow for a weighted sled push exercise, and the lower right and left arms of the crossarm module rotated to act as safety bars on either side of the treadmill module.

The height of crossarm module 116 may be adjusted based on the exercise being performed by the user. Crossarm module 116 may slide upon rail 228 to be raised or lowered along rail 228 placed within center stack 108, and may be locked into place anywhere along the rail 228, allowing crossarm module 116 to be placed at any height along said rail 228. In a preferred embodiment, crossarm module 116 may be raised by 26 inches from its lowermost height. The height of crossarm module 116 may be adjusted to best suit the exercise being performed by the user, and to best suit the height of the user. For example, FIG. 11 depicts crossarm module 116 in the fully raised position 116-1, and FIGS. 12 and 13 depicts crossarm module 116 in the fully lowered position 116-2. In certain embodiments, height of crossarm module 116 may be adjusted manually by unlocking crossarm module 116 from rail 228, sliding crossarm module 116 to the preferred height along rail 228, and then locking crossarm module 116 at the preferred height on rail 228. In alternative embodiments, height of crossarm module 116 may be adjusted automatically through the use of a motor and controller, where a user may adjust the height of crossarm module 116 through touch screen 112. A person skilled in the art will recognize the different exercises that may be performed with different heights of crossarm module 116.

Different configurations of crossarm module 116 allow for different exercises to be performed. For example, in a fully raised position 116-1, resistance pulley 264A of crossarm module 116 may be used in a standing twist exercise where a user may move resistance pulley 264A from a retracted position 264-1 as depicted in FIG. 14 to an extend position 264-2 as depicted in FIG. 27. In another example, in a sled push exercise, crossarm module 116 may be in a fully lowered position 116-2 where both the upper portion of the "S" shape of upper right armbar 260A and upper left armbar 260B may be pushed upon, as can be seen in FIG. 28. A person skilled in the art will recognize the different exercises that may be performed with the different configurations of crossarm module 116. A person skilled in the art will also recognize that the different exercises that may be performed with different configurations of treadmill belt 136, whether it is in a locked, freely movable or powered configuration, in combination with the different configurations of crossarm module 116.

Referring to FIGS. 1 and 4, center resistance pulley 120 is depicted, and can be seen located/mounted above touch screen 112 and above crossarm module 116, mounted in the center of center stack 108. Center resistance pulley 120 is similar to other resistance pulleys previously discussed, such as resistance pulleys 168A, 168B, 172A, 172B, 264A and 264B, and is a pulley with variable resistance. In some embodiments, center resistance pulley 120 may have a greater range of resistance provided due to the center placement and the associated exercises that can be performed with center resistance pulley 120. In other embodiments, center resistance pulley 120 may have the same range of resistance as those previously described, with a simulated weight of between 1 lbs to 200 lbs, where the weight may be incremented by 0.5 lbs. Center resistance pulley 120 may be moved from a retracted position to an extended position and back to a retracted position as part of a user's exercise. For example, a cabled pistol squat may be performed using center resistance pulley 120.

Center resistance pulley 120 includes handle 284, cable 292, pulley 288 and bearing 296. Handle 284 is attachable to cable 292, and provides the user with an area to grip when exercising and pulling center pully 120 from a retracted position to an extended position, and also when moving center resistance pulley 120 from an extended position back to a retracted position. In the current embodiment, handle 284 is triangular in shape, and includes a grip for a user's hand. In certain embodiments, handle 284 may be larger than the handles of other resistance pulleys on exercise apparatus 100, as center resistance pulley 120 may be used for exercises where two hands are gripped around handle 284, and as such, the grip on handle 284 may be larger to accommodate a two handed grip, such as a rope attachment for tricep pulldowns, or a v-bar attachment. It is further contemplated that handle 284 may be of any shape that allows for a two handed grip. Furthermore, similar to other handles of resistance pulleys on exercise apparatus 100, the grip of handle 284 may include sensors, such as a heart rate sensor to detect the user's heart rate while they are exercising and using center resistance pulley 120, and a gyroscope to track the rotation and positioning of handle 284 as a user exercises. In addition, handle 284 may be detachable from cable 292 and replaced with other handles or other accessories. This will be further discussed below. A person skilled in the art will recognize the different possible configurations for handle 284. A persons killed in the art will also recognize that handle 284 may be interchangeable with handle 212. For example, handle 284 may be attached to cable 220 of resistance pulleys 168A, 168B, 172A or 172B, and handle 212 may be similarly attached to cable 282 of center resistance pulley 120. It will also occur to a person skilled in the art that any other attachments may also be interchangeably used amongst resistance pulleys 168A, 168B, 172A, 172B, 264A, 264B or center resistance pulley 120.

Pulley 288 provides guidance for cable 292 when center resistance pully 120 is moved between a retracted position 120-1 and an extended position (not depicted). Center resistance pulley 120 further includes bearing 296, which is connected to pulley 288. Bearing 296 allows for the rotation of pulley 288, allowing a user to pull down on handle 284 in any direction towards the front of exercise apparatus 100, away from center stack 108.

Similar to the other resistance pulleys in exercise apparatus 100, resistance against cable 292 as center resistance pulley 120 is moved between the retracted position 120-1 and the extended position (not depicted) may be adjusted in order to simulate different weights when exercising and moving the center resistance pulley 120 between the retracted position and the extended position. Resistance may be provided and adjusted through either mechanical means, or in a preferred embodiment, through magnetic means. For example, in an embodiment where a magnetic means is employed, a flywheel may be placed inside center stack 108, with cable 292 attached to the flywheel, and the magnetic field of magnets placed near flywheel may be adjusted to correspond with a change in resistance against cable 292. The magnetic field may be adjusted by either moving the magnets closer and further away from the flywheel, or by electrically adjusting the magnetic field of fixed magnets. The amount of resistance provided against cable 292 may be adjusted based on a user's input on touch screen 112. A person skilled in the art will recognize the different potential methods and apparatus available to provide adjustable resistance against cable 292.

Exercises involving center resistance pulley 120 include a user pulling on center resistance pulley 120 moving it from the aforementioned retracted position 120-1 to an extended position (not depicted), and back to the retracted position 120-1 while a resistance is applied to cable 292. Exercises may include, but is not limited to, cabled pistol squats or inverted rows.

Center stack 108 further includes pull up arm module 124, where pull up arm module 124 is mounted on inner mast 304, located on top of outer mast 230 of center stack 108. Pull up arm module 124 includes a body 308 with a through hole 312 through the center of body 308 along a vertical axis. Inner mast 304 protrudes out the top of center stack 108, and through hole 312, allowing body 308 of pull up arm module 124 to telescopically slide vertically along inner mast 304. Referring to FIGS. 1 through 6 and FIGS. 15 and 16, in addition to body 308 and hole 312, pull up arm module 124 further includes right pull up bar 300A, and left pull up bar 300B.

Body 308 of pull up arm module 124 may be of any shape or design, and is not limited to the shape as depicted in FIG. 1. However, the shape of body 308 should not obscure or interfere with other modules or components on exercise apparatus 100. For example, body 308 has a semi-circular indent 316 that allows for the placement of center resistance pulley 120 when pull up arm module 124 is in its lowered position. In addition, while the shape of body 308 is not limited, in a preferred embodiment, the shape of body 308 may extend towards the front of exercise apparatus, to allow for right pull up bar 300A and left pull up bar 300B to extend away from center stack 108, allowing room for a user to perform pull ups and not hit or interfere with center stack 108.

Body 308 further includes pull up arm holders 320B and 320A. More specifically, body 308 includes left pull up arm holder 320B and right pull up arm holder 320A. Left pull up arm holder 320B and right pull up arm holder 320A are located on the previously described extended portion of body 308 which extends away from center stack 108 towards the center of exercise apparatus 100. Left pull up arm holder 320B and right pull up arm holder 320A are hollow cylinders, where the through hole allows for the insertion of left pull up bar 300B and right pull up bar 300A respectively. The left pull up bar 300B and left pull up arm holder 320B may be considered a clearance fit, allowing left pull up bar 300B to be frictionally held in place, but also allowing for adjustment. A user may rotate or move left pull up bar 300B towards the left or to the right depending on the user's arm length and stature, or depending on the exercise being performed. Similarly, right pull up bar 300A and right pull up arm holder 320A may also be considered a clearance fit for the same reasons and same adjustments.

In the current embodiment, left pull up bar 300B and right pull up bar 300A are shaped similar to an "L". More specifically, left pull up bar 300B has a first section 324B of left pull up bar 300B pointing inwards towards the central axis of center stack 108, and a second section 328B of the pull up bar 300B pointing outwards away from center stack 108, towards the left side of exercise apparatus 100. Furthermore, the second section 328B of pull up bar 300B is partially angled downwards. A similar configuration may be found on right pull up bar 300A, with a first section 324A, and a second section 328A. This configuration allows a user to perform different types of pull ups and will be discussed further below.

Pull up arm module 124 may be raised or lowered to adjust to the height of the user exercising. In the current embodiment, pull up arm module 124 is raised and lowered along inner mast 304 by telescopic means. In a preferred embodiment, pull up arm module 124 may be raised by 8 inches from its lowermost height. Inner mast 304 remains stationary while the body 308 of pull up arm module 124 may be raised or lowered and locked into place. As body 308 is lowered, the top of inner mast 304 becomes exposed through hole 312. Body 308 may be locked into place at any height along inner mast 304. Other designs for the raising and lowering of pull up arm module 124 may be contemplated, such as a notched ratchet system on inner mast 304, or pulleys to raise pull up arm module 124. In certain embodiments, pull up arm module 124 may be adjusted manually by a user raising or lowering arm module 124 along inner mast 304. In alternative embodiments, pull up arm module 124 may be raised or lowered using a motor and a controller, where a user may achieve the preferred height of pull up arm module 124 by interacting with touch screen 112. A person skilled in the art will recognize that there are different configurations that may be used for the raising and lowering of pull up arm module 124.

Figure 15:
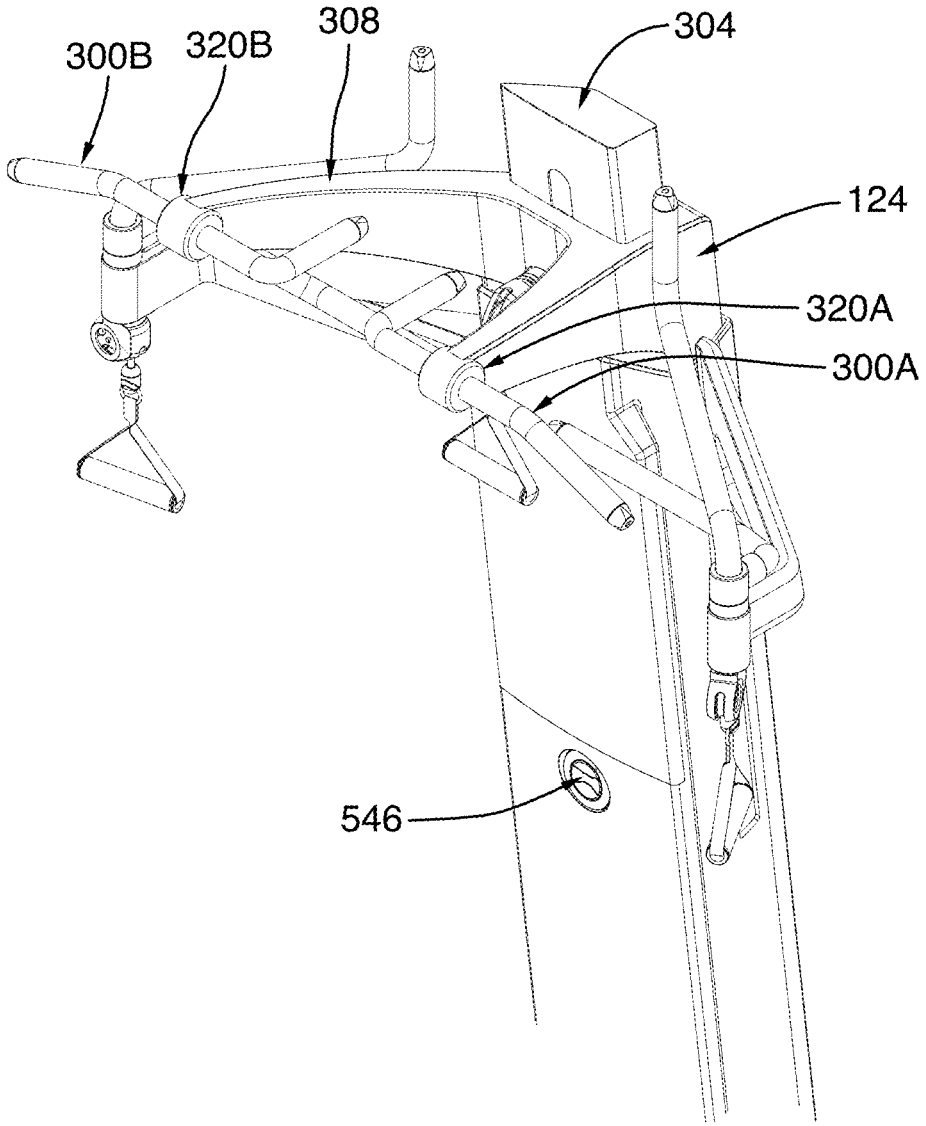
FIG. 15 is a front left perspective view of the exercise apparatus shown in FIG. 1, with the crossarm module shown in a raised position, and the pull up arm module in a lowered position.
Figure 16:
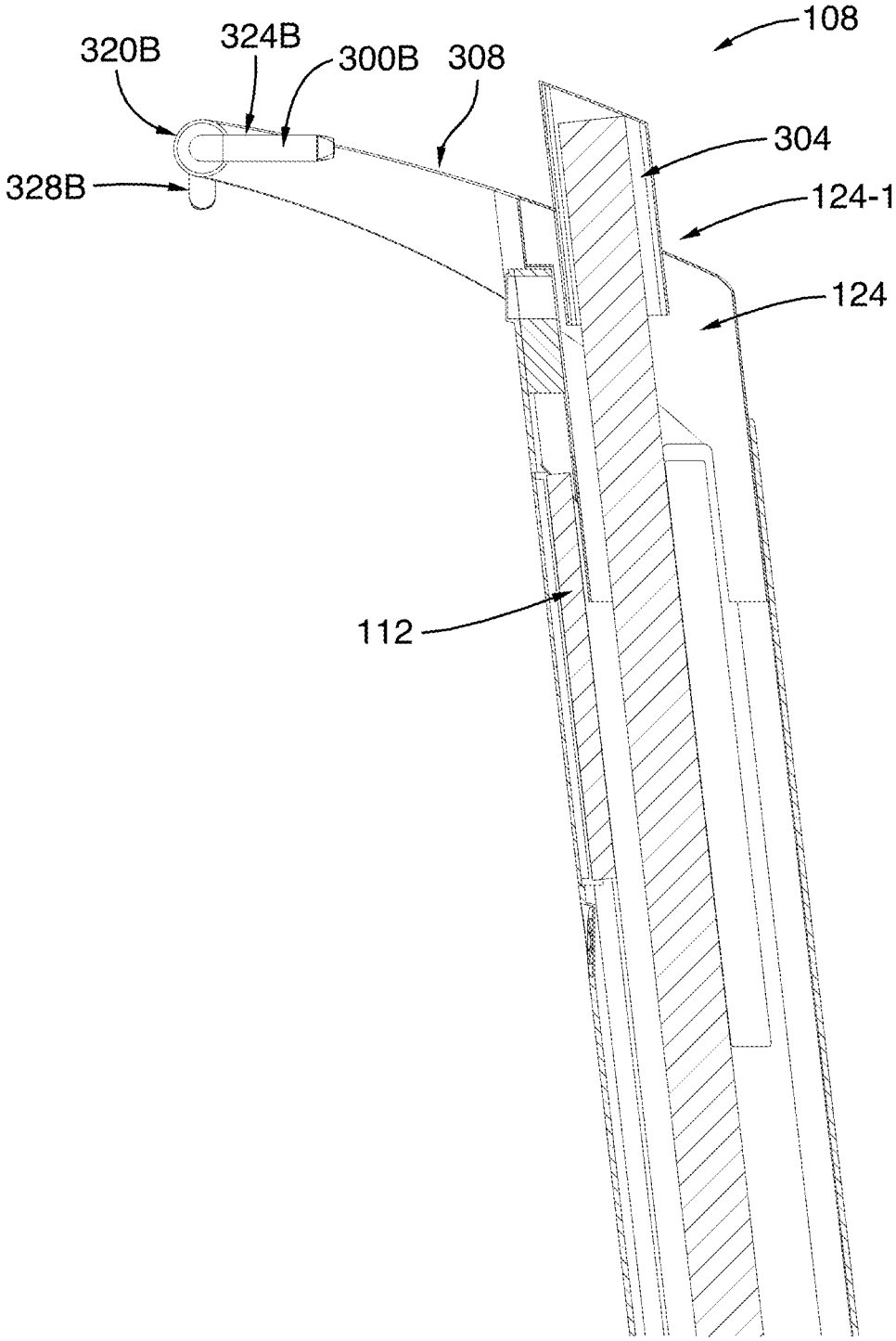
FIG. 16 is a cross-sectional view of the center stack similar to that shown in FIG. 11, except that the pull up arm module is in the lowered position.
Figure 29:
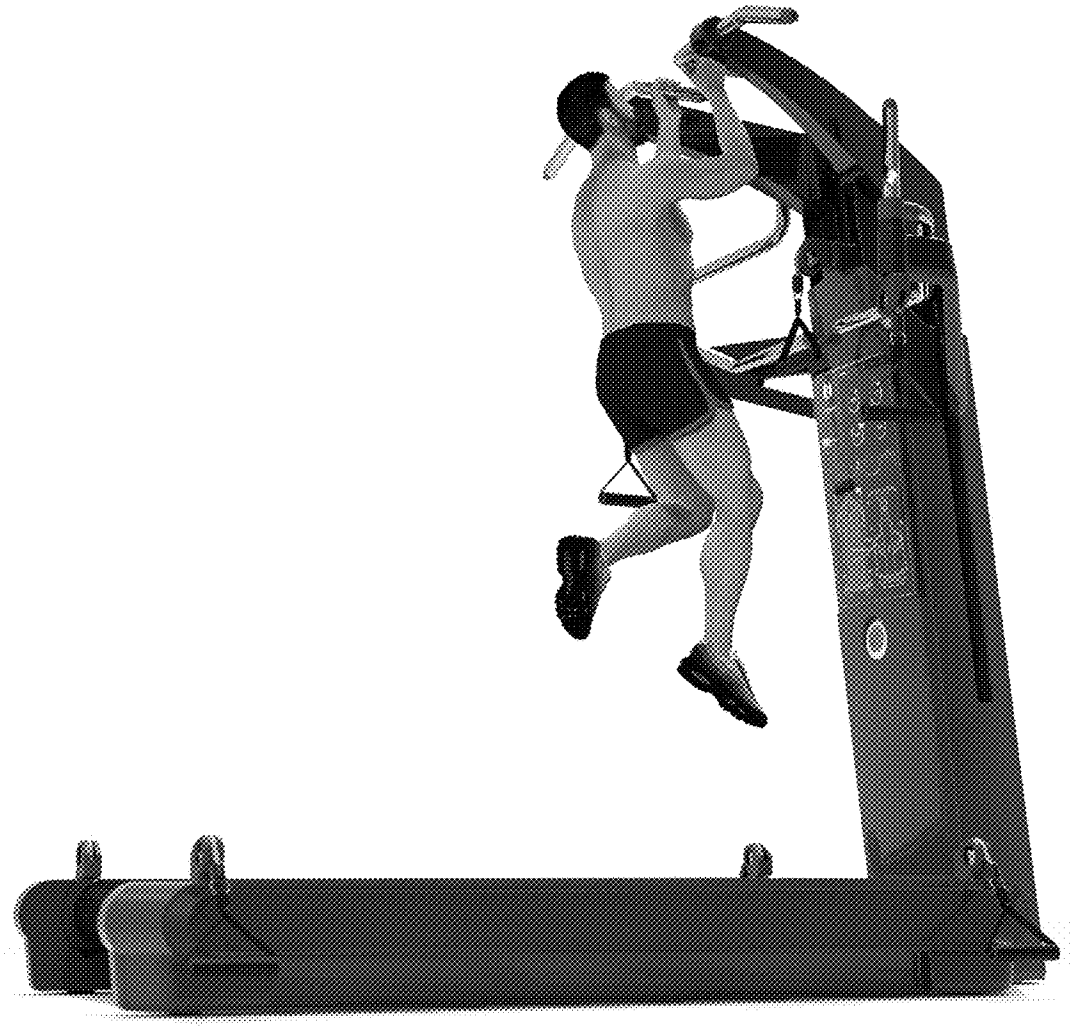
FIG. 29 is an additional front left perspective view of the exercise apparatus of FIG. 1, showing a user performing a neutral grip chin up exercise using the pull up arm module in a raised position.
Figure 30:
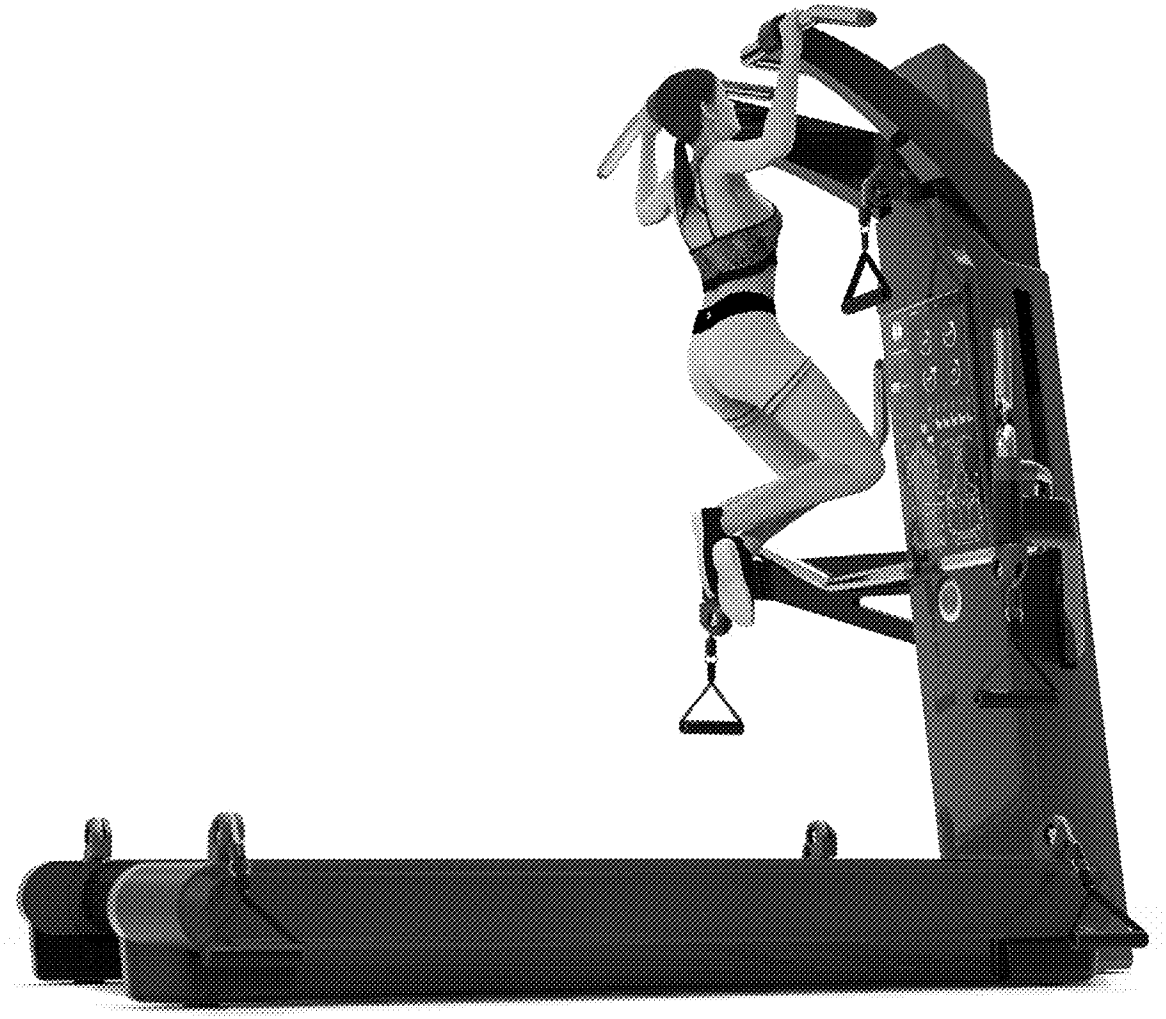
FIG. 30 is yet another front left perspective view of the exercise apparatus of FIG. 1, showing a user performing pull up exercises using the pull up arm module in a lowered position.

If a tall user were exercising, the pull up arm module 124 may be raised to its maximum height position 124-1, as is depicted in FIGS. 1, 2, 4, and 5, to provide additional clearance, so as when the user is performing a pull up, their feet are not touching the treadmill. FIG. 29 provides a depiction of a user performing a pull up with the pull up arm module 124 at its maximum height position 124-1. Alternatively, if a shorter user were exercising, the pull up arm module 124 may be lowered to its minimum height position 124-2 as is depicted in FIGS. 15 and 16, allowing the user easier reach of the right pull up bar 300A and the left pull up bar 300B. FIG. 30 provides a depiction of a user performing a pull up with the pull up arm module 124 at its minimum height position 124-2.

Different pull up exercises may be performed using pull up arm module 124. When a user is performing a pull up while grabbing first sections 324A and 324B of respective right pull up bar 300A and left pull up bar 300B, the user is performing a close grip pull up, allowing the user to target the muscles in the back and arms, and engages the biceps and chest muscles. FIG. 29 depicts an example of this exercise, where the user is grabbing first sections 324A and 324B. When a user is performing a pull up while grabbing second sections 328A and 328B of respective right pull up bar 300A and left pull up bar 300B, the user is performing a wide grip pull up, allowing the user to target the muscles in the back, chest shoulders and arms. The partially downward angled portion of second sections 328A and 328B allows for a user to get a better grip of right pull up bar 300A and left pull up bar 300B without the need for twisting the user's wrist significantly.

Figure 22:
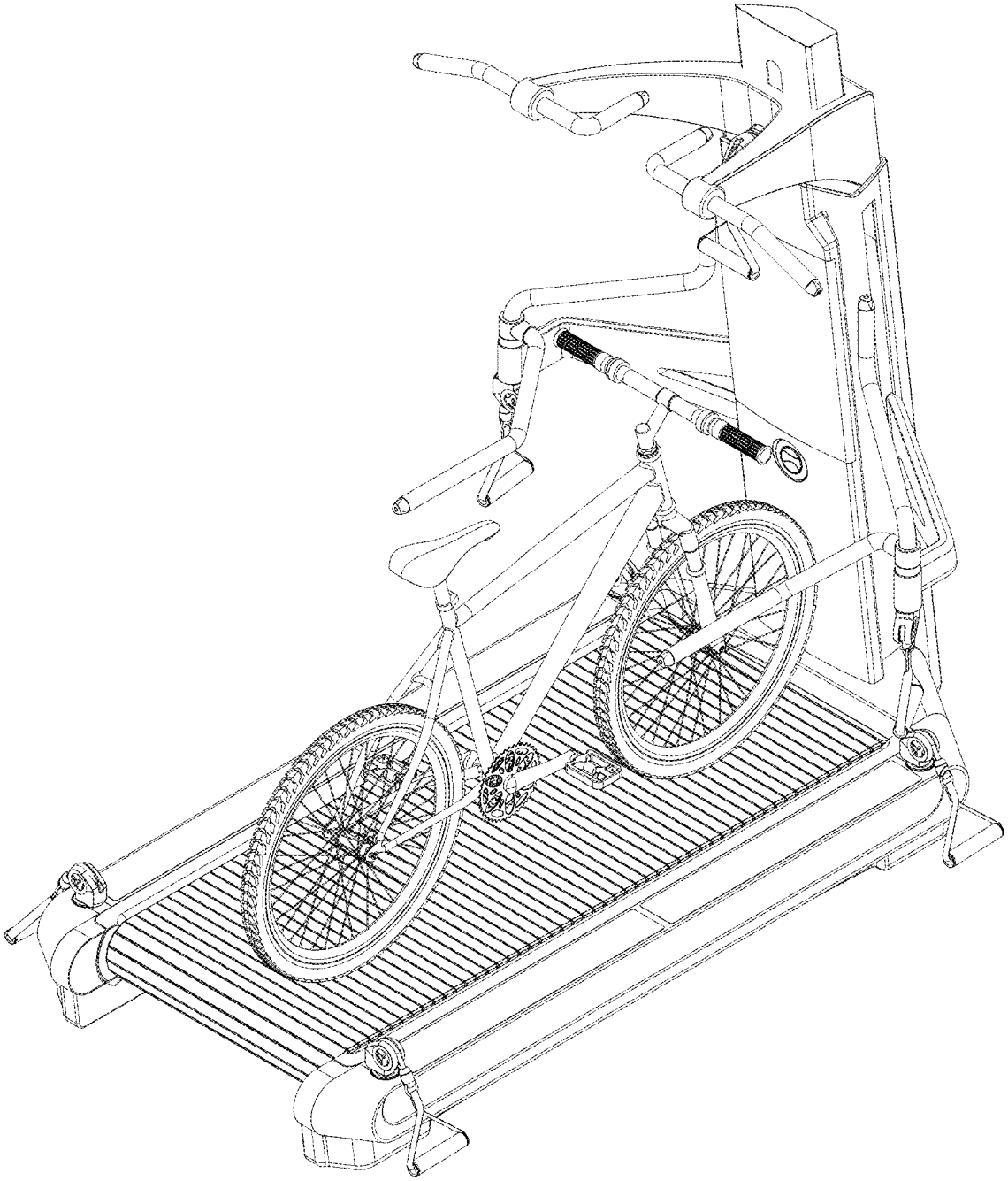
FIG. 22 is a front left perspective view of the exercise apparatus similar to that shown in FIG. 1, with a bicycle placed on the treadmill platform.
Figure 23:
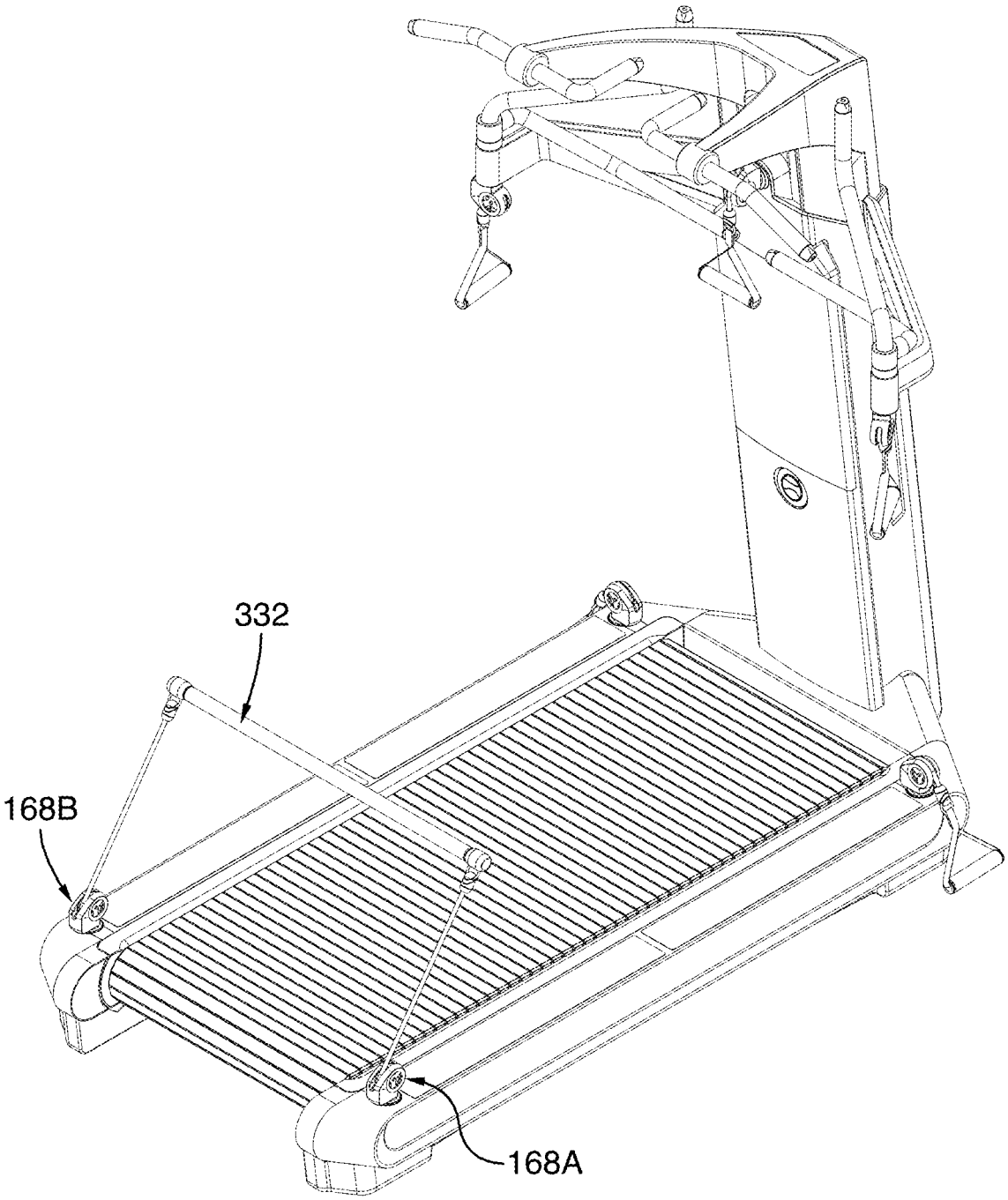
FIG. 23 is a front left perspective view of the exercise apparatus similar to that shown in FIG. 1, where a crossbar is connected to the two pulleys located at the front corners of the treadmill module.
Figure 32:
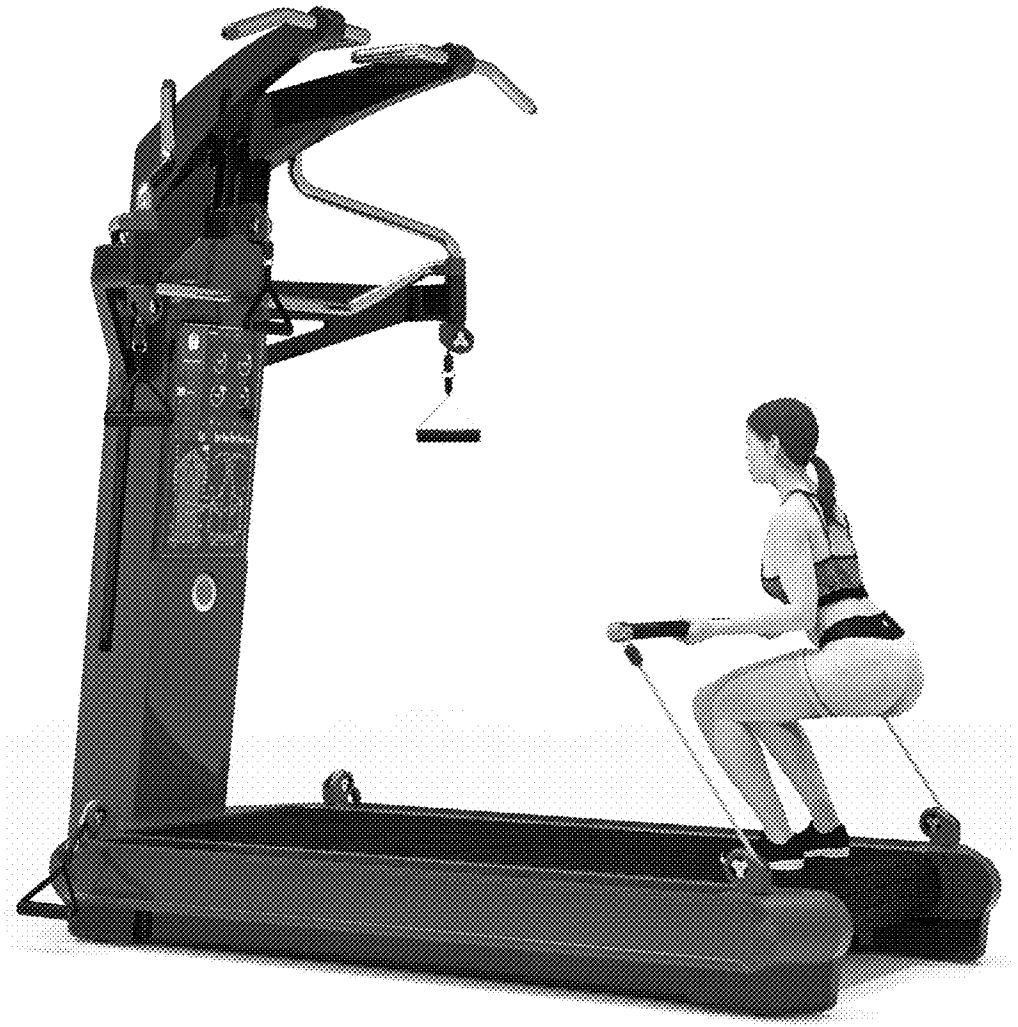
FIG. 32 is a further front right perspective view of the exercise apparatus of FIG. 1, showing a user performing bicep curls using a crossbar connected between the two pulleys located at the front corners of the treadmill module.

As previously discussed, handles on resistance pulleys may be detachable to be replaced with different handles or other accessories. As can be seen in FIG. 22, resistance pulleys 168A, 168B, 172A and 172B have had their handles removed, and the cables are securely attached to a bicycle placed on treadmill belt 136. The resistance of resistance pulleys allows for the bicycle to stay upright, and allows a user to cycle on the treadmill safely, allowing for an addition form of exercise. Specifically, the bicycle being securely attached to the cables of resistance pulleys 168A, 168B, 172A and 172B allow the bicycle to act as a stationary bicycle. Other forms of vehicles that may be placed on the treadmill belt 136 may be contemplated. For example, a wheelchair may be securely attached to the cables of resistance pulleys 168A, 168B, 172A and 172B. Another alternate use for resistance pulleys 168A and 168B is to replace the handles with crossbar 332, allowing a user to perform squats with the crossbar 332 on the user's back, providing resistance to the squatting movement. This can be seen in FIG. 31. In addition, bicep curls may also be performed using crossbar 332 as can be seen in FIG. 32. Other accessories that may be attachable include D-ring handles, ankle straps or a waist harness to hold a user upright when the user is doing sprints. A waist harness connected to cables may also be used to provide additional resistance when running, if the cable is hooked to the rear of the waist harness, acting like a parachute.

Figure 17:
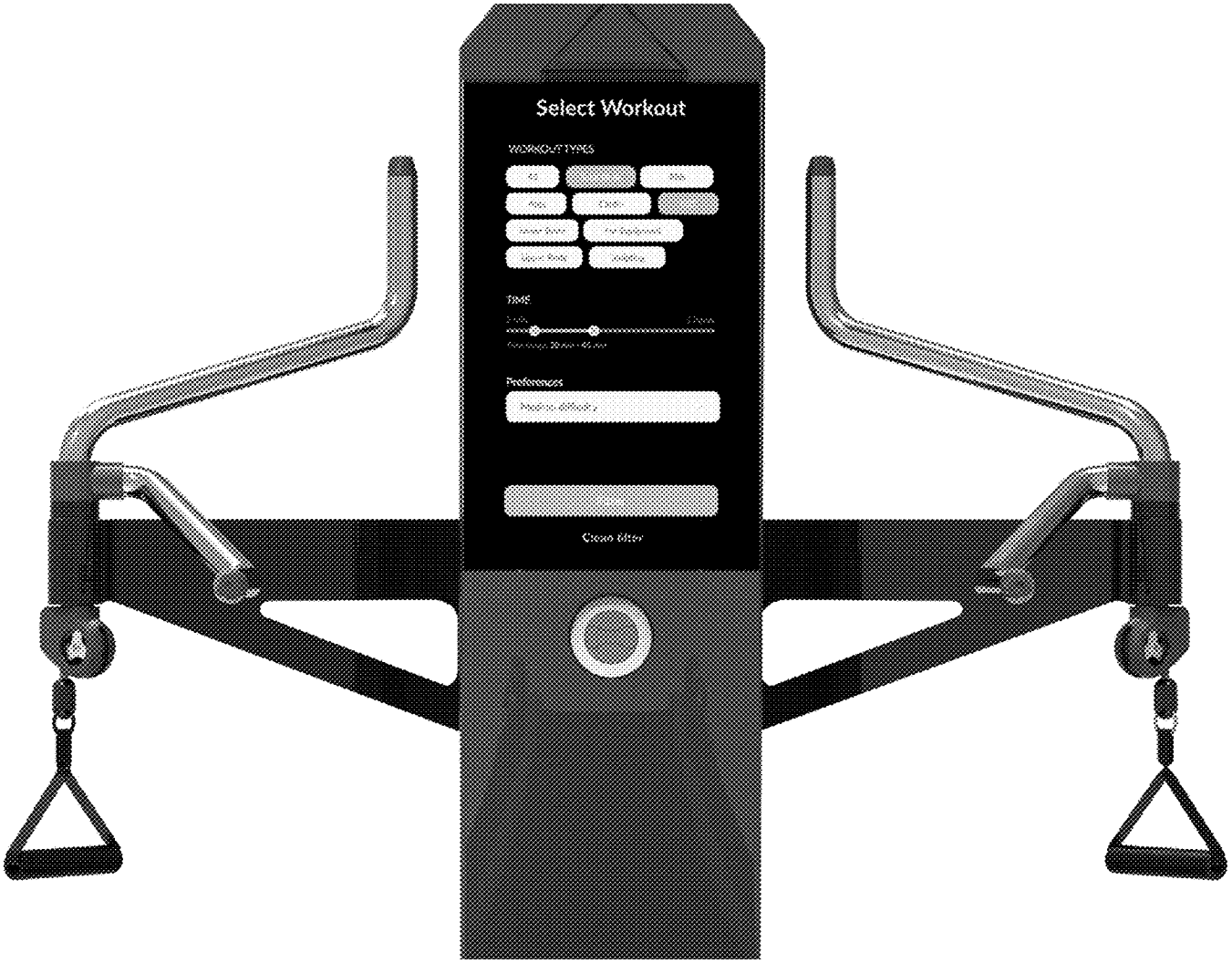
FIG. 17 is a front end view of the exercise apparatus of FIG. 4, showing a touch screen located on part of the mast portion of the center stack, the screen on the mast portion displaying a graphical user interface for selecting a workout type, workout duration and workout intensity.
Figure 18:
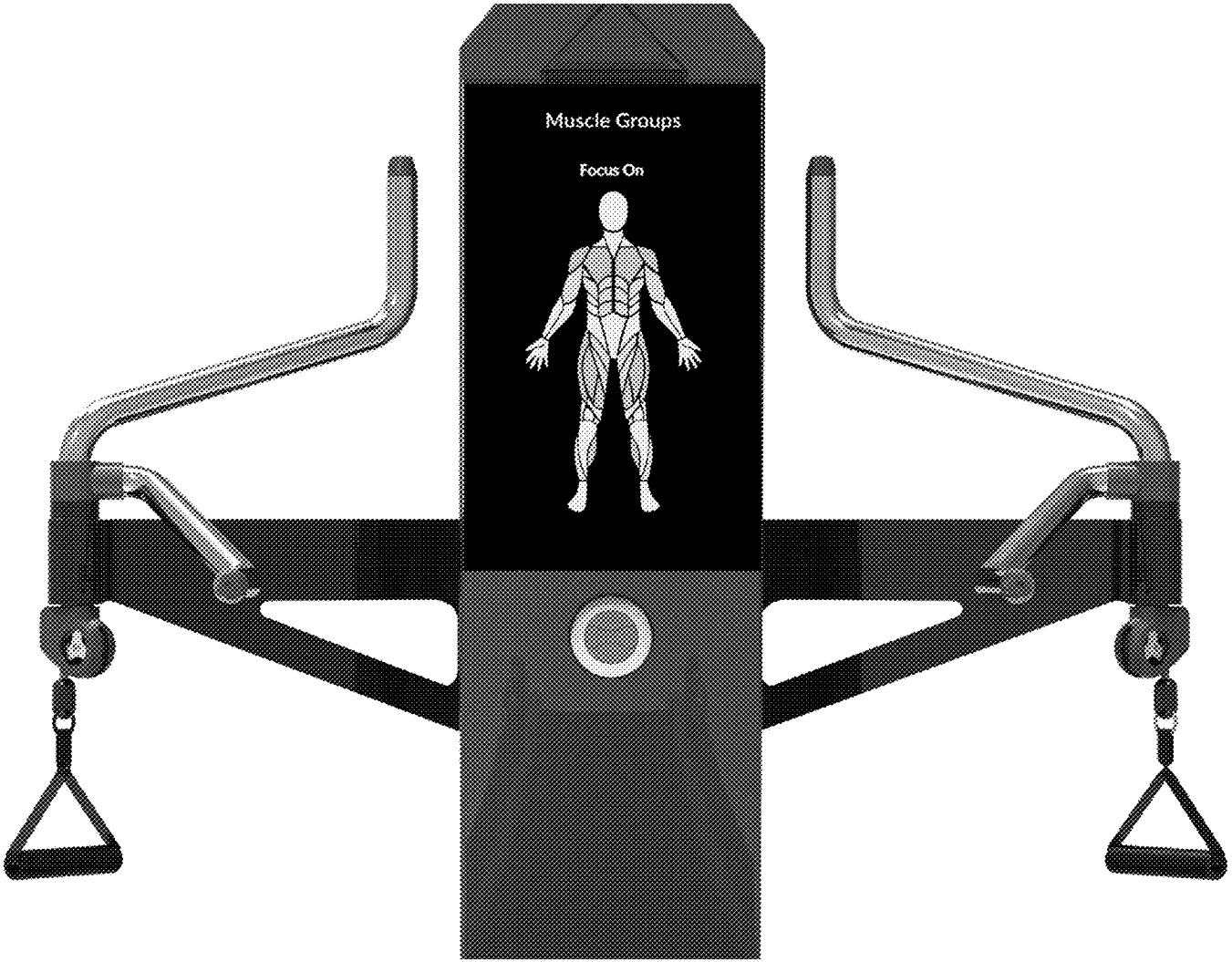
FIG. 18 is a front end view of the exercise apparatus similar to FIG. 17, except that the screen on the mast portion is displaying a graphical user interface for selecting a workout based on a specific muscle group.
Figure 19:
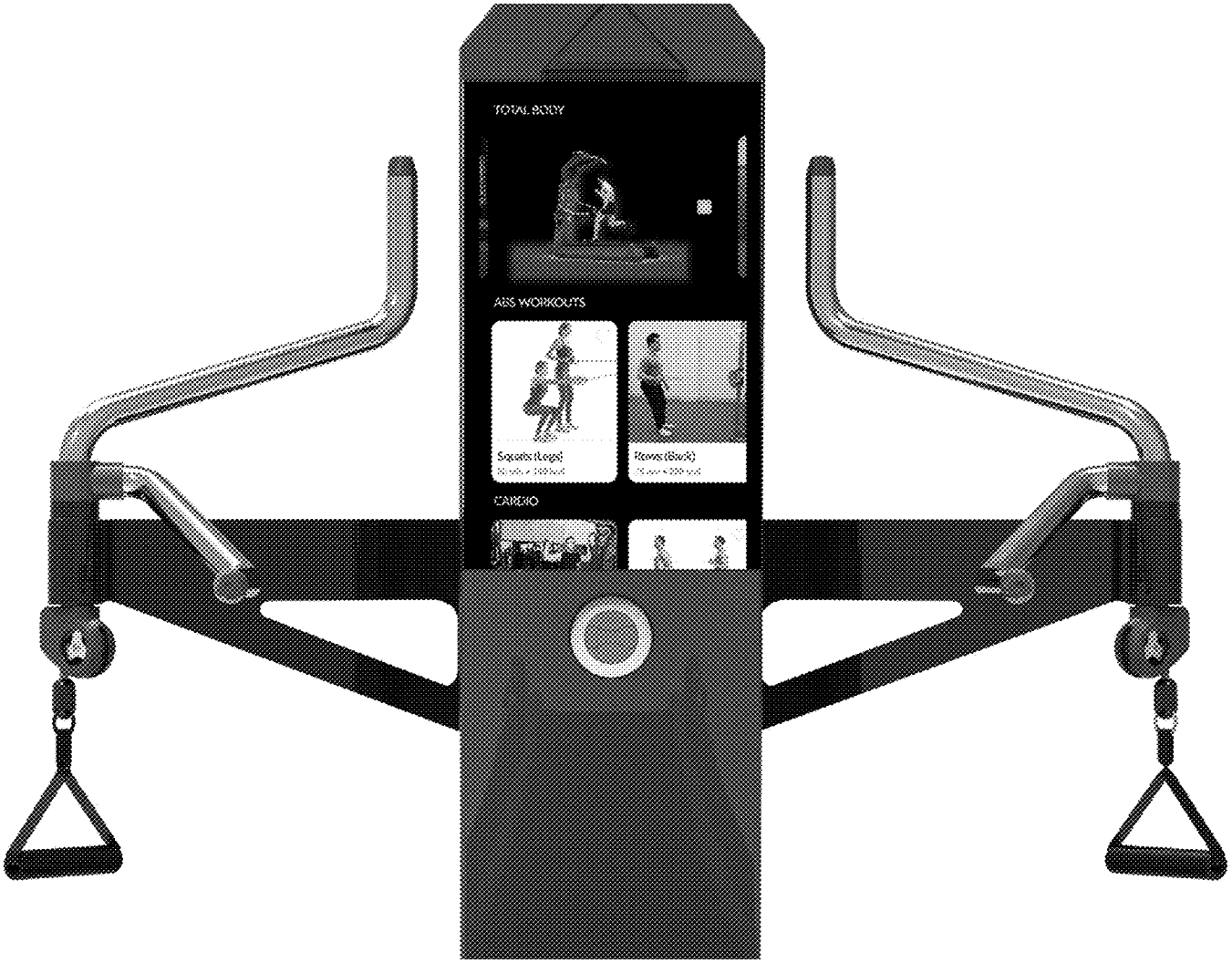
FIG. 19 is a front end view of the exercise apparatus similar to FIG. 17, expect that the screen on the mast portion is displaying a graphical user interface for selecting a preprogrammed workout.
Figure 20:
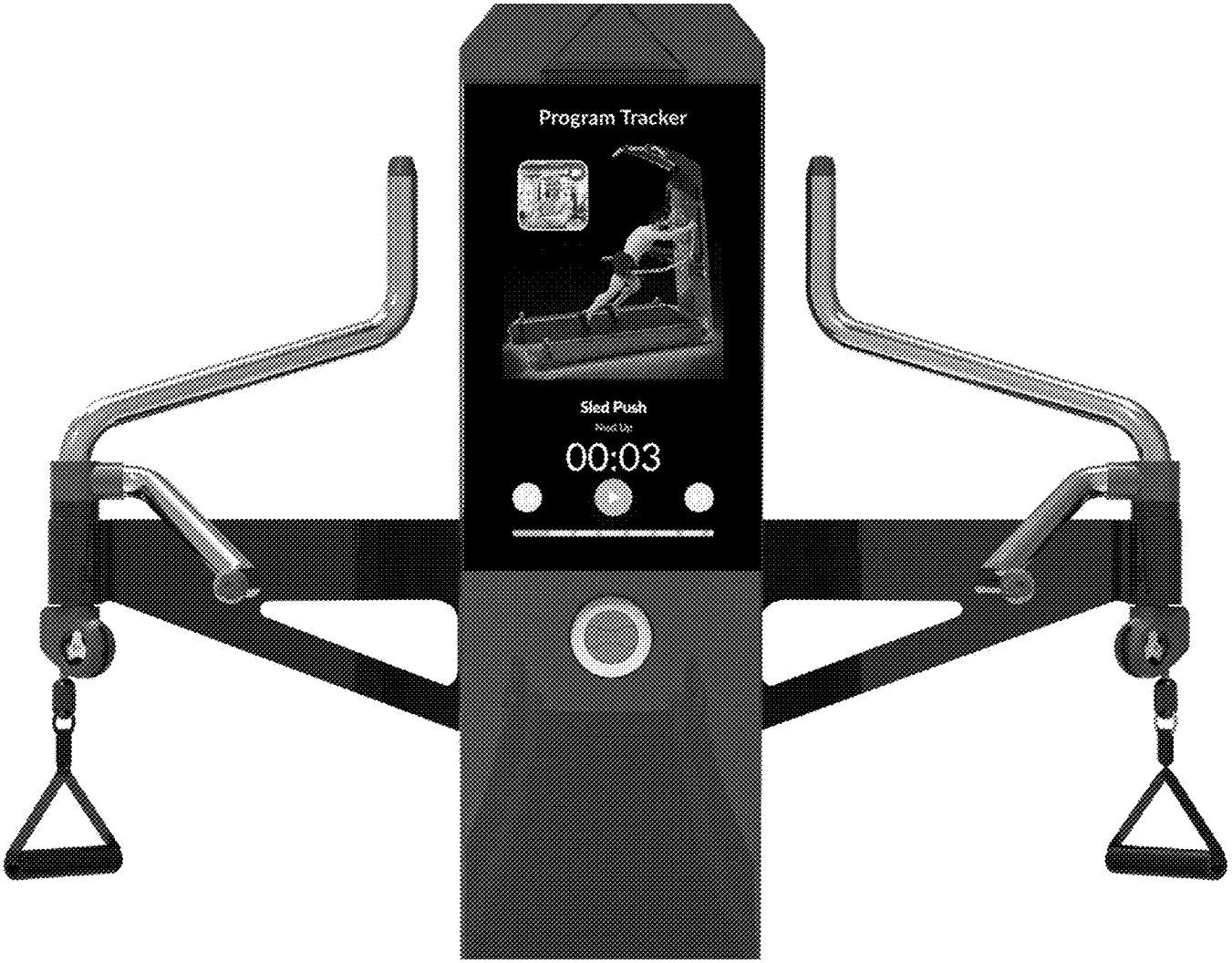
FIG. 20 is a front end view of the exercise apparatus similar to FIG. 17, except that the screen on the mast portion is displaying a graphical user interface for providing workout instructions and tracking the progress of the workout.
Figure 21:
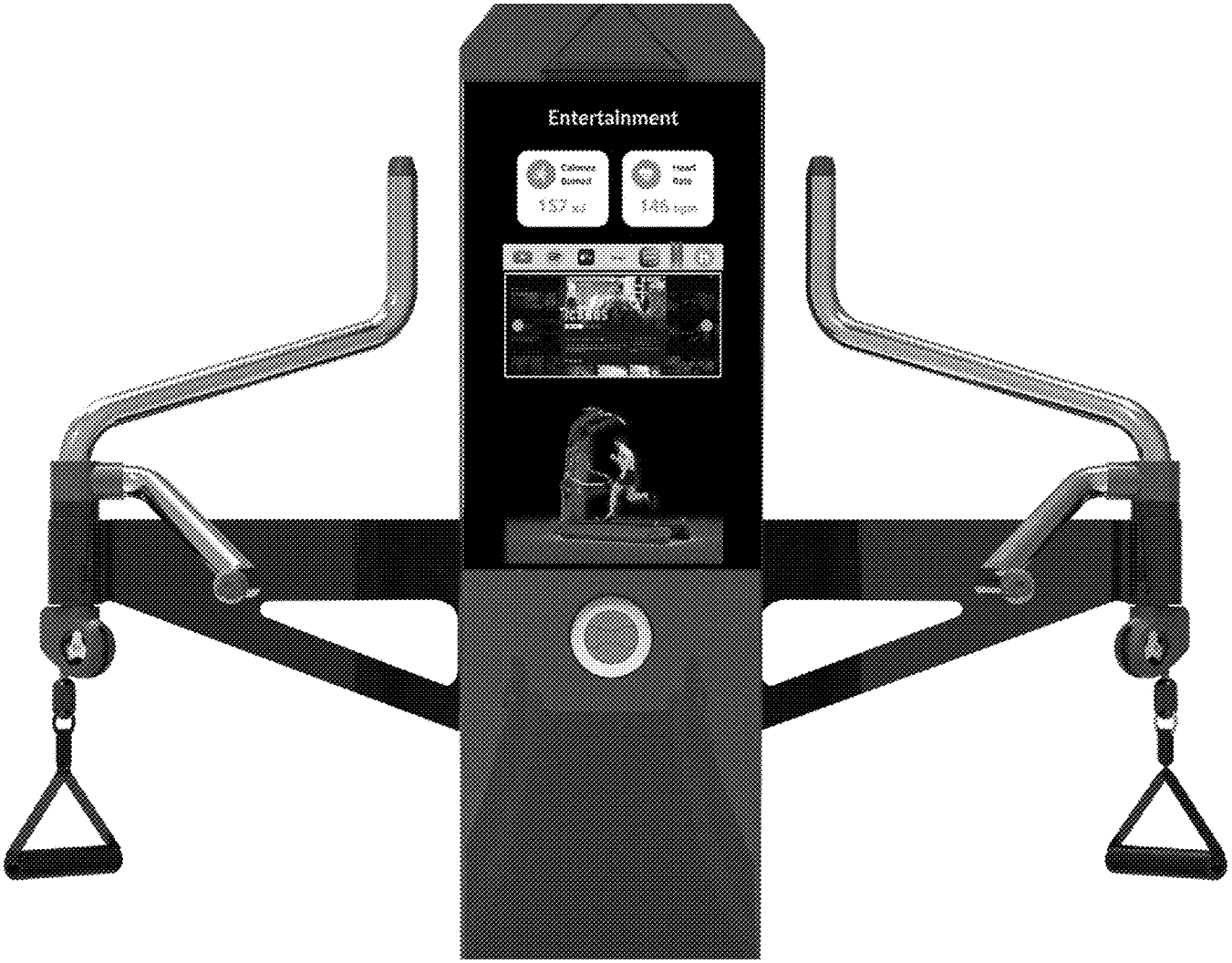
FIG. 21 is a front end view of the exercise apparatus similar to FIG. 17, except that the screen on the mast portion is displaying a graphical user interface for providing and selecting entertainment options to watch and listen to while working out.

Center stack 108 is used to house touch screen 112, and a computer (not shown) that provides a user interface to screen 112. Touch screen 112 is connected to the computer that is placed within center stack 108 and displays a user interface that allows users to select their workouts (as depicted in FIG. 17), review their progress during workouts (as depicted in FIG. 20), indicate particular muscle groups they wish to focus on (as depicted in FIG. 18), browse through available workouts (as depicted in FIG. 19), or watch other forms of entertainment while working out (as depicted in FIG. 21). Workouts may be stored locally in the computer, and updated via the internet, or may be streamed from an external server over the internet. For example, a video with audio of a workout may be streamed to be displayed as part of the user interface on touch screen 112. Users may interact with the user interface via screen 112 with screen 112 being a touch screen.

Figure 33:
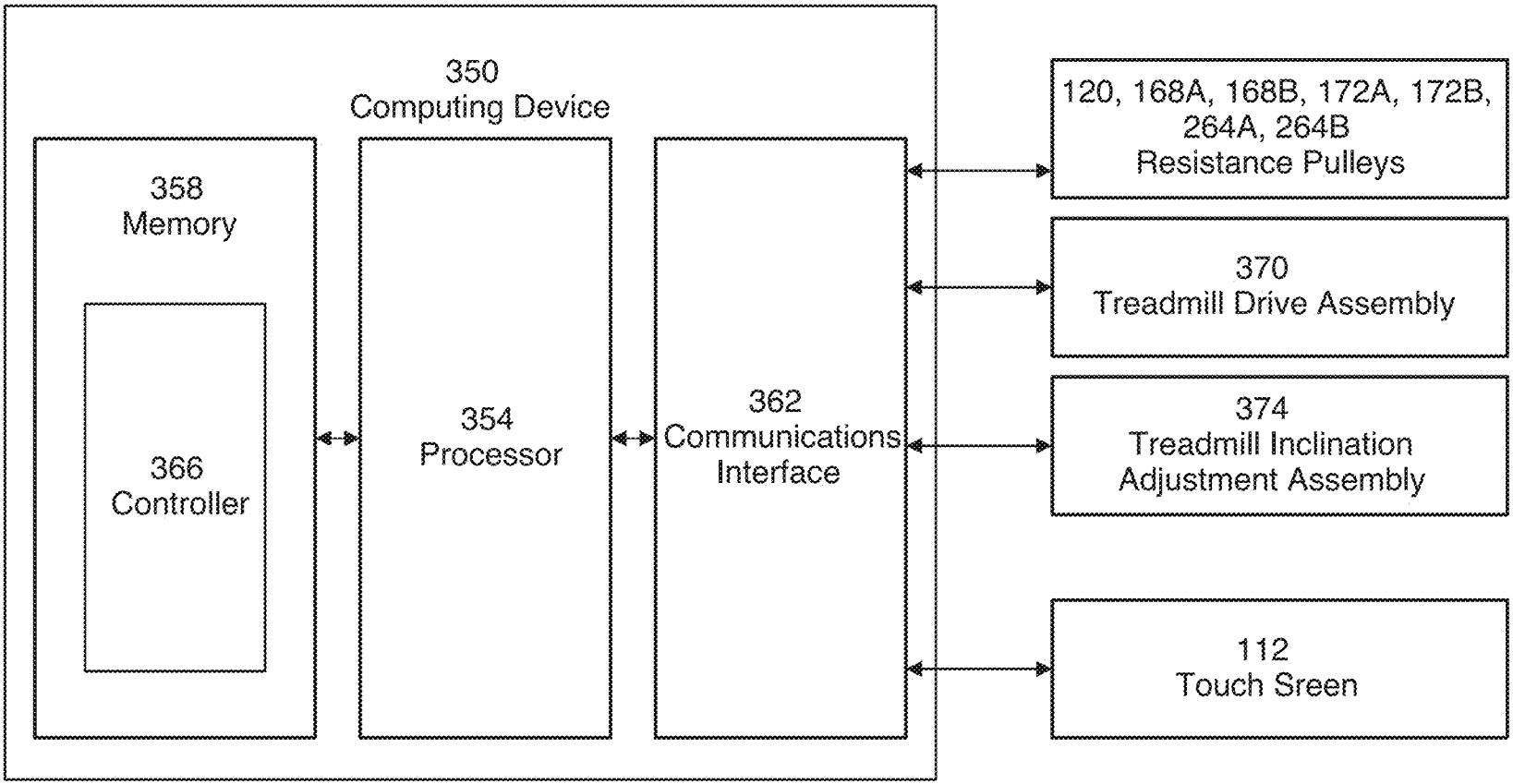
FIG. 33 is a block diagram showing a computer or computing device connected to various components of the exercise apparatus of FIG. 1.
Figure 34:
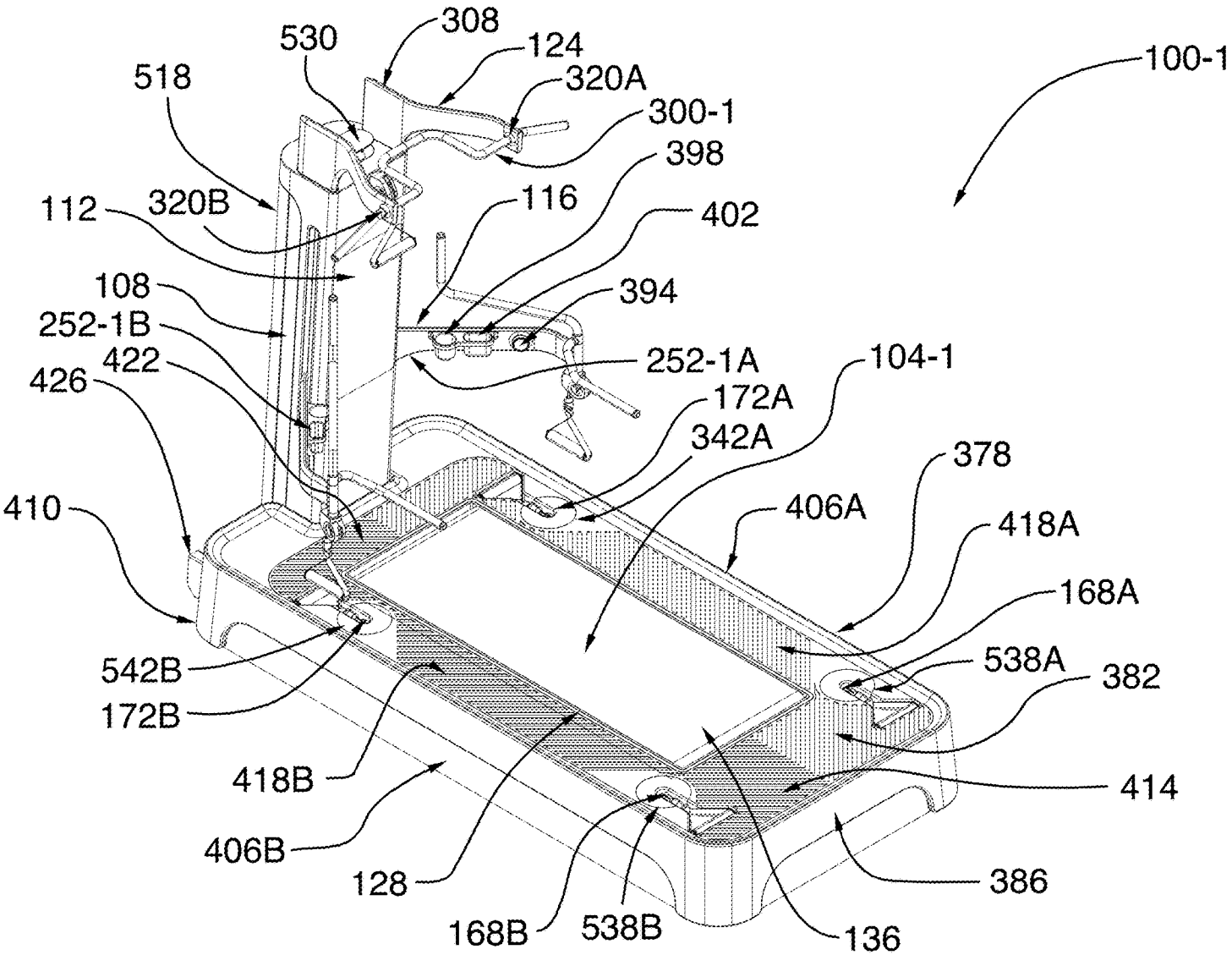
FIG. 34 is a front left perspective view of another embodiment of the exercise apparatus.
Figure 35:
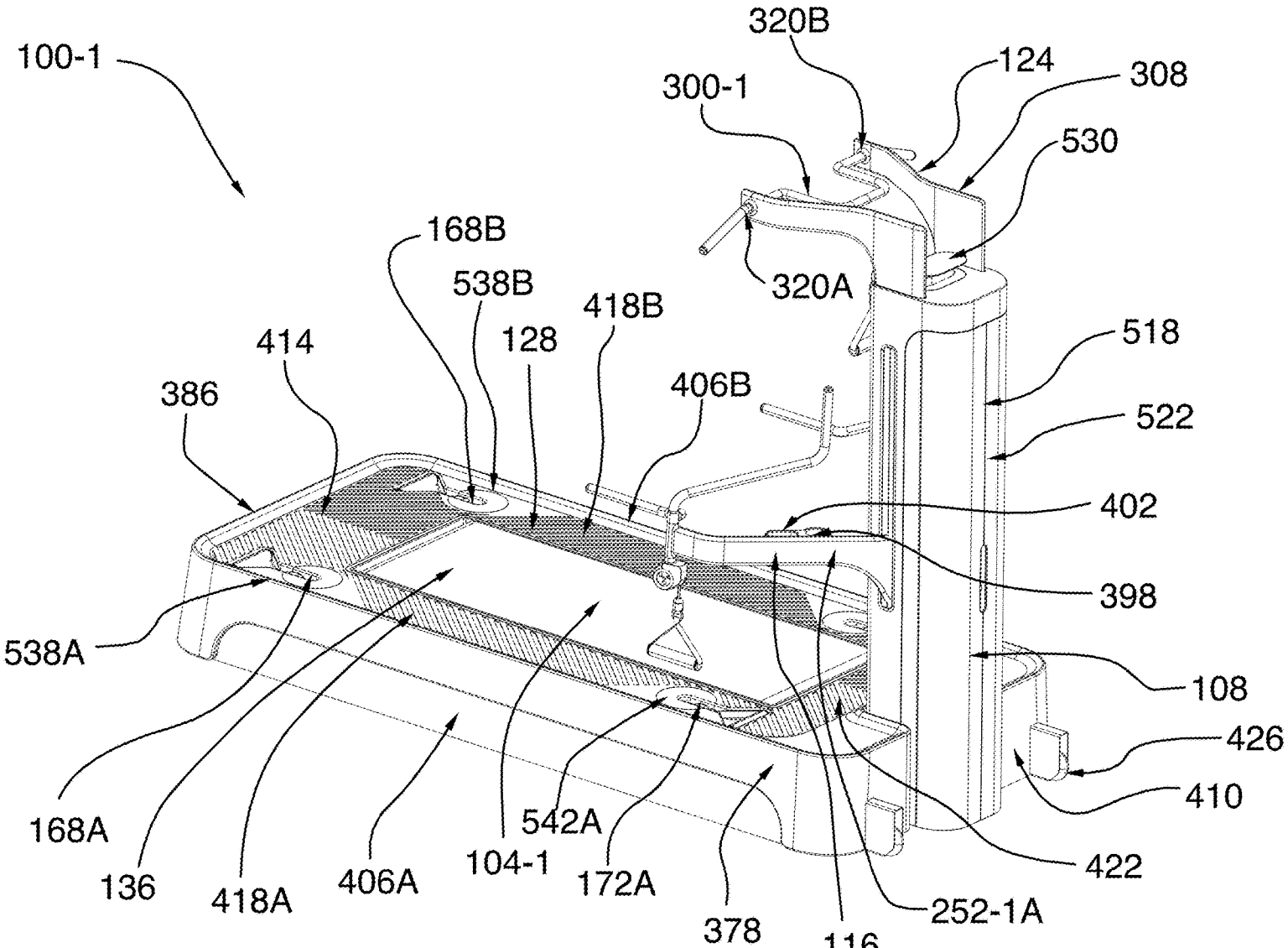
FIG. 35 is a rear right perspective view of the exercise apparatus shown in FIG. 34.
Figure 36:
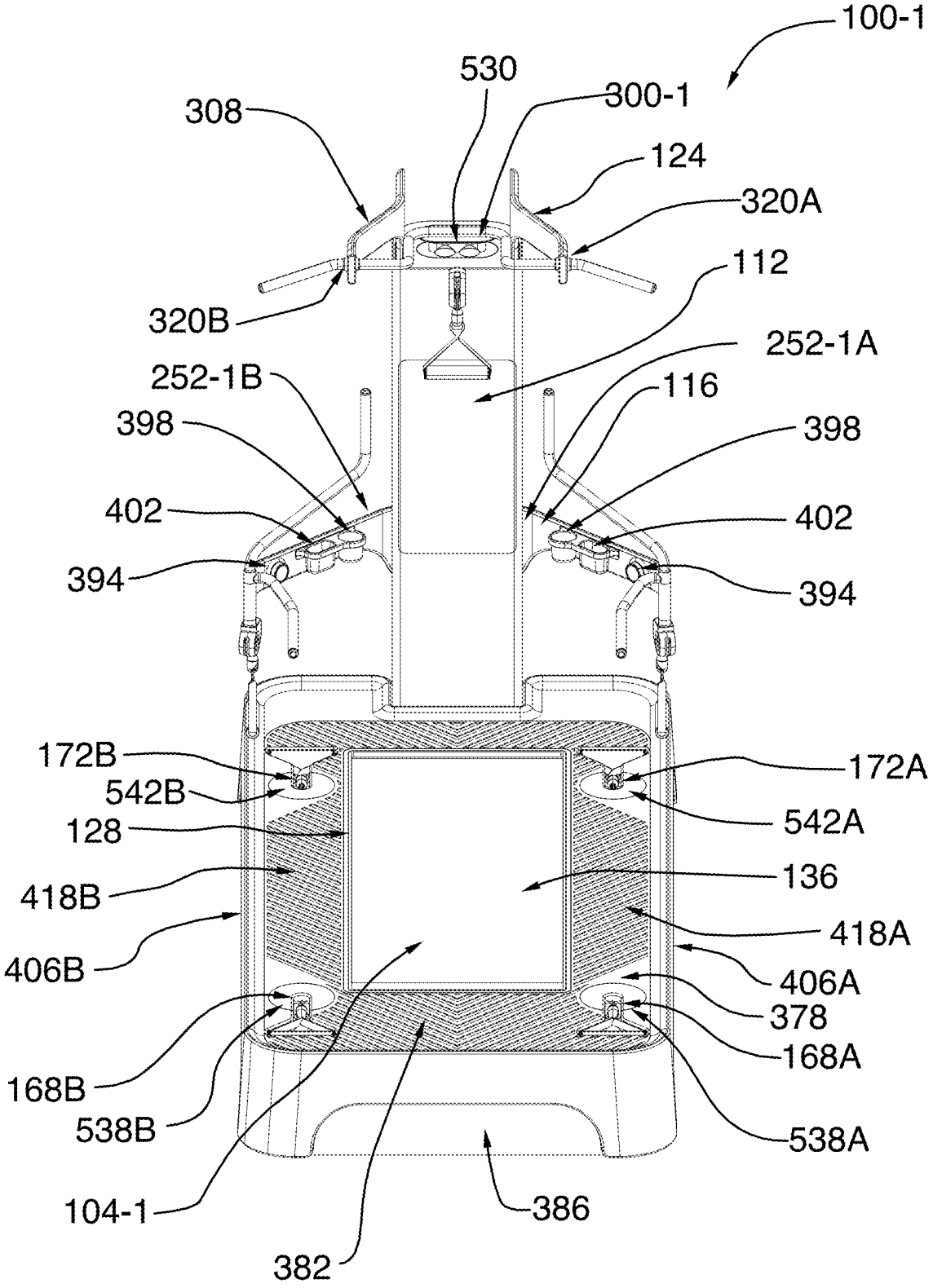
FIG. 36 is an angled front end view of the exercise apparatus shown in FIG. 34.
Figure 37:
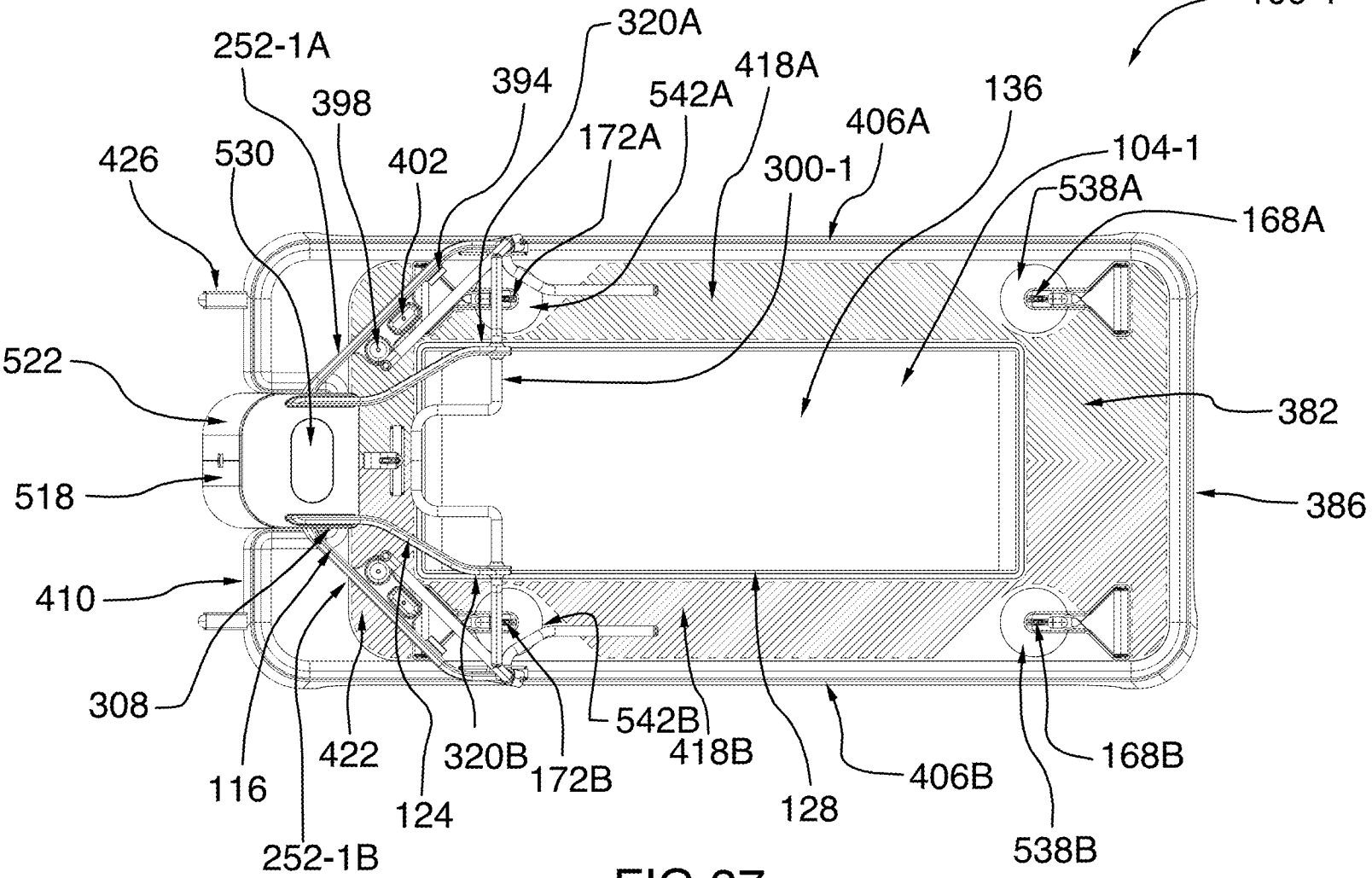
FIG. 37 is a top plan view of the exercise apparatus shown in FIG. 34.
Figure 38:
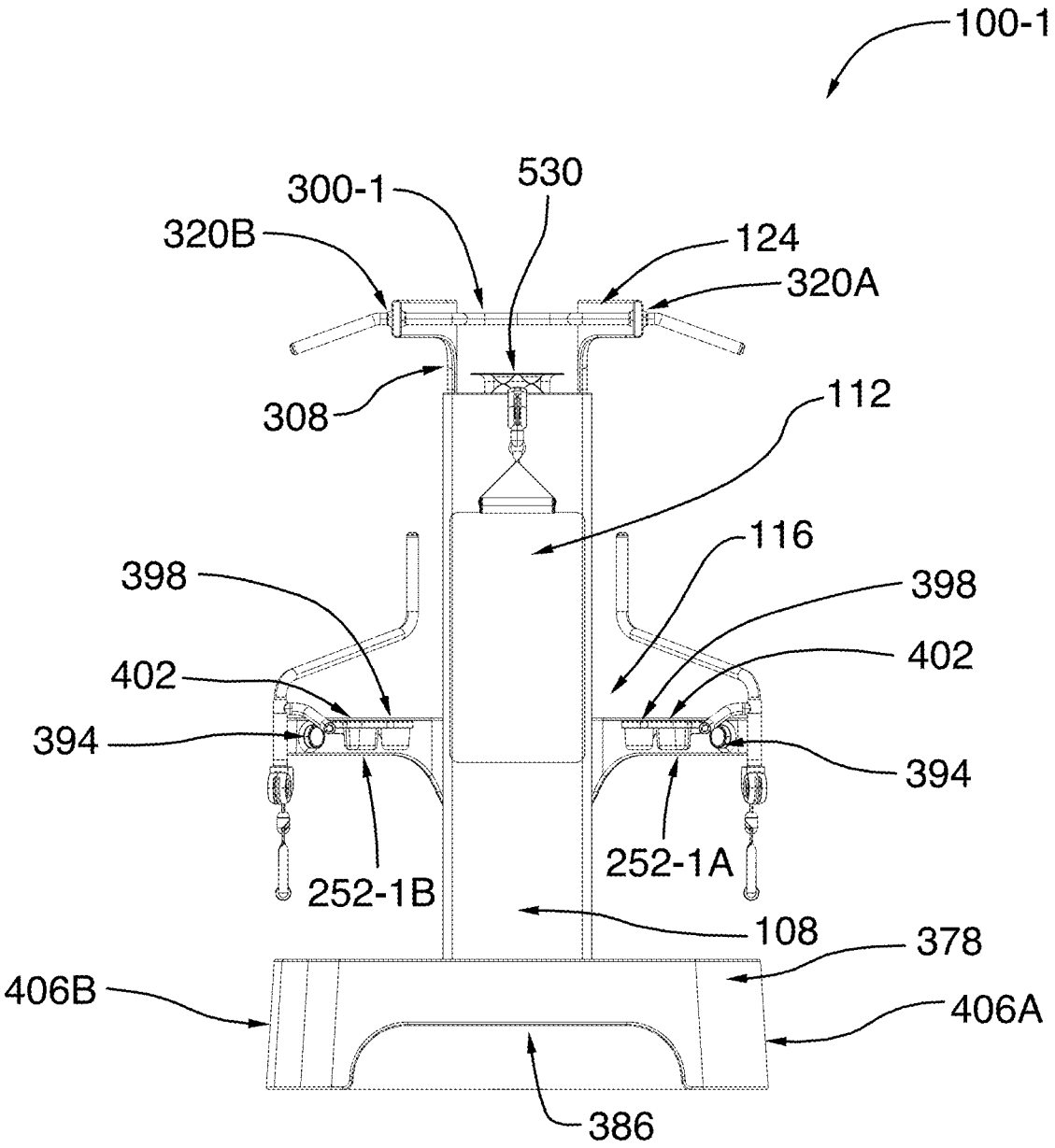
FIG. 38 is a front end view of the exercise apparatus shown in FIG. 34.
Figure 39:
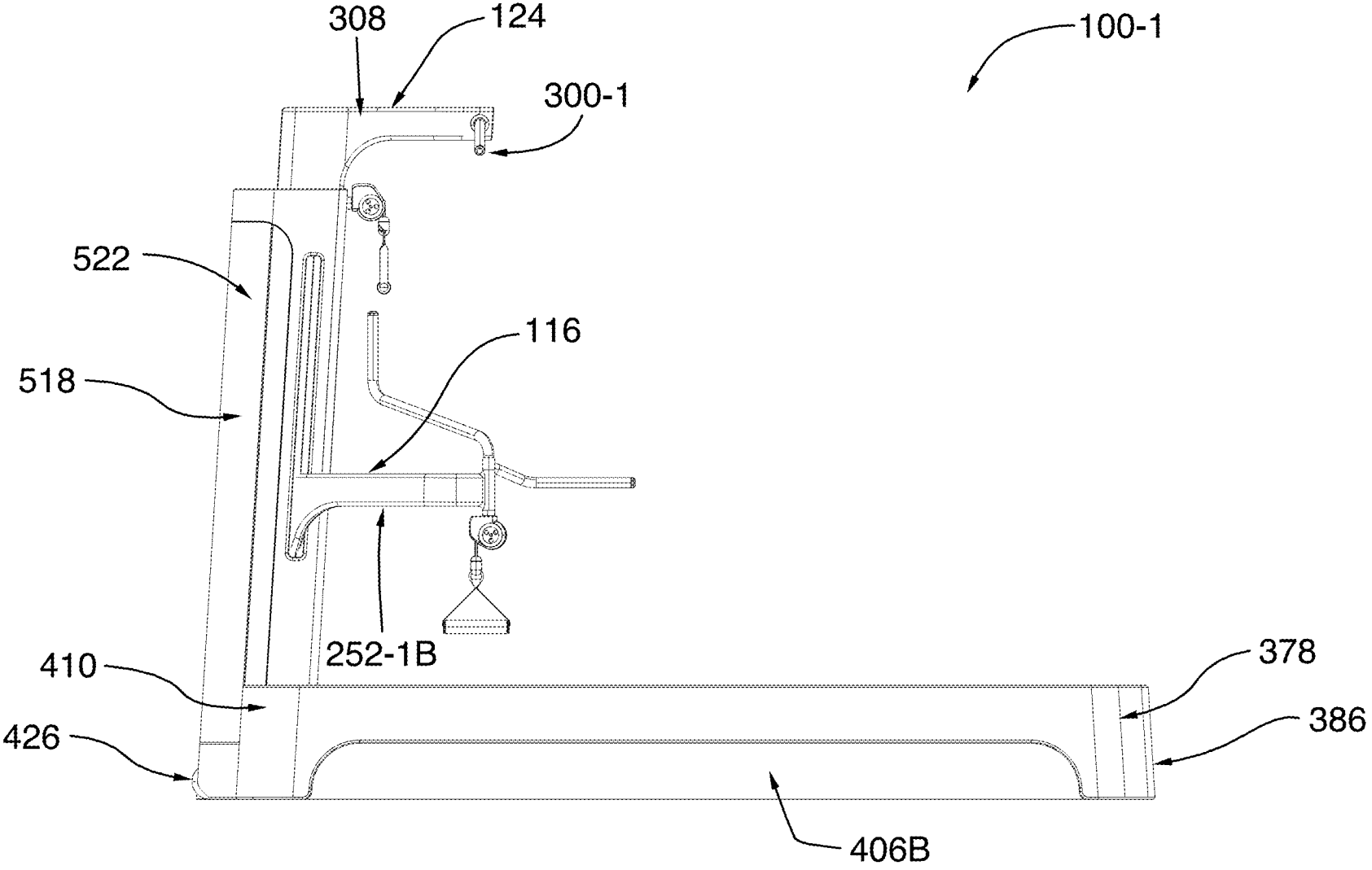
FIG. 39 is a left side view of the exercise apparatus shown in FIG. 34.
Figure 40:
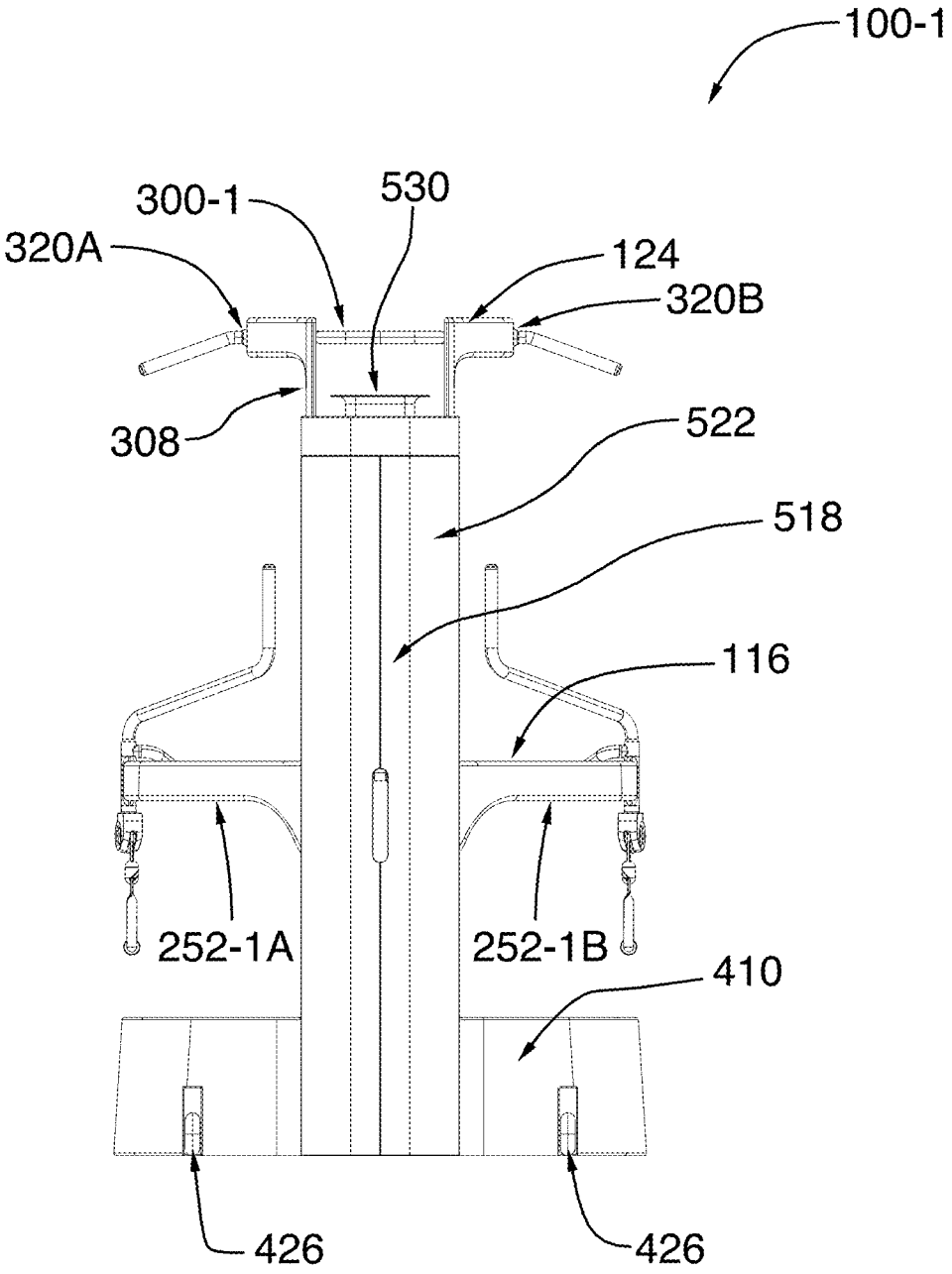
FIG. 40 is a rear end view of the exercise apparatus shown in FIG. 34.

Referring to FIG. 33, is an example computer or computing device 350 which includes a processor 354 interconnecting a memory 358 and a communications interface 362. The processor 354 can include a central-processing unit (CPU), a graphics processing unit (GPU), a microcontroller, a microprocessor, a processing core, a field-programmable gate array (FPGA), or similar. In some embodiments, the processor 354 can include multiple cooperating processors. The processor 354 can cooperate with non-transitory computer readable medium, such as the memory 358 to execute instructions to realize the functionality discussed herein.

The memory 358 can include a combination of volatile memory (e.g., Random Access Memory or RAM) and non-volatile memory (e.g., non-volatile random-access memory, read only memory or ROM, Electrically Erasable Programmable Read Only memory or EEPROM, flash memory). All or some of the memory 358 can be integrated with processor 354. Memory 358 stores computer readable instructions for execution by processor 354.

In some embodiments, memory 358 stores a plurality of computer-readable data and programming instructions, accessible by processor 354, in the form of software objects, such as various applications, queries or types of data for use during the execution of those applications. In particular, the execution of the instructions in memory 358 allow for data received through various heart rate sensors as a user exercises, storing the heart rate data over time for a particular user for future display. Data retrieved regarding a user's heart rate may be used to adjust the resistance of any of the resistance pulleys on exercise apparatus 100 or center resistance pulley 120 while exercising to provide either a harder exercise, or an easier one, depending on the user's settings, or whether a user may be performing warm up or warm down exercises. The person skilled in the art will now recognize that various forms of computer-readable programming instructions stored in memory 358 can be executed by processor 354 as applications or queries.

In at least some embodiments, memory 358 also stores controller 366. Controller 366 allows for inputs received through touch screen 112 to be converted into adjustments to be sent to various components on exercise apparatus 100 through communications interface 362. Inputs from touch screen 112 may be received by processor 354 on computer 350 through communications interface 362. Processor 354 may then convert the received inputs into adjustments using controller 366, which will then output instructions to the relevant component to adjust accordingly. For example, an input to adjust the angle of inclination for running deck 128 may be provided to touch screen 112 by a user, after which processor 354 receives the input through communications interface 362. Processor 354 may then convert the received inputs into instructions understood by treadmill inclination adjustment assembly 374 using controller 366, after which the instructions are sent to treadmill inclination adjustment assembly 374 where the angle of inclination is changed. A similar process may be used to control and/or adjust the resistance-on-resistance pulleys 120, 168A, 168B, 172A, 172B, 264A and 264B. A similar process may also be used to control the speed of treadmill belt 136, or to lock or allow the treadmill to freely move by providing input through touch screen 112, and controller 366 providing instructions to treadmill drive assembly 370.

In alternate embodiments, a similar process may be used to adjust the positions of crossarm module 116 or pull up arm module 124. For example, a motor may be located within outer mast 230 to move crossarm module 116 based on instructions from controller 366. A person skilled in the art will recognize the different components and configurations that may be affected based on the use of controller 366.

As previously indicated, communications interface 362 allows for processor 354 to receive inputs from touch screen 112. In alternative embodiments, communications interface 362 may also allow for wireless communication, such as through Bluetooth™, to receive data wirelessly from sensors that may be located on a user's body to fitness or exercise related bodily functions. For example, sensors may track heart rate, hydration levels, muscle performance, or blood oxygen levels. In other embodiments, communications interface 362 may be wired to sensors located throughout handles on exercise apparatus 100, such as handle 212 to record heart rate data. Other sensors that computer 350 may also be connected to include cameras to track movements of a user to ensure that they are exercising with proper form. The computer may also use the cameras to perform facial or image recognition for quick and easy determination of a user so as to provide the user with their previous exercise statistics and preferences.

A person skilled in the art will recognize that communications interface 362 includes suitable hardware (e.g., transmitters, receivers, network interface controllers and the like) allowing computer 350 to communicate with other input devices, such as the aforementioned sensors or touch screen 112. A person skilled in the art will also recognize that the connection between communications interface 362, the input components, and adjustable components of exercise apparatus 100 is not limited in its configuration to either wired or wireless.

Furthermore, a person skilled in the art will recognize that while in this embodiment, touch screen 112 is both an input device to receive input from a user and to display an output to a user, other devices, such as keyboards, mice, other external displays, or other external computing devices may also be contemplated.

Other embodiments of centre stack 108 may also be contemplated. For example, an alternate embodiment of centre stack 108 may include inner mast 304 (also referred to as an extension mast) secured to the top of a central mast (not shown), the central mast defined by front panel 232, which includes embedded touch screen 112, right side panel 236, left side pane 240 and rear panel 244. Inner mast 304 continues to provide a surface for pull up arm module 124 to slide vertically along inner mast 304, and extends the length of intended height adjustment for pull up module 124. More specifically, inner mast 304 extends between the minimum height position 124-2 and the maximum height position 124-1. Inner mast 304 also has a smaller circumference than the central mast.

Referring to FIGS. 34 to 40, there is an alternate embodiment exercise apparatus 100-1. Exercise apparatus 100-1 is generally similar to exercise apparatus 100 in all material respects, except as described below. Exercise apparatus 100-1 has a surrounding enclosure 378 around treadmill module 104-1 with positioning wheels 426 located at the rear lower peripheral of exercise apparatus 100-1 instead of a right enclosure 140A and a left enclosure 140B as is provided in exercise apparatus 100. In addition, exercise apparatus 100-1 may further include attachments to the crossarm module 116 for the user to interact or engage with, including physical buttons 394 to control the touch screen 112, a cup holder 398 and a phone holder 402.

Referring to FIGS. 42 to 45, exercise apparatus 100-1 further differs from exercise apparatus 100 in that frame 430 is provided as a support structure for treadmill module 104-1 and the panels defining surrounding enclosure 378. Treadmill module 104-1 is also similar to treadmill module 104, except for the addition of a treadmill module frame 434 as a supporting frame for the treadmill drive assembly 370-1 and treadmill inclination adjustment assembly 374-1.

Figure 46:
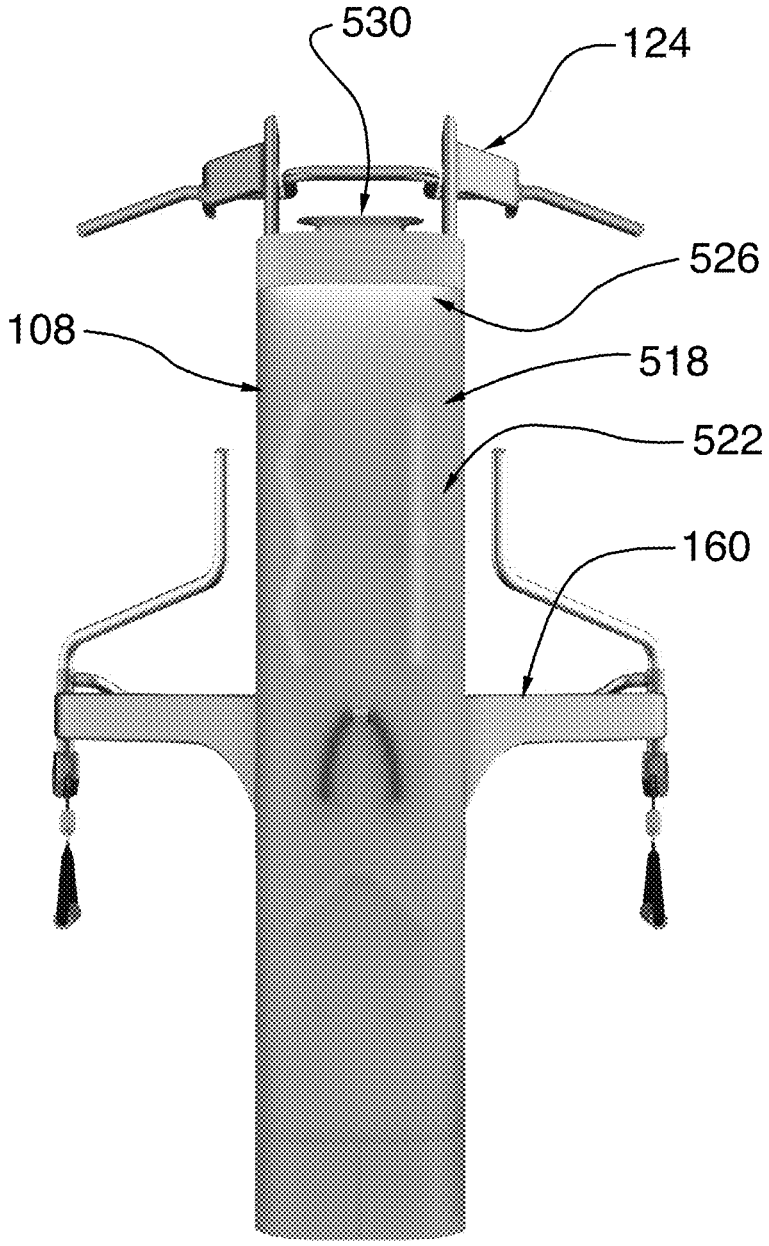
FIG. 46 is an angled rear end view of the accessory storage area and center mast of the exercise apparatus shown in FIG. 34, except that the treadmill module and base are removed.
Figure 47:
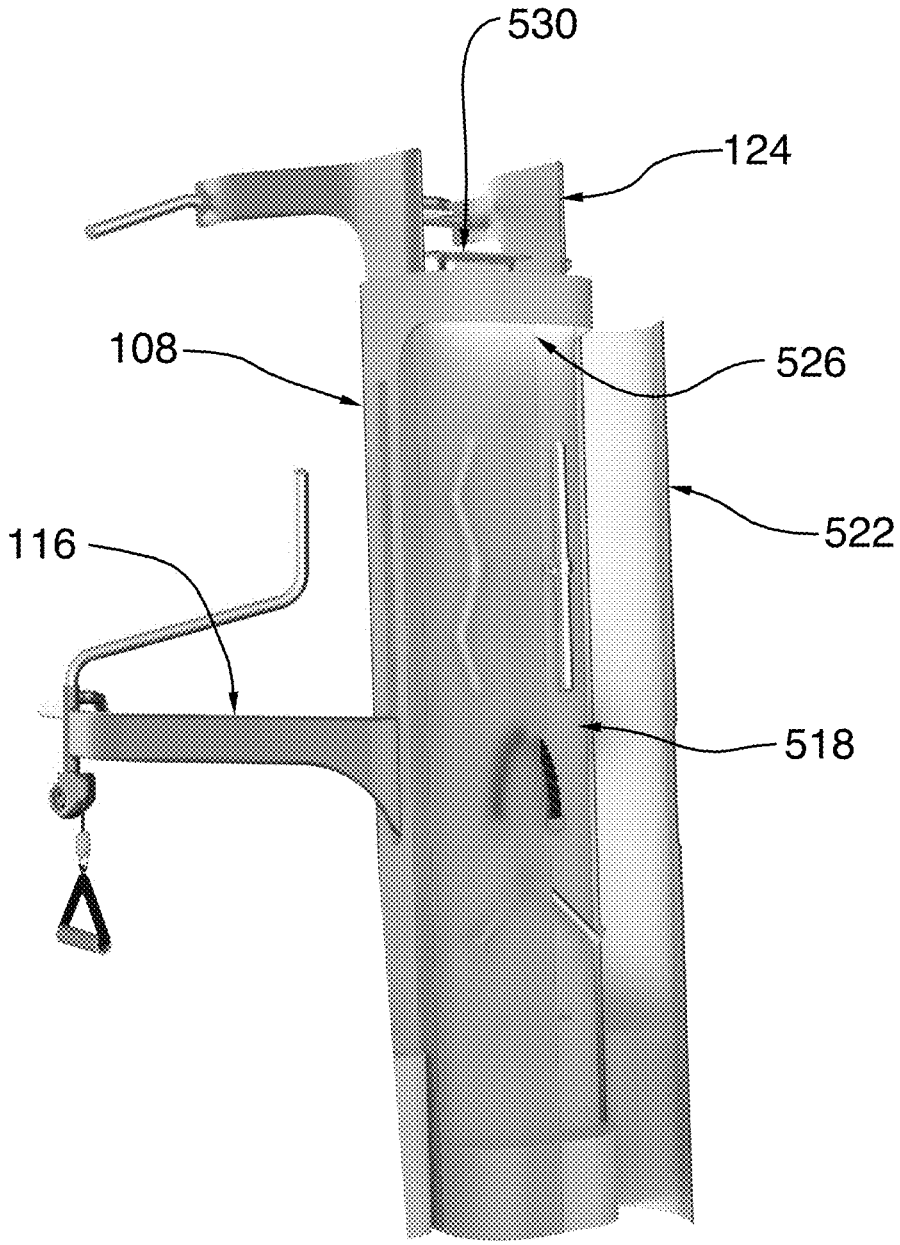
FIG. 47 is a rear left perspective view of the accessory storage area and center mast of exercise apparatus similar to that shown in FIG. 46, except that the treadmill module and base are removed, and that the accessory storage area doors are open.

Referring to FIGS. 46 and 47, exercise apparatus 100-1 also differs from exercise apparatus 100 in that there is an accessory storage compartment 518 with doors 522 on the rear of exercise apparatus 100-1, running along the entire height and width of center stack 108.

Returning to FIGS. 34 to 40, similar to exercise apparatus 100, exercise apparatus 100-1 has a running deck 128 and treadmill belt 136. However, exercise apparatus 100-1 does not include a right enclosure 140A or a left enclosure 140B. Rather the running deck 128 of exercise apparatus 100-1 includes a surrounding enclosure 378 bordering the outer edges of treadmill module 104-1. Surrounding enclosure 378 is defined by exercise platform 382 and front outer wall 386, right outer wall 406A, left outer wall 406B and rear outer wall 410. The surrounding enclosure 378 may also have a frame 430 within to support the exercise platform 382, and outer walls 386, 406A, 406B and 410. Optionally, surrounding enclosure 378 may also have a bottom cover (not shown) located below the exercise apparatus 100-1, providing additional protection to the components of treadmill module 104-1 from below.

Figure 41:
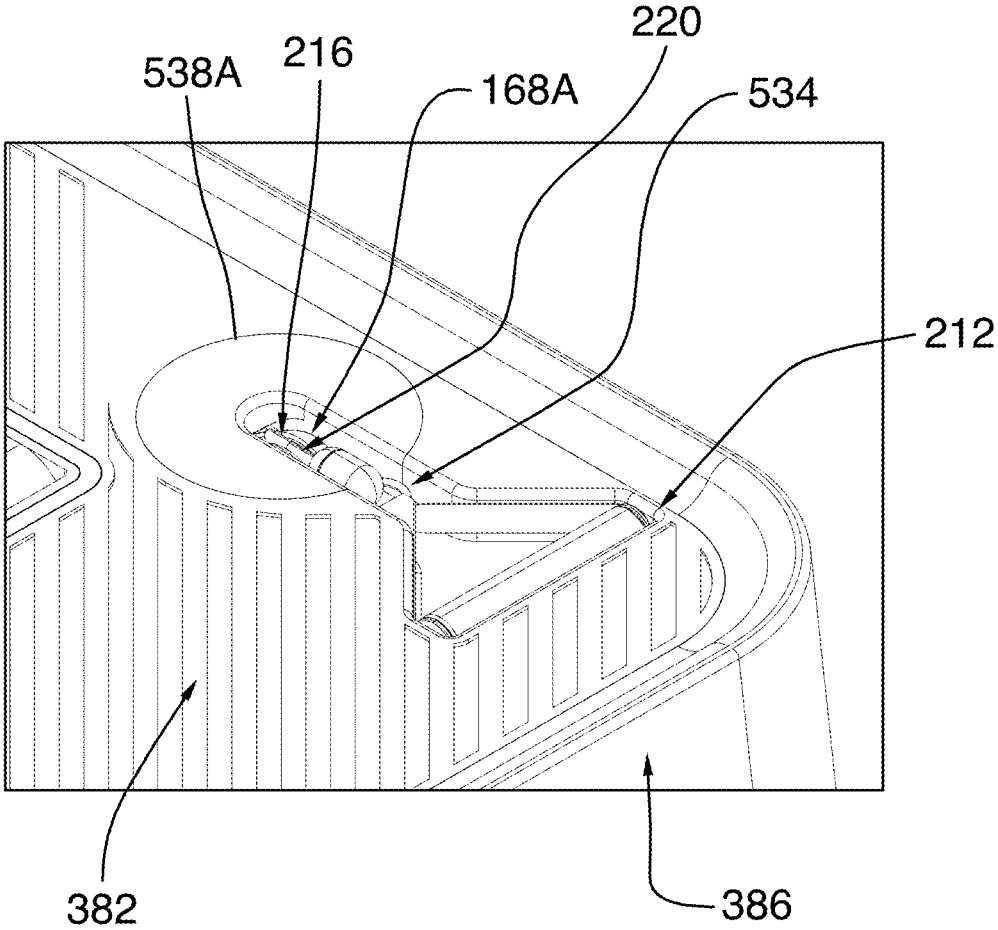
FIG. 41 is an enlarged partial front left perspective view of the front right corner of the treadmill module of exercise apparatus of FIG. 34, showing a resistance pulley in a retracted position, and the handle in a stored position.
Figure 42:
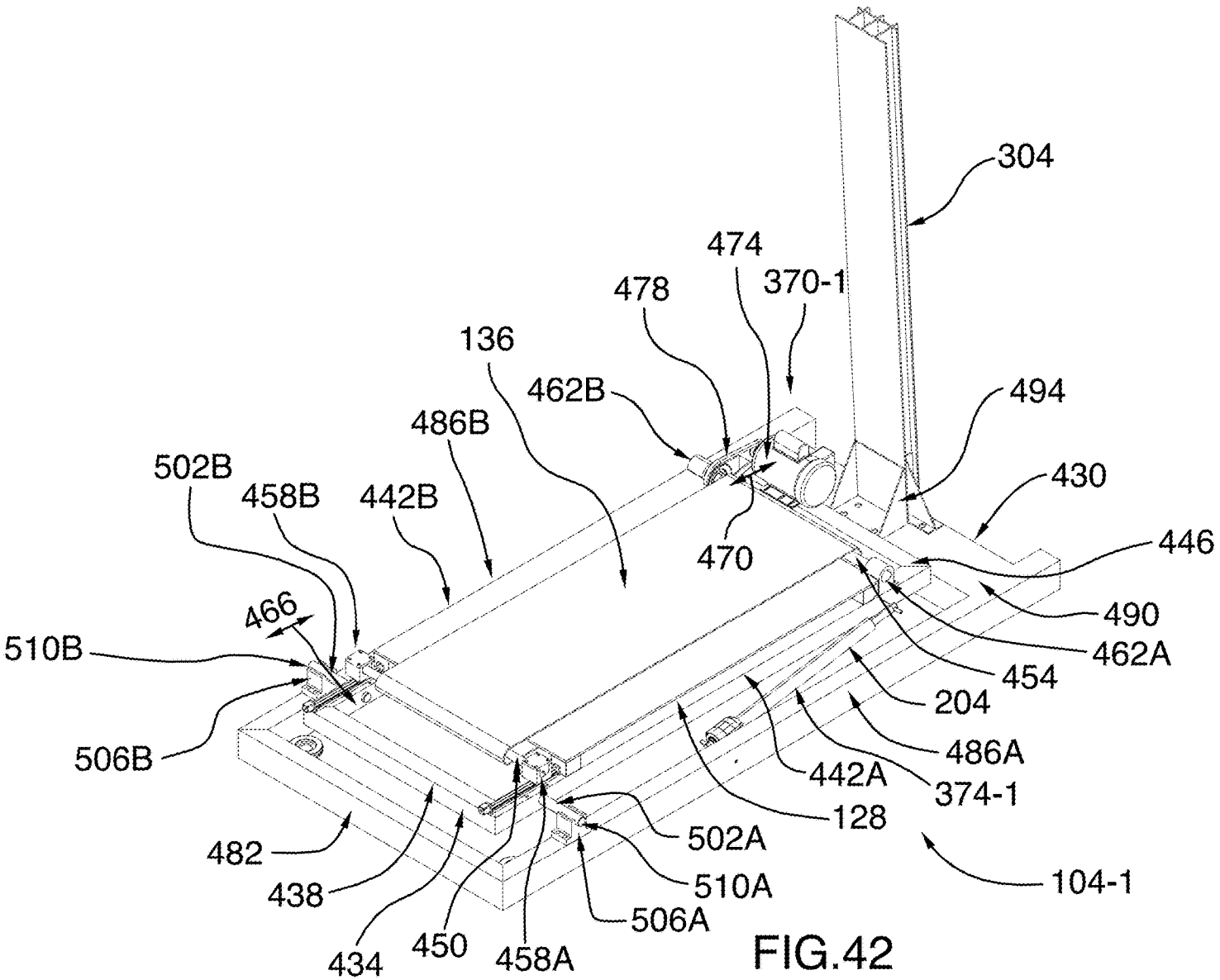
FIG. 42 is a front right perspective view of the exercise apparatus shown in FIG. 34 with the outer panels of the treadmill module and the center stack removed, depicting the inner workings of the treadmill module and the mast of the center stack.

Referring to FIG. 42, frame 430 is rectangular in shape with at least four members, front member 482, right member 486A, left member 486B and rear member 490. As can be seen in FIGS. 41 and 42, rear member 490 may be thicker than front member 482, right member 486A and left member 486B, so as to support inner mast 304. A brace 494 may also be used to support inner mast 304, and may be attached to rear member 490. In a preferred embodiment, frame 430 (also referred to herein as chassis 430) may be made out of aluminum and/or steel extrusions or members.

Returning to FIGS. 34 to 40, the rectangular frame 430 in conjunction with exercise platform 382 and outer walls 386, 406A, 406B and 410 provide additional support for exercise apparatus 100-1 from all sides, including the front and rear of exercise apparatus 100-1 as compared to the front of exercise apparatus 100 where there is a pass-through, and the rear of exercise apparatus 100 which is a triangular base. Furthermore, additional stability is provided from the base of exercise apparatus 100-1 as a whole, based on the bolstered nature of the base from the rectangular frame 430, exercise platform 382 and outer walls 386, 406A, 406B and 410. In addition, the base of exercise apparatus 100-1 provides four sides of contact with the floor surface further providing stability compared to exercise apparatus 100, where only three sides of the base are in contact with the floor surface. Stability for the base of exercise apparatus 100-1 is important due to the forces acted on the exercise apparatus 100-1 while a user exercises on said exercise apparatus 100-1, and also due to the uneven center of gravity and weight provided from center stack 108. A person skilled in the art will also contemplate other configurations and shapes of bases that may provide additional stability.

In the current embodiment, exercise platform 382 is on the same plane as running deck 128, and further surrounds running deck 128 as a border. For a user, exercise platform 382 may be considered an expansion of running deck 128, when treadmill belt 136 is in a locked configuration, as a surface to perform floor type exercises. Additionally, resistance pulleys 168A, 168B, 172A and 172B are located along the surface of exercise platform 382, allowing the user to use the resistance pulleys 168A, 168B, 172A and 172B to perform resistance-based exercises. In a preferred embodiment, exercise platform 382 is made from a slip-proof material, allowing a user to perform exercises on the exercise platform 382 without slipping. Alternatively, exercise platform 382 may be made of a metal or hard plastics to help support the weight of a user, and covered in a slip-proof material, such as rubber. In alternate embodiments, exercise platform 382 may have extrusions or bulges along the surface to provide additional friction and act as a slip-proof surface. A person skilled in the art will recognize the different configurations and materials available to be used to allow exercise platform 382 to support the weight of a user and also provide a slip-proof surface.

In a preferred embodiment, resistance pulleys 168A, 168B, 172A and 172B may be recessed into surrounding enclosure 378 and exercise platform 382. Referring to FIG. 41, resistance pulley 168A can be seen in its retracted position. As can be seen, the pulley 216, cable 220 and bearing 224 of resistance pulley 168A are recessed into exercise platform 382, specifically within recess 534. As such, the component with the greatest height, the pulley 216 is still below the planar surface of exercise platform 382, preventing it from becoming a tripping hazard. In an alternate embodiment (not shown), the pulley 216, cable 220 and bearing 224 may be below exercise platform 382, and be within the volume of surrounding enclosure 378, only providing a hole for cable 220 to be pulled out by handle 212.

Furthermore, resistance pulleys 168A, 168B, 172A and 172B may also be installed within rotating mechanisms 538A, 538B, 542A and 542B. Specifically, pulley 216, cable 220 and bearing 224 of each of the resistance pulleys 168A, 168B, 172A and 172B may reside within their respective rotating mechanisms 538A, 538B, 542A and 542B. Referring to FIG. 41, pulley 216, cable 220 and bearing 224 of resistance pulley 168A reside within rotating mechanism 538A, while handle 212 of resistance pulley 168A resides outside of rotating mechanism 538A, but within recess 534, as will be described further below. Rotating mechanism 538A is configured to allow pulley 216, cable 220 and bearing 224 to swivel/rotate. Rotating mechanism 538A allows a further reorientation of resistance pulley 168A when being used, allowing a more optimal angle for pulley 216 when cable 220 is pulled by a user during exercise, providing a better experience for the user when exercising. Furthermore, rotating mechanism 538A aids in preventing cable 220 from fraying along any hard edges of either pulley 216, or along the edges of recess 534.

Handle 212 is also within recess 534, in a stored position within the recess 534 of exercise platform 382. Similar to pulley 216, cable 220 and bearing 224, by having handle 212 within recess 534 and below the planar surface of exercise platform 382, it does not act as a tripping hazard, ensuring the safety of the user when they are exercising on exercise platform 382 when not using resistance pulley 168A. In alternate embodiments, handle 212 may be removably attached via snap fit to recess 534, to further ensure resistance pulley 168A from being a tripping hazard to the user. A person skilled in the art will recognize other forms of securing resistance pulleys 168A, 168B, 172A and 172B that may be used.

Returning to FIGS. 34 to 40, in the current embodiment, exercise platform 382 is wider along the front edge 414 in comparison to the exercise platform 382 along the right side edge 418A and left side edge 418B. In addition, the exercise platform 382 along the front edge 414, right side edge 418A and left side edge 418B is wider in comparison to the exercise platform along the rear edge 422. It will occur to a person skilled in the art that the width and size of the surface area of exercise platform 382 may vary and that different configurations of surface area of exercise platform 382 along each edge 414, 418A, 418B, and 422 may be contemplated. However, it will also occur to a person skilled in the art that the width of exercise platform 382 along rear edge 422 be relative to that of the preferred distance of a user from touch screen 112 and center stack 108, so that the user can still use touch screen 112 when operating the treadmill belt 136.

In the current embodiment, the resistance pulleys 168A, 168B, 172A and 172B are located on the surface of exercise platform 382, and as such the width of exercise platform 382 along the edges 414, 418A, 418B, and 422 can accommodate said resistance pulleys 168A, 168B, 172A and 172B. In an alternate embodiment, resistance pulleys 168A and 172A may be located along the surface of right outer wall 406A, and resistance pulleys 168B and 172B may be located along the surface of left outer wall 406B, allowing the width of exercise platform 382 to be narrower. A person skilled in the art will recognize the different potential configurations and their relation to the potential width and surface area size of exercise platform 382 that may be used.

Furthermore, the overall placement of resistance pulleys 168A and 168B in relation to treadmill belt 136 differs between exercise apparatus 100-1 and exercise apparatus 100. In exercise apparatus 100-1, resistance pulleys 168A and 168B are in closer proximity to the front of exercise apparatus 100-1 than treadmill belt 136. In addition, front edge 414 of exercise platform 382 extends between resistance pulleys 168A and 168B. In comparison, in exercise apparatus 100, treadmill belt 136 runs to the front edge of exercise apparatus 100-1, and treadmill belt 136 is in between resistance pulleys 168A and 168B.

Outer walls 386, 406A, 406B and 410 complete the enclosure and run along the outer peripheral of surrounding enclosure 378, protecting the internal components of treadmill module 104-1. Outer walls 386, 406A, 406B and 410 may be made out of metals or hard plastics. In a preferred embodiment, outer walls 386, 406A, 406B and 410 are made out of aluminium to provide adequate protection to treadmill module 104-1 while maintaining a lower weight than other materials.

Rear outer wall 410 may include positioning wheels 426. Specifically, positioning wheels 426 may be located along rear outer wall 410 in proximity to the ground. Positioning wheels 426 may also be attached to chassis 430. Positioning wheels 426 aid in moving exercise apparatus 100-1, specifically by tilting exercise apparatus 100-1 at an angle towards the rear of exercise apparatus 100-1. Positioning wheels may also include a locking mechanism. While there are two positioning wheels 426 in the current embodiment, a person skilled in the art will recognize that any number of positioning wheels 426, ranging from a single positioning wheel 426 to a plurality of positioning wheels 426 may be used. Furthermore, a person skilled in the art will also recognize the different configurations that may be used for the placement of positioning wheels 426. For example, in alternate embodiments, there may be three positioning wheels 426 along the rear outer wall 410. Alternatively, there may be four positioning wheels 426, one located on each corner of exercise apparatus 100-1.

Furthermore, exercise apparatus 100-1 differs from exercise apparatus 100 in the shape of various components. In exercise apparatus 100-1, pull up arm bar 300-1 is a single bar spanning between and extending beyond pull up arm bar holders 320A and 320B. The single pull up arm bar 300-1 allows for the same angle of rotation for the entire pull up bar 300-1, allowing better form when exercising. In comparison, pull up arm bar 300A and 300B may be a different angles providing greater flexibility in performing different exercises, and may provide worse form when performing certain exercises, such as two arm pull ups.

Pull up arm module 124 of exercise apparatus 100-1 also differs from that of exercise apparatus 100 in that shape of body 308 differs. Body 308 of exercise apparatus 100-1 does not include through hole 312, but rather is two separate vertical fins, a left and a right fin, each connected to a respective pull up arm bar holders 320A and 320B. Each fin is connected to the raising and lowering mechanism.

The raising and lowering mechanisms of crossarm module 116 and pull up arm module 124 of exercise apparatus 100-1 may differ than that of exercise apparatus 100. Linear guide rails (not shown) may be used to raise and lower cross arm module 116 and pull up arm module 124 in exercise apparatus 100-1. Alternatively, motors may spin worm gears to raise and lower cross arm module 116 and pull up arm module 124.

In addition, the right wing 252-1A and left wing 252-1B of crossarm module 116 of exercise apparatus 100-1 are straight angled arms as compared to right wing 252A and left wing 252B of exercise apparatus 100 which are triangular shaped with a hole. The straight angled arms of crossarm module 116 of exercise apparatus 100-1 weigh less as less material is used in comparison to the triangular arms of crossarm module 116 of exercise apparatus 100. The lighter weight allows less stress to be placed on the lowering and raising mechanisms of crossarm module 116. However, the triangular arms of crossarm module 116 of exercise apparatus 100 provide additional support and also act as a handle, allowing a user's hands to grip through the hole of the triangular arms when raising and lowering the crossarm module 116.

In addition, the angle of center stack 108 may differ in exercise apparatus 100-1 in comparison to exercise apparatus 100. The angle of center stack 108 may be dependent on several factors, including stability of exercise apparatus 100-1 or exercise apparatus 100, and the positioning of the user when performing exercises. For example, the angle of center stack 108 may be steeper in exercise apparatus 100 to position the user on top of treadmill belt 136 when using either center resistance pulley 120 or pull arm module 124. Similarly, with the availability of the additional surface area and size exercise platform 382, the angle of center stack 108 may be gentler due to the additional stability of the base of exercise apparatus 100-1 and also the placement of the user on exercise platform 382 when using pull up arm module 124 and center resistance pulley 120. A person skilled in the art will recognize the different angles and configurations of center stack 108 in various embodiments of exercise apparatuses.

Figure 43:
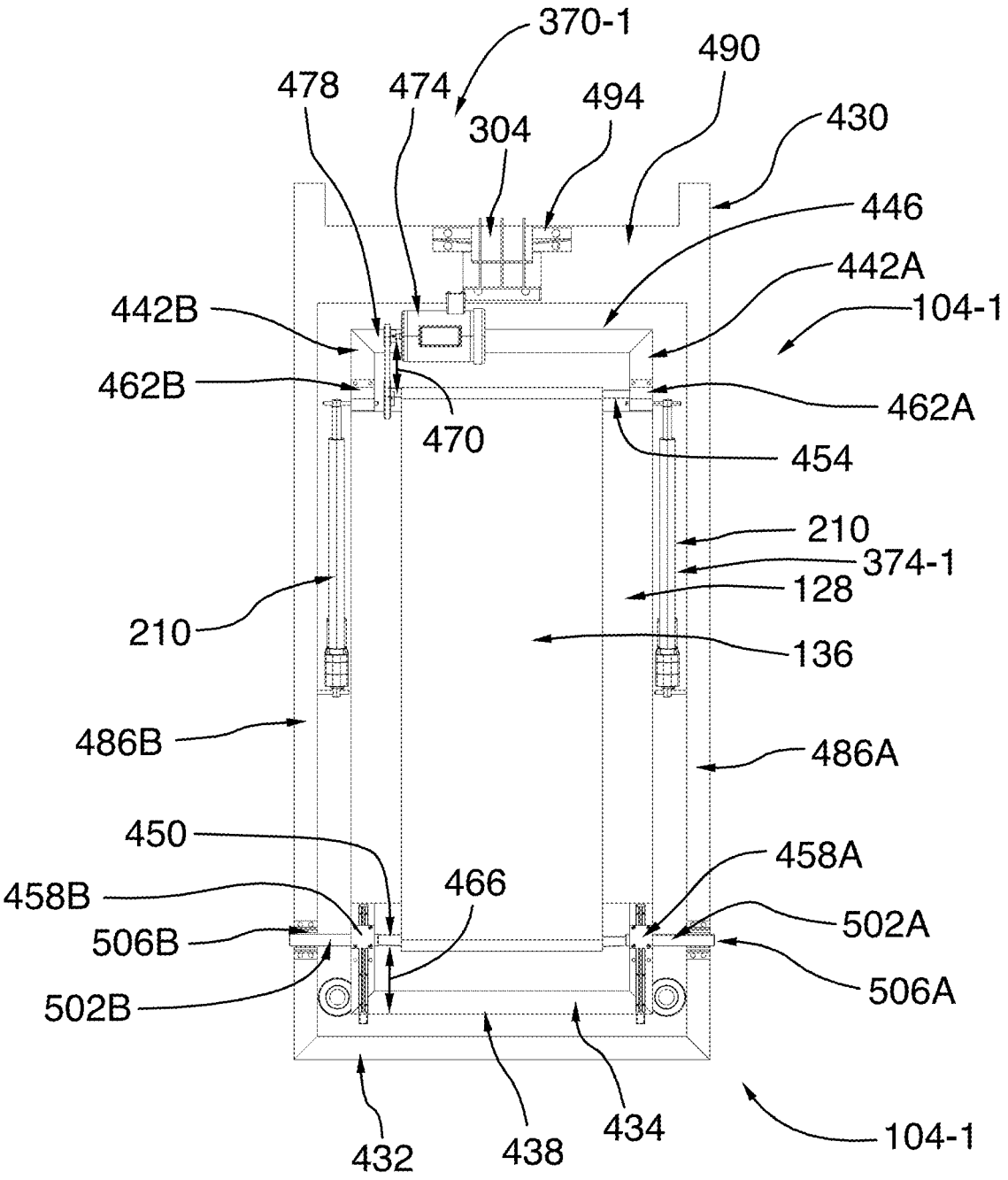
FIG. 43 is a top plan view of the treadmill module and mast of the exercise apparatus similar to that shown in FIG. 34.
Figure 44:
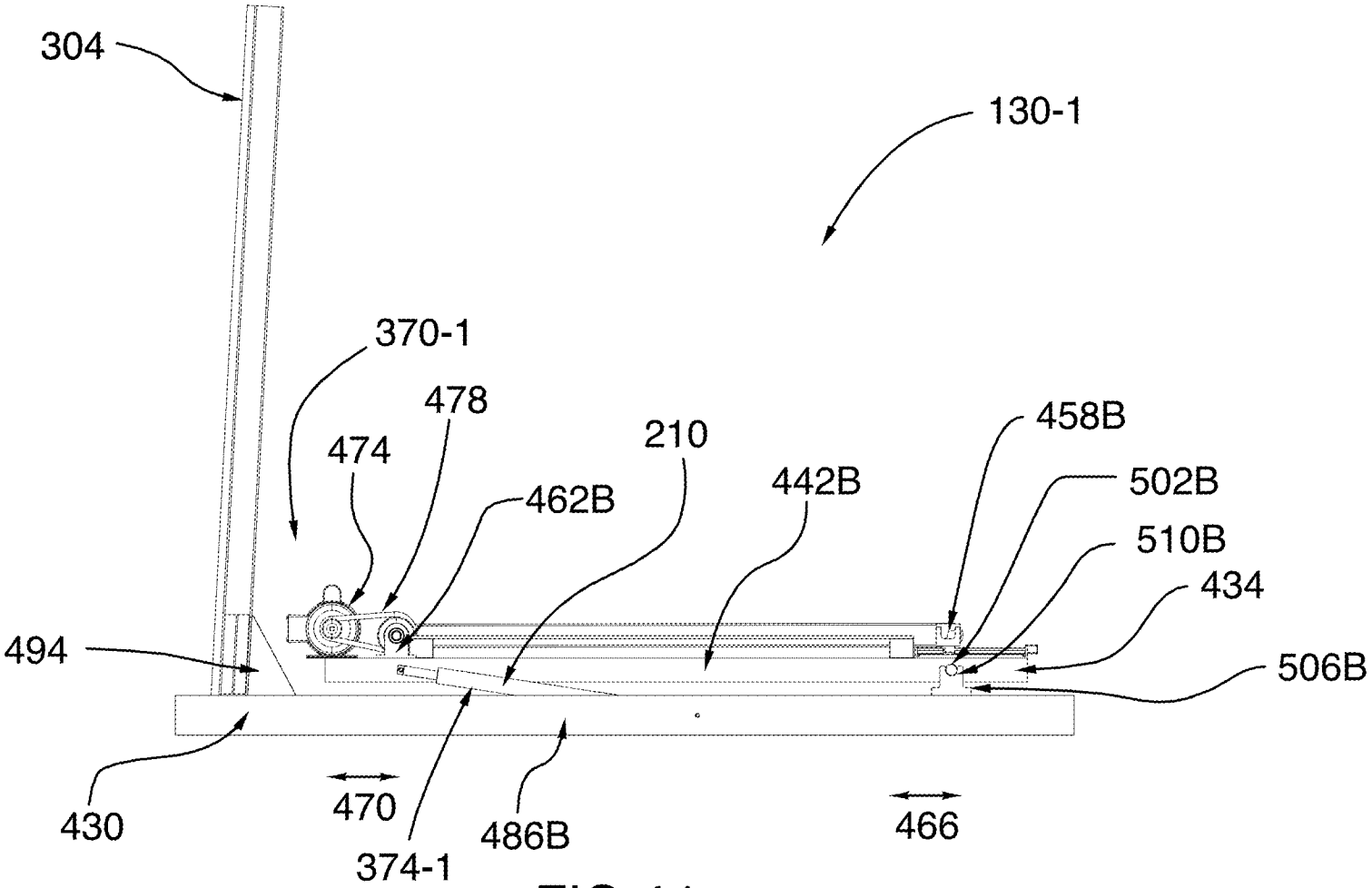
FIG. 44 is a left side view of the treadmill module and mast of the exercise apparatus similar to that shown in FIG. 34.

Referring to FIGS. 42 to 44, treadmill module 104-1 is depicted. Treadmill module 104-1 is similar to treadmill module 104, except that the components may be disposed at different locations, and may further be supported by different frames or support structures.

In the current embodiment, running deck 128 of treadmill module 104-1 is supported by treadmill module frame 434. Treadmill module frame 434 has a rectangular footprint and is made of four members attached to each other to form a rectangular shape. The four members include a front member 438, a right member 442A, a left member 442B and a rear member 446. The members may be made out of any material that can support the weight of the running deck and a user, such as aluminum or steel. Treadmill module frame 434 is mounted on chassis 430 as part of a treadmill inclination adjustment assembly 374-1 that allows for the inclination of treadmill frame 434. The treadmill inclination adjustment assembly 374-1 allowing the inclination of treadmill frame 434 will be discussed further below.

Treadmill drive assembly 370-1 includes treadmill belt 136, front drum 450, rear drum 454, motor 474, drive belt 478 and mounting points with bearings 458A, 458B, 462A, and 462B. Treadmill belt 136 is supported on top of running deck 128 and is rotationally mounted onto drums 450 and 454. Front drum 450 is located adjacent the front of the running deck 128 and rear drum 454 is located adjacent the rear of the running deck 128. Along right member 442A and left member 442B are mounting points 458A, 458B, 462A and 462B. Mounting points 458A, 458B, 462A and 462B each have bearings in them, and are configured to rotationally mount drums 450 and 454 extending between right member 442A and left member 442B. The bearings allow for drums 450 and 454 to freely rotate, allowing treadmill belt 136, which is in tension around both drums 450 and 454 to move.

In a preferred embodiment, mounting point 458A is located along right member 442A at a distance 466 from and in proximity to front member 438. Mounting point 458B is located along left member 442B at the same distance 466 from front member 438, ensuring that the front drum 450 extending between mounting point 458A on right member 442A and mounting point 458B on left member 442B is perpendicular to both right member 442A and left member 442B. Similarly, mounting point 462A is located along right member 442A at a distance 470 from and in proximity to rear member 446. Mounting point 462B is located along left member 442B at the same distance 470 from rear member 446, ensuring that the rear drum 454 extending between mounting point 462A on right member 442A and mounting point 462B on left member 442B is perpendicular to both right member 442A and left member 442B. This also ensures that front drum 450 and rear drum 454 are parallel to each other, allowing treadmill belt 136 to rotate freely.

Motor 474 is provided to drive rotation of one or both drums 450 and 454 and urge movement of the tread belt 136. In a preferred embodiment, motor 474 is mounted on treadmill module frame 434. In a more preferred embodiment, motor 474 is mounted at the rear of and on treadmill module frame 434.

In the current embodiment, motor 474 drives rear drum 454 with drive belt 478. Drive belt 478 is rotationally mounted on the drive shaft of motor 474 and rear drum 454. As the drive shaft of motor 474 spins, drive belt 478 translates the rotational movement to rear drum 454, urging rear drum 454 to rotate. Similarly, the rotational movement of rear drum 454 urges the movement of treadmill belt 136, which also urges front drum 450 to rotate.

A person skilled in the art will recognize that different forms of driving drums 450 and 454 may be used to urge treadmill belt 136 to rotate. For example, the drive shaft of motor 474 may be directly connected to drum 454, removing the need for drive belt 478. In another embodiment, motor 474 may be translating driving power to drum 454 through gears or means other than drive belt 478. Similarly, in the current configuration, there is a single motor 474 directly powering a single drum 454. In alternate embodiments, motor 474 and drive belt 478 may be located towards the front of treadmill module frame 434, and may be providing power to front drum 450. In yet another alternate embodiment, there may be two motors 474, one driving drum 454, and a second driving drum 450. A person skilled in the art will recognize that different configurations and layouts may be used to drive drums 450 and 454 to urge treadmill belt 136 to rotate.

Figure 45:
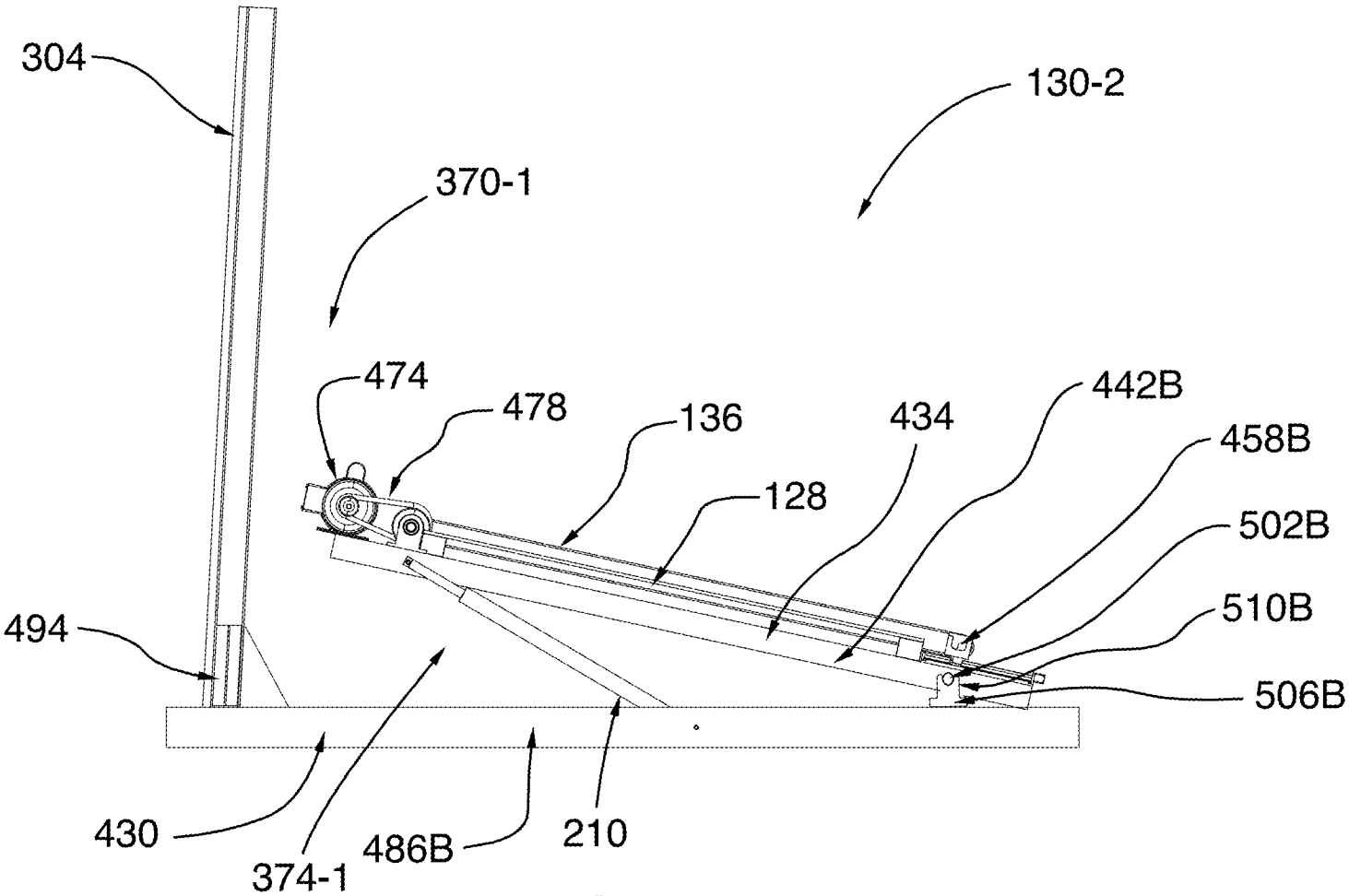
FIG. 45 is a left side view of the treadmill module and mast of the exercise apparatus similar to that shown in FIG. 36, except that the treadmill platform is shown in the raised position.

Referring to FIGS. 44 and 45, treadmill inclination adjustment assembly 374-1 is operable to incline or decline running deck 128 and treadmill module frame 434. FIG. 44 depicts the running deck in a lowered position 130-1. FIG. 45 depicts the running deck in a raised position 130-2. Treadmill inclination adjustment assembly 374-1 is similar to treadmill inclination adjustment assembly 374, except that there are two pneumatic cylinders 204, one on each side of treadmill module frame 434, and pivot points 210 are connected to treadmill module frame 434. Furthermore, treadmill inclination adjustment assembly 374-1 further includes lower right pivot point 498A and lower left pivot point 498B. Lower pivot points 498A and 498B each include a cylindrical member 502A and 502B that are rotationally mounted on mounting points 506A and 506B on chassis 430, specifically mounting point 506A may be located towards the front of exercise apparatus 100-1 on right member 486A at a distance 514 from front member 482, and mounting point 506B may be located towards the front of exercise apparatus 100-1 on left member 486B at the same distance 514 from front member 482. In the current embodiment, cylindrical members 502A and 502B each sit in a depression 510A and 510B on mounting points 506A and 506B, allowing for cylindrical members 502A and 502B to rotate within each depression 510A and 510B, allowing the front end/lower end of treadmill module frame 434 and running deck 128 to pivot as the rear end inclines upwards. It will occur to a person skilled in the art that different configurations may be used to provide a lower pivot point, such as providing mounting points 506A and 506B with bearings.

Referring to FIGS. 46 and 47, exercise apparatus 100-1 also includes an accessory storage compartment 518. Accessory storage compartment 518 provides a storage area for accessories, such as a straight bar, or handles to be attached to resistance pulleys 168A, 168B, 172A, 172B, 120, 264A and 264B to be stored when not in use. A person skilled in the art will recognize the different accessories that may be stored in accessory storage compartment 518. In a preferred embodiment, accessory storage compartment 518 is located at the rear of exercise apparatus 100-1 running along the height and width of center stack 108. Different sizes of accessory storage 518 may be contemplated. In a preferred embodiment, accessory storage compartment 518 is a single space and may be accessed via a pair of doors 522 that are configured to open outwardly. A person skilled in the art will recognize that any number of compartments, openings and doors may be contemplated. Accessory storage 518 may also include hooks, hangers and other attachments to hold and stow the accessories. Furthermore, accessory storage compartment 518 may also include lighting 526. Lighting 526 may be controlled via touch screen 112, or may automatically turn on and off based on motion sensors or the opening and closing of doors 522.

Figure 48:
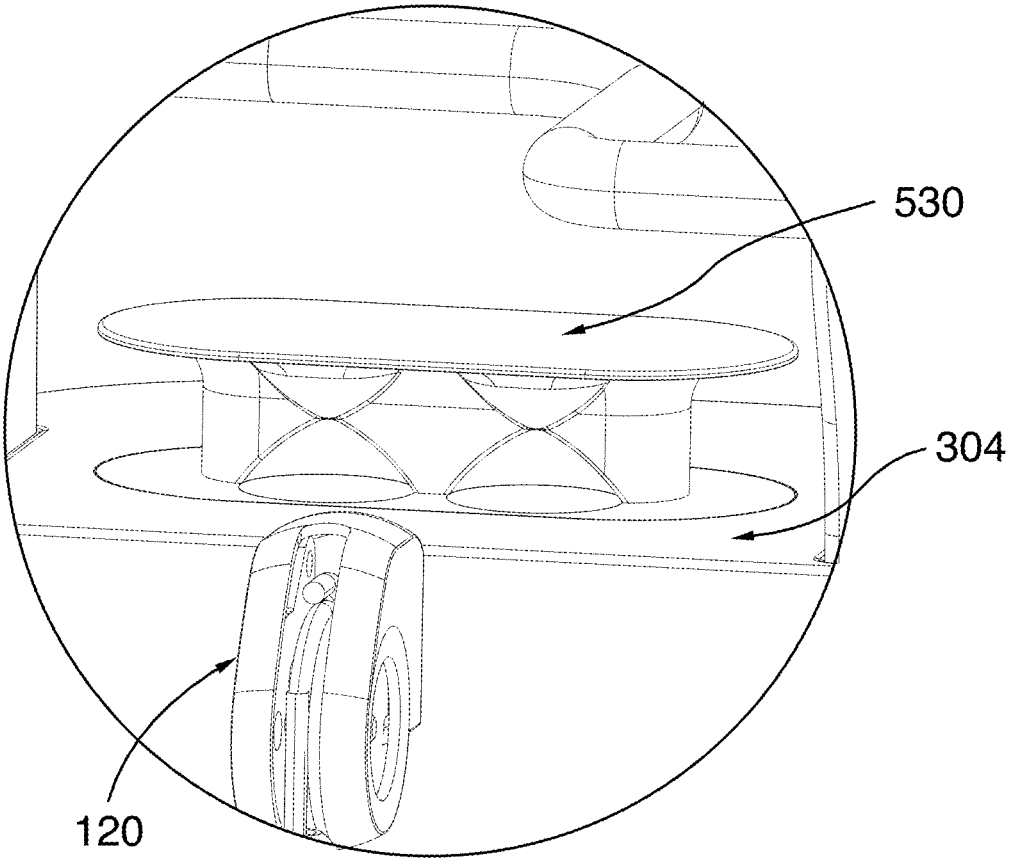
FIG. 48 is a partial front right perspective view of the speakers in a raised position above the center stack of the exercise apparatus shown in FIG. 34.

Referring to FIG. 48, exercise apparatus 100-1 may also include speakers 530. Speakers 530 may play audio from music or videos displayed on touch screen 112. For example, touch screen 112 may be displaying a workout video, of which the audio may be played from speakers 530. In alternate embodiments, speakers 530 may be connected to other electronic devices to play audio via Bluetooth connection. In a preferred embodiment, speakers 530 are located at the top of inner mast 304. In a more preferred embodiment, speakers 530 may be recessed and raised using a motor (not shown). In yet another preferred embodiment, speakers 530 may be a pair of 2.5 inch drivers and be made by Bang & Olufsen of Struer, Denmark. The raising and lowering of speakers 530, and the volume for speakers 530 may be controlled via computing device 350 via any input device, such as physical controls 394 or touch screen 112.

Figure 49:
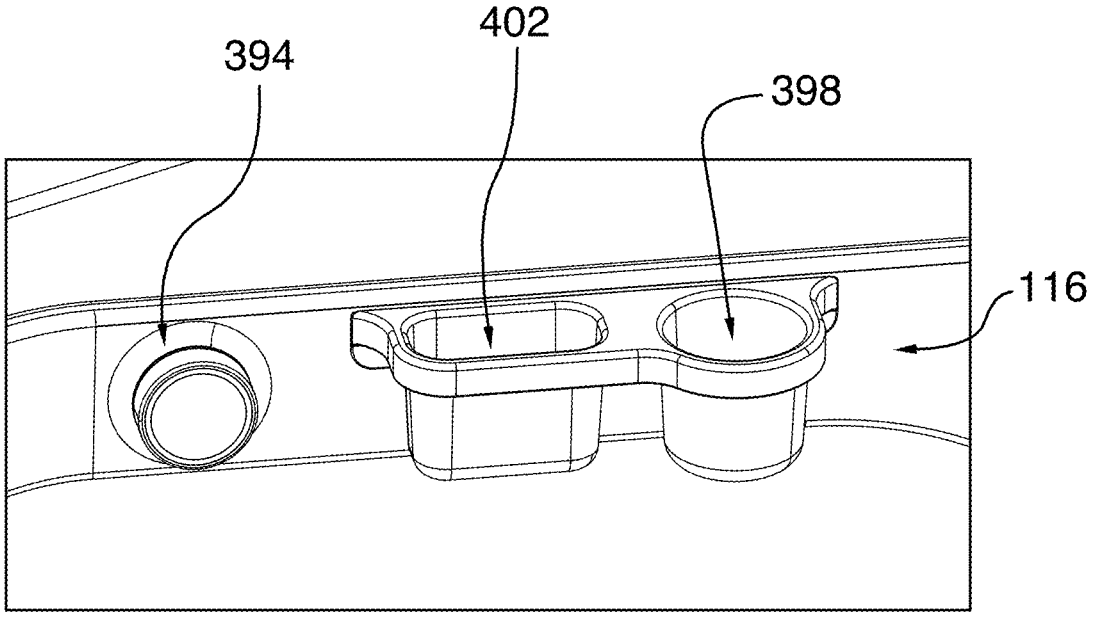
FIG. 49 is a partial front right perspective view of the rotary knob, cup holder and phone holder on the crossarm module of the exercise apparatus shown in FIG. 34.

Referring to FIG. 49, exercise apparatus 100-1 may also include physical controls 394 on crossarm module 116. Physical controls 394 may be any form of physical input device to control computing device 350. In a preferred embodiment, physical controls 394 may be a rotary knob to move between selected items on touch screen 112, or seek a time code on a video playing on touch screen 112, or raise or lower the volume of any audio playing on speakers 530. Other forms of physical controls 394, such as buttons may be contemplated. Exercise apparatus 100-1 may also include a phone holder 402 and/or a cup holder 398 on crossarm module 116. Cup holder 398 and phone holder 402 are not limited to holding phones, but may be used to hold any other item. Other devices or apparatus may also be contemplated, such as a wireless charger for phones or temperature-controlled cup holders. It will occur to a person skilled in the art that placement of physical controls 394, phone holder 402 and cup holder 398 is not limited to a single arm of crossarm module 116, but may be placed on both arms of crossarm module 116 or on other components of exercise apparatus 100-1.

Although the foregoing description and accompanying drawings to specific preferred embodiments of the present invention as presently contemplated by the inventor, it will be understood that various changes, modifications and adaptations, may be made without departing from the spirit of the invention.

The embodiments for which an exclusive privilege or property is claimed are as follows:

1. A multi-functional exercise apparatus comprising:

a treadmill module, the treadmill module including:

a first end;

a second end;

a running deck extending therebetween, the running deck being capable of serving as an exercise platform to support a user performing exercises; and a plurality of resistance pulleys integrated therewith;

a center stack attached to the second end of the treadmill module, the center stack including:

a display screen oriented towards the running deck for a user to interact with, the display screen being configured to provide instructions to the user in connection with performing exercises and to display statistics regarding a workout;

a crossarm module connected to the center stack being movable relative hereto between a raised position and a lowered position, the crossarm module including a first rotatable arm extending from a right side of the center stack, a second rotatable arm extending from a left side of the center stack, and at least one resistance pulley integrated with each of the first rotatable arm and the second rotatable arm; and a pull up arm module for performing pull up exercises located adjacent a top of the center stack, the pull up arm module being movable between a raised position and a lowered position, the pull up arm module including arms on either side of the pull up arm module;

the multi-functional exercise apparatus being configured to allow the user to perform a variety of exercises using the treadmill module, the crossarm module or the pull up arm module in rapid succession.

2. The multi-functional exercise apparatus of claim 1, wherein the running deck includes a treadmill platform configured to be inclinable or declinable.

3. The multi-functional exercise apparatus of claim 2, wherein the treadmill module includes a treadmill inclination adjustment assembly, the treadmill inclination adjustment assembly including a pneumatic cylinder pivotally connected to the treadmill platform.

4. The multi-functional exercise apparatus of claim 1, wherein the running deck includes a treadmill belt configured to be placed in a locked, freely movable or powered configuration.

5. The multi-functional exercise apparatus of claim 1, wherein the treadmill module has a rectangular footprint, and the plurality of resistance pulleys are located along margins of the rectangular footprint.

6. The multi-functional exercise apparatus of claim 5, wherein the plurality of resistance pulleys are located in recesses.

7. The multi-functional exercise apparatus of claim 6, wherein the plurality of resistance pulleys includes four resistance pulleys.

8. The multi-functional exercise apparatus of claim 7, wherein each of the four resistance pulleys is located in proximity to a corner of the treadmill module.

9. The multi-functional exercise apparatus of claim 1, wherein the display screen includes a touch screen.

10. The multi-functional exercise apparatus of claim 1, wherein the center stack includes at least one rail upon which the crossarm module is mounted on, the crossarm module being configured to slide upon the at least one rail to move between the raised position and the lowered position.

11. The multi-functional exercise apparatus of claim 1, further including a motor to move the crossarm module between the raised position and the lowered position.

12. The multi-functional exercise apparatus of claim 11, further including a controller, the motor being controllable by the controller, the controller being directed by a processor, the processor receiving instructions from the display, the user able to adjust the height of the crossarm module by interacting with the display.

13. The multi-functional exercise apparatus of claim 1, wherein the first and second rotatable arms of the crossarm module are movable between a push sled exercise position, and a stowage position, in the push sled exercise position each of the first and second rotatable arms presenting a vertical section oriented towards the user to push against while performing a push sled exercise.

14. The multi-functional exercise apparatus of claim 13, wherein the crossarm module includes a third rotatable arm and a fourth rotatable arm, the third rotatable arm extending from the right side of the center stack, the fourth rotatable arm extending from the left side of the center stack.

15. The multi-functional exercise apparatus of claim 14, wherein the third and fourth rotatable arms are movable to a treadmill exercise position, in the treadmill exercise position the third and fourth rotatable arms being rotated to serve as safety bars for the user when using the running deck.

16. The multi-functional exercise apparatus of claim 1, wherein the center stack further includes a center resistance pulley accessible from the treadmill module.

17. The multi-functional exercise apparatus of claim 1, wherein the center stack includes an inner mast and an outer mast, the inner mast extending from the treadmill module upwardly, the outer mast surrounding the inner mast, the pull up arm module to travel along the inner mast to move between the raised position and the lowered position.

18. The multi-functional exercise apparatus of claim 1, wherein the center stack includes a central mast, and an extension mast secured to the top of the central mast, the pull up arm module to travel along the extension mast to move between the raised position and the lowered position.

19. The multi-functional exercise apparatus of claim 1 further including a motor to move the pull up arm module between the raised position and the lowered position.

20. The multi-functional exercise apparatus of claim 19 further including a controller, the motor being controllable by a controller, the controller being directed by a processor, the processor receiving instructions from the display, the user able to adjust a height of the pull up arm module by interacting with the display.

21. The multi-functional exercise apparatus of claim 1, wherein the plurality of resistance pulleys integrated with the treadmill module being configured to securely attach at least one member of the group consisting of a bicycle and a wheelchair to a surface of the running deck to allow the user to perform cycling exercises.

22. The multi-functional exercise apparatus of claim 1, wherein the display screen being further configured to stream audio and video content.

* * * * *